US011679911B2

(12) United States Patent
Turvey et al.

(10) Patent No.: US 11,679,911 B2
(45) Date of Patent: Jun. 20, 2023

(54) SLIDER WITH ERGONOMIC FEATURES

(71) Applicant: S.C. Johnson & Son, Inc., Racine, WI (US)

(72) Inventors: Robert R. Turvey, Sanford, MI (US); Lawrence C. Stanos, Midland, MI (US); Bryan L. Ackerman, Freeland, MI (US); Matthew N. Thurin, Wauwatosa, WI (US); Christina J. Korinda, Midland, MI (US)

(73) Assignee: S.C. Johnson & Son, Inc., Racine, WI (US)

( * ) Notice: Subject to any disclaimer, the term of this patent is extended or adjusted under 35 U.S.C. 154(b) by 4 days.

(21) Appl. No.: 17/243,624

(22) Filed: Apr. 29, 2021

(65) Prior Publication Data

US 2021/0245928 A1 Aug. 12, 2021

Related U.S. Application Data

(63) Continuation of application No. 16/986,549, filed on Aug. 6, 2020, now Pat. No. 11,027,890, which is a (Continued)

(51) Int. Cl.
*B65D 33/25* (2006.01)
*A44B 19/26* (2006.01)

(52) U.S. Cl.
CPC ..... *B65D 33/2541* (2013.01); *A44B 19/26* (2013.01); *A44B 19/262* (2013.01); (Continued)

(58) Field of Classification Search
CPC ..... B65D 33/2591; B65D 33/2558; B65D 33/255; B65D 33/2508; B65D 33/2541; A44B 19/262; A44B 19/26; Y10T 24/158
See application file for complete search history.

(56) References Cited

U.S. PATENT DOCUMENTS

D114,269 S 4/1939 Poux
3,115,689 A 12/1963 Jacobs
(Continued)

FOREIGN PATENT DOCUMENTS

JP 05-91907 A 4/1993
JP 05-91911 A 4/1993
(Continued)

OTHER PUBLICATIONS

PCT/US2015/036741 International Search Report and Written Opinion dated Mar. 24, 2016.
(Continued)

*Primary Examiner* — Robert Sandy
*Assistant Examiner* — Louis A Mercado

(57) ABSTRACT

A slider for a closure assembly of a bag. The slider has a pair of finger pads extending from a top wall. Each pad has a surface with a curved portion running from a front end to a back end of the slider, a defined, first curved area extending from the curved portion to an end of the first curved area, and a defined, second curved area extending from the end of the first curved area to a midpoint of the curved portion. The first curved area and the second curved area are defined by different angles at which the respective curved area extends into the respective finger pad. Each finger pad includes a major axis dimension greater than a minor axis dimension to provide an area that fits an average finger size, and a lip region to guide a finger of a user into a finger pad.

20 Claims, 35 Drawing Sheets

Related U.S. Application Data continuation of application No. 16/361,882, filed on Mar. 22, 2019, now Pat. No. 10,773,858, which is a continuation of application No. 14/744,742, filed on Jun. 19, 2015, now Pat. No. 10,301,076.

(60) Provisional application No. 62/014,977, filed on Jun. 20, 2014, provisional application No. 62/014,957, filed on Jun. 20, 2014.

(52) U.S. Cl.
CPC ..... *B65D 33/255* (2013.01); *B65D 33/2508* (2013.01); *B65D 33/2558* (2013.01); *Y10T 24/158* (2015.01)

(56) References Cited

U.S. PATENT DOCUMENTS

| | | | |
|---|---|---|---|
| 5,063,644 | A | 11/1991 | Herrington et al. |
| 5,067,208 | A | 11/1991 | Herrington et al. |
| 5,070,583 | A | 12/1991 | Herrington |
| 5,189,764 | A | 3/1993 | Herrington et al. |
| 5,442,837 | A | 8/1995 | Morgan |
| 5,448,808 | A | 9/1995 | Gross |
| 5,718,024 | A | 2/1998 | Robbins |
| 5,867,875 | A | 2/1999 | Beck et al. |
| 5,896,627 | A | 4/1999 | Cappel et al. |
| 5,983,466 | A | 11/1999 | Petkovsek |
| 6,014,795 | A | 1/2000 | McMahon et al. |
| D422,909 | S | 4/2000 | Smith et al. |
| 6,088,887 | A | 7/2000 | Bois |
| 6,112,374 | A | 9/2000 | Van Erden |
| D439,866 | S | 4/2001 | Savicki, Sr. |
| 6,220,754 | B1 | 4/2001 | Stiglic et al. |
| 6,247,844 | B1 | 6/2001 | Tomic et al. |
| 6,257,763 | B1 | 7/2001 | Stolmeier et al. |
| D449,794 | S * | 10/2001 | Savicki, Sr. ..... D11/221 |
| 6,306,071 | B1 | 10/2001 | Tomic |
| 6,461,042 | B1 | 10/2002 | Tomic et al. |
| 6,595,689 | B1 | 7/2003 | Borchardt et al. |
| 6,739,755 | B2 | 5/2004 | Schreiter |
| D490,706 | S | 6/2004 | Smith et al. |
| 6,854,887 | B2 | 2/2005 | Anderson |
| 6,915,546 | B2 | 7/2005 | Kasai |
| 6,948,848 | B2 | 9/2005 | Ausnit |
| 6,951,421 | B2 | 10/2005 | Crunkleton et al. |
| 7,017,240 | B2 | 3/2006 | Savicki |
| D520,870 | S | 5/2006 | Withers |
| 7,036,987 | B2 | 5/2006 | Crunkleton et al. |
| D525,122 | S | 7/2006 | Turvey |
| 7,137,736 | B2 | 11/2006 | Pawloski et al. |
| 7,165,292 | B2 | 1/2007 | Kasai |
| 7,188,394 | B2 | 3/2007 | Turvey et al. |
| 7,263,748 | B2 | 9/2007 | Blythe |
| 7,269,883 | B2 | 9/2007 | Savicki |
| 7,287,904 | B2 | 10/2007 | Withers |
| 7,410,298 | B2 | 8/2008 | Pawloski |
| 7,461,434 | B2 | 12/2008 | Ackerman |
| 7,496,992 | B2 | 3/2009 | Ausnit |
| 7,549,954 | B2 | 6/2009 | Blythe |
| 7,574,781 | B2 | 8/2009 | Ackerman et al. |
| 7,574,782 | B2 | 8/2009 | Ackerman |
| 7,670,051 | B2 | 3/2010 | Chaturvedi |
| 7,797,802 | B2 | 9/2010 | Ackerman |
| 7,850,368 | B2 | 12/2010 | Pawloski et al. |
| 8,434,943 | B2 | 5/2013 | Blythe |
| 8,523,438 | B2 | 9/2013 | Roger |
| 8,926,179 | B2 | 1/2015 | Ackerman |
| 2004/0078971 | A1 | 4/2004 | Withers |
| 2005/0063616 | A1 | 3/2005 | Chang |
| 2005/0220372 | A1 | 10/2005 | Withers |
| 2006/0168777 | A1 | 8/2006 | Turvey et al. |
| 2006/0168778 | A1 | 8/2006 | Turvey et al. |
| 2006/0210201 | A1 | 9/2006 | Ackerman et al. |
| 2006/0269171 | A1 | 11/2006 | Turvey et al. |
| 2007/0180668 | A1 | 8/2007 | Ackerman et al. |
| 2009/0139067 | A1 | 6/2009 | Ackerman |
| 2011/0311167 | A1 | 12/2011 | Hall |
| 2013/0291349 | A1 | 11/2013 | Roger |

FOREIGN PATENT DOCUMENTS

| | | | |
|---|---|---|---|
| JP | 10-501714 | A | 2/1998 |
| JP | H10-503672 | A | 4/1998 |
| JP | 2002-511285 | A | 4/2002 |
| JP | 2003-522547 | A | 7/2003 |
| JP | 2005-520749 | A | 7/2005 |
| WO | 91/13562 | A1 | 9/1991 |
| WO | 2006/112035 | A1 | 10/2006 |

OTHER PUBLICATIONS

Office Action (with English translation) dated Feb. 18, 2019, issued in corresponding Japanese Patent Application No. 2017-519461.
Office Action (with English translation) dated Oct. 11, 2019, issued in corresponding Japanese Patent Application No. 2016-574248.

* cited by examiner

SLIDER WITH ERGONOMIC FEATURES

CROSS REFERENCE TO RELATED APPLICATIONS

This application is a continuation of U.S. patent application Ser. No. 16/986,549, filed Aug. 6, 2020, now U.S. Pat. No. 11,027,890, issued Jun. 8, 2021, which is a continuation of U.S. patent application Ser. No. 16/361,882, filed Mar. 22, 2019, now U.S. Pat. No. 10,773,858, issued Sep. 15, 2020, which is a continuation of U.S. patent application Ser. No. 14/744,742, filed Jun. 19, 2015, now U.S. Pat. No. 10,301,076, issued May 28, 2019, which claims the benefit of priority of U.S. Provisional Patent Application No. 62/014,977, filed Jun. 20, 2014, and U.S. Provisional Patent Application No. 62/014,957, filed Jun. 20, 2014, each of which is incorporated herein in its entirety.

FIELD OF THE INVENTION

Our invention relates generally to sliders for use on closure assemblies. More specifically, our invention relates to hinged sliders that include at least one separator finger or separating mechanism for opening and closing at least one pair of interlocking profiles of a closure assembly. The sliders and closure assemblies of our invention are often disposed on, for example, pouches, such as resealable thermoplastic storage bags.

RELATED ART

Storage bags made from flexible plastic materials are well known. Such storage bags are made in a variety of sizes, and can be used to contain a variety of items, including food, utensils, clothing, tools, etc. Such storage bags often include some type of zipper-like closure mechanism to resealably seal the interior of the bag. Plastic storage bags with closure mechanisms are sold by the assignee of the present application under the ZIPLOC® trademark.

The closure mechanisms of plastic storage bags, which are often referred to as a fastener assembly or a zipper, include interlocking closure profiles at a top end of the bag. Closure mechanisms having a single pair of opposing elongate interlocking profiles that are occluded between a user's fingers to create a resealable seal are well known. In addition, closure mechanisms having multiple pairs of elongate interlocking profiles, for example, opposing upper and lower interlocking profiles that are pressed together by the user's fingers, are also used to create a stronger and more secure seal than single pairs. Alternatively, it is also known to use sliders with closure assemblies that have single and multiple interlocking profile pairs to open and to close the seal. The sliders can be placed onto the closure assemblies via various means, including, for example, creating a slider with hinged wings, such that the wings can be folded and snapped into place to attach the slider onto the closure assembly during manufacturing of the storage bag.

SUMMARY OF THE INVENTION

According to one aspect, our invention provides a slider for a closure assembly of a bag. The slider comprises a top wall and a pair of wings extending from the top wall. A first wing of the pair of wings comprises a first finger pad and a surrounding lip, and a second wing of the pair of wings comprises a second finger pad and a surrounding lip. The first and second finger pads each have a major axis dimension that is larger than a minor axis dimension to provide a slider with an improved ergonomic feel.

Other aspects and advantages of the present invention will become apparent upon consideration of the following detailed description.

DETAILED DESCRIPTION OF THE INVENTION

Our invention relates to sliders for opening and closing at least one pair of interlocking profiles of a closure assembly. In particular, our invention relates to hinged sliders that include at least one separator finger or separating mechanism for opening and closing interlocking profiles of a closure assembly. In this regard, the interlocking profiles of the closure assembly are generally provided on sidewalls of a storage bag, and the slider is configured to be operatively engaged on the interlocking profiles of the bag.

As will be apparent from the description herein, the term "bag" encompasses a broad range of structures designed to contain items, such as pouches, envelopes, packets, and the like. In general, the term bag, as used herein, simply means a somewhat flexible container with an opening, with the bag being capable of carrying any number of items.

Figure 1:
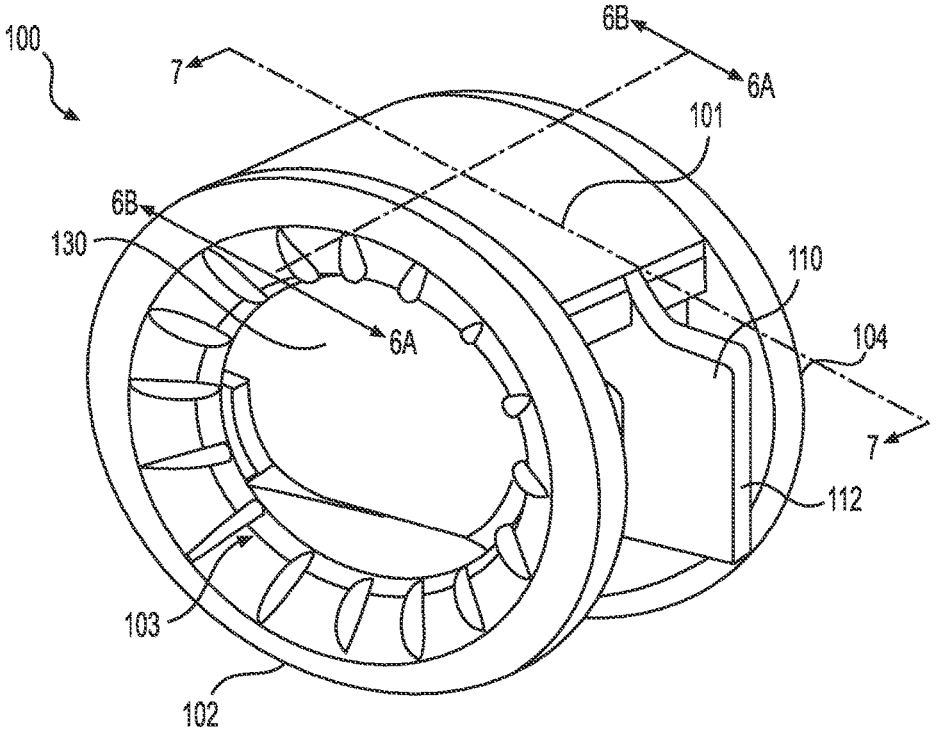
FIG. 1 is a top perspective view of a slider according to one embodiment of the invention.
Figure 2:
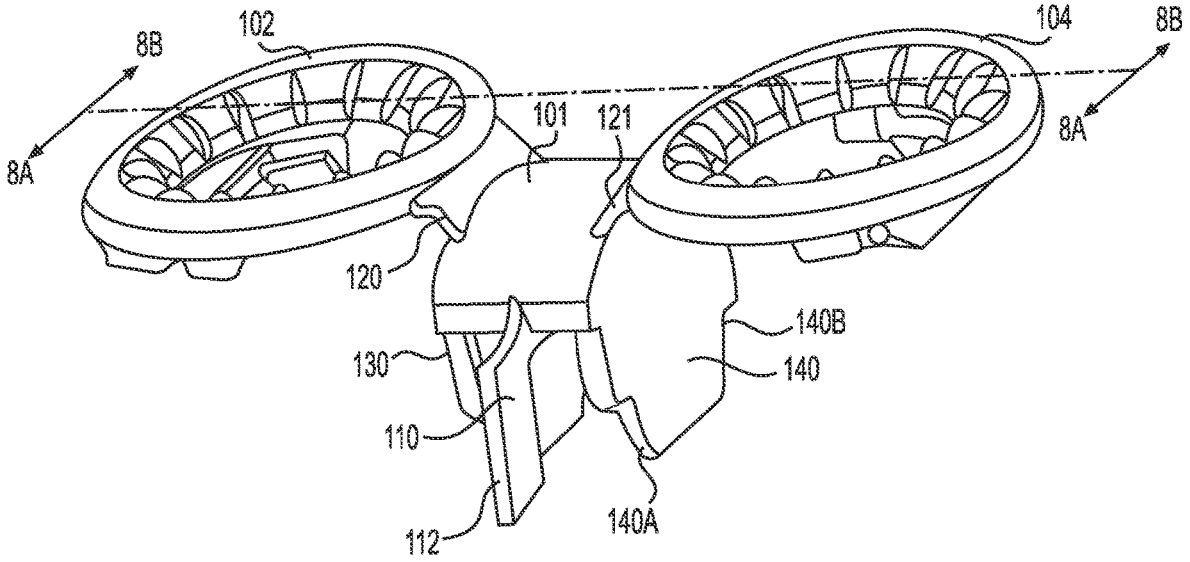
FIG. 2 is a top perspective view of the slider shown in FIG. 1 in an opened position.

Turning now to the drawings, FIGS. 1 and 2 illustrate one embodiment of a slider 100 that includes first and second opposing wings 102, 104 extending from a top wall 101 defining a channel therebetween in which a closure assembly, such as a single or double zipper, can be operatively accepted. The first and second wings 102, 104 encompass sidewalls of the slider 100, which are hingedly attached to the slider 100. In particular, the first wing 102 is hingedly attached to the top wall 101 of the slider 100 via a hinge 120, while the second wing 104 is hingedly attached to the top wall 101 of the slider 100 via a hinge 121. The first wing 102 includes an opening 103 exposing an interior leg 130 of the slider 100. The second wing 104 also includes a similar opening 105 that is not shown in FIG. 1. Although the opening 103 is hollow in the embodiment shown in FIG. 1, the opening 103 could alternatively be completely filled-in or partially filled-in. In addition, the opening 103, which is an arcuate-shaped opening, could be an ellipse or an oval shape, as shown in, for example, FIG. 1, or the opening 103 could be of a different shape, such as, for example, a circular, rectangular, or square shape, or any other polygonal shape, etc., since the specific shape and configuration of the wings and/or openings can be altered without departing from the spirit of the invention. The top wall 101 includes a pair of vertically extending legs 130, 140 that extends from opposing sides of the top wall 101. The leg 130 extends from the top wall 101 starting at the hinge 120 to a bottom edge that includes a front face 130A and a back face 130B (see, e.g., FIG. 4). The leg 140 also extends from the top wall 101 starting at the hinge 121 to a bottom edge that includes a front face 140A and a back face 140B.

Figure 3:
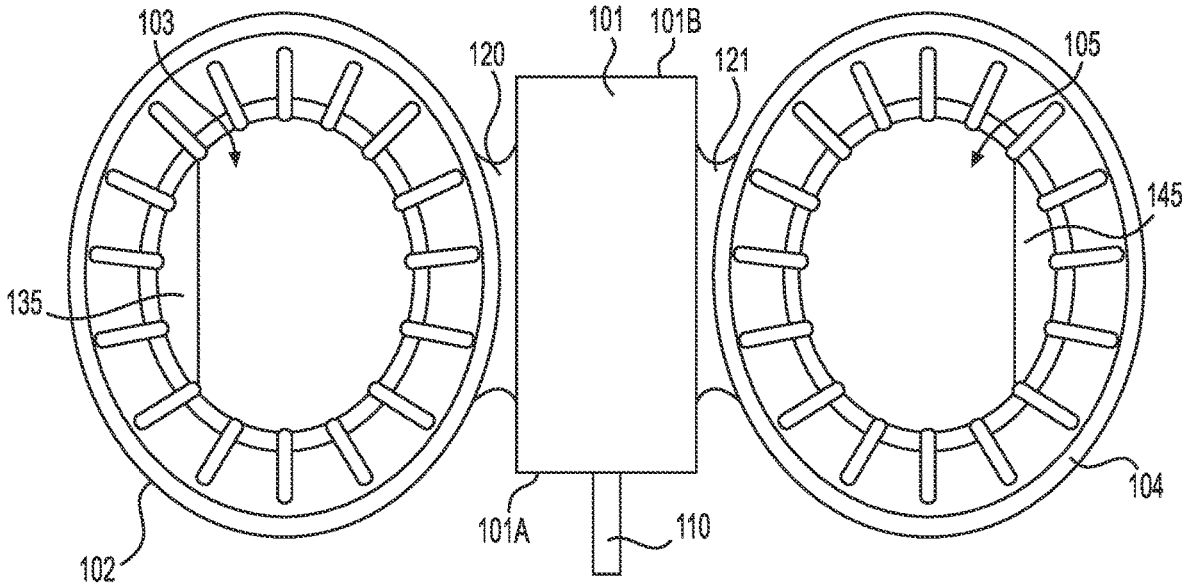
FIG. 3 is a top view of the slider shown in FIG. 1 in an opened position.

As shown in FIGS. 1-3, the slider 100 further includes a central protrusion, such as a separator finger 110, that extends from the top wall 101 into the channel spaced between the first and second wings 102, 104, and the pair of legs 130, 140. The separator finger 110 includes a first opening member 114 (see, e.g., FIGS. 6B and 7) at a front end 101B of the top wall 101. The separator finger 110 also includes a second opening member 112 at a back end 101A of the top wall 101. The first and second opening members 114, 112 of the separator finger 110 are configured to gently separate closure elements of a closure assembly, once the slider 100 is operatively engaged on the closure assembly.

Figure 4:
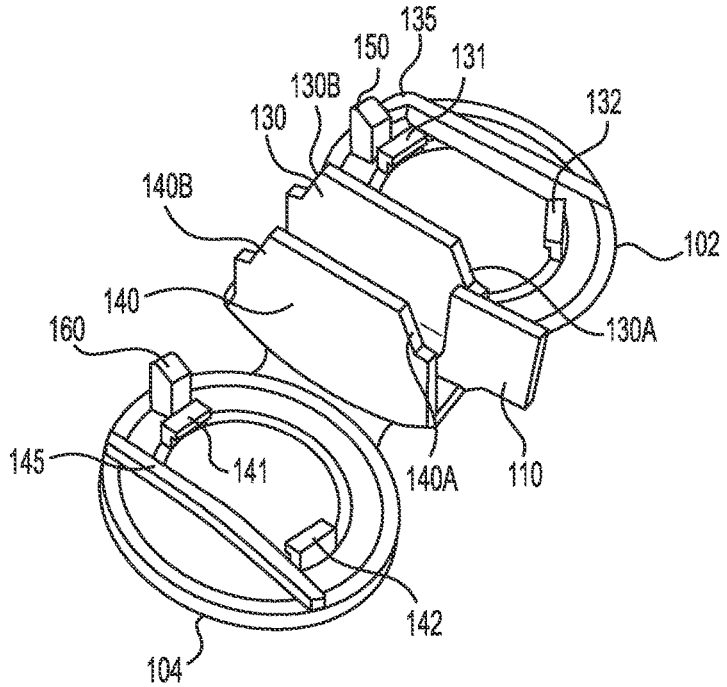
FIG. 4 is a bottom perspective view of the slider shown in FIG. 1 in an opened position.
Figure 5:
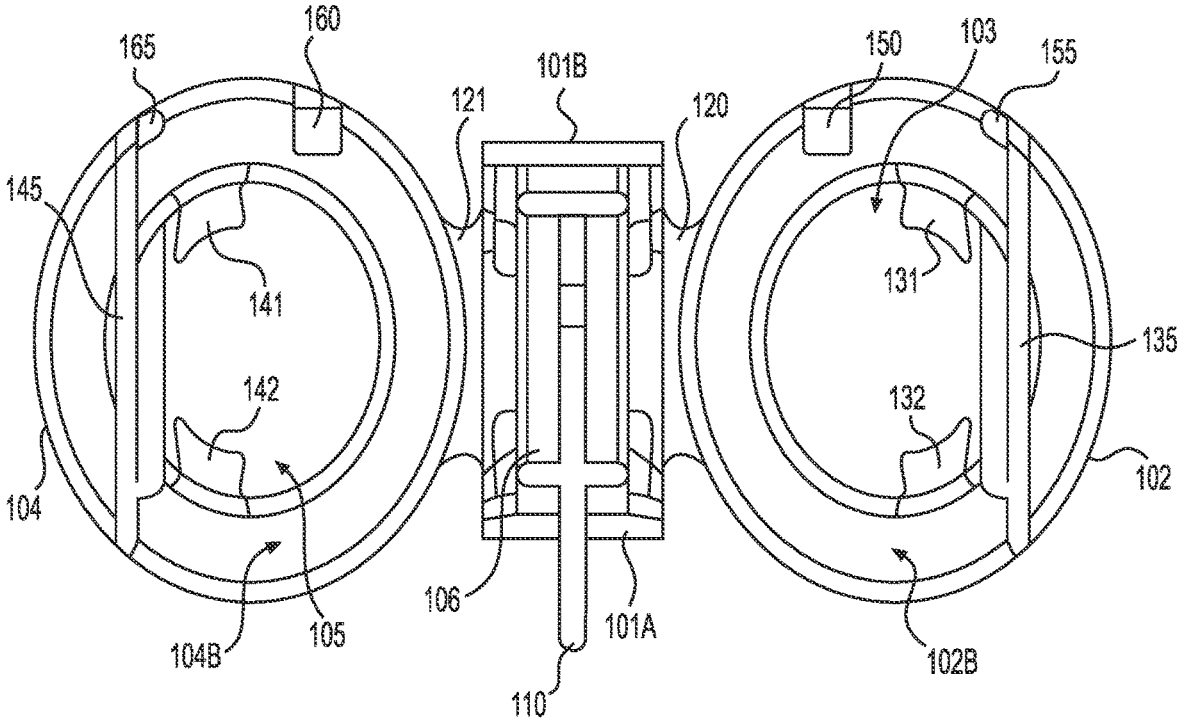
FIG. 5 is a bottom view of the slider shown in FIG. 1 in an opened position.
Figure 6A:
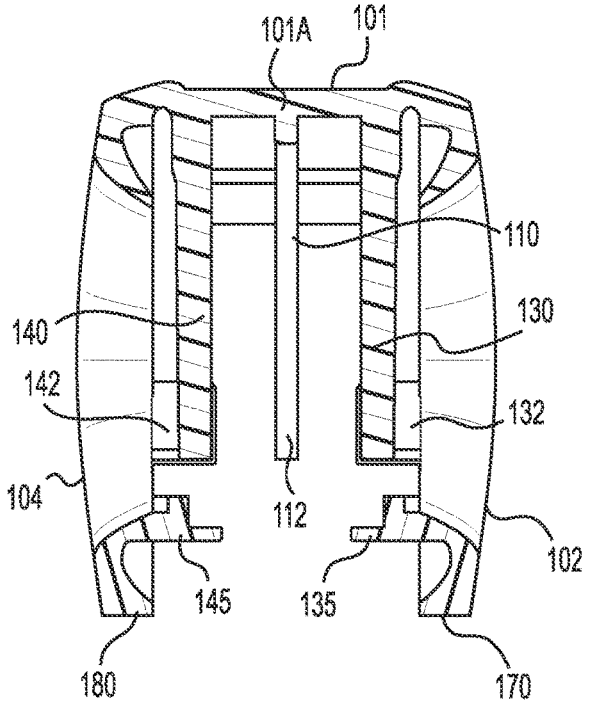
FIG. 6A is a back-side cross-sectional view taken along line 6A-6A of FIG. 1 showing the slider of FIG. 1 in a closed position.
Figure 6B:
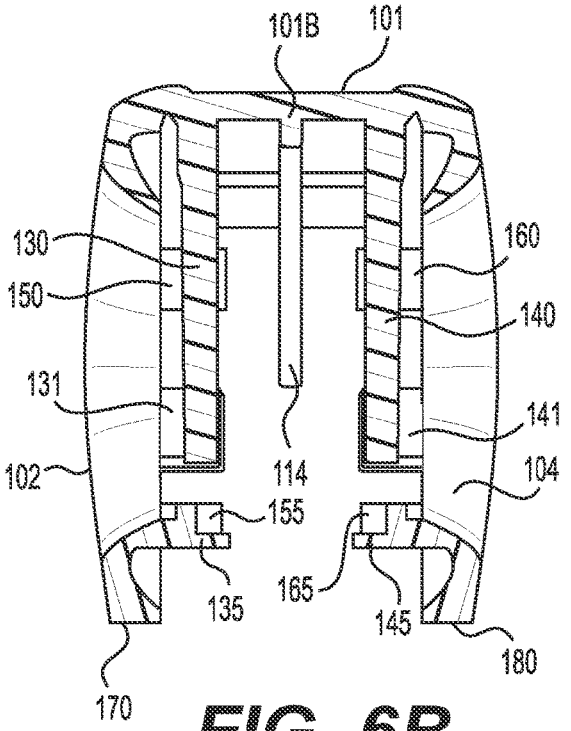
FIG. 6B is a front-side cross-sectional view taken along line 6B-6B of FIG. 1 showing the slider of FIG. 1 in a closed position.

As shown in FIGS. 4 and 5, the interior surfaces of the first and second wings 102, 104 include various elements for attaching the first and second wings 102, 104 to a respective leg 130, 140 of the slider 100. In particular, the first wing 102 includes a pair of latches 131, 132 that is disposed on opposing sides of the interior surface of the opening 103. A crossbar 135 is also included on the interior surface of the first wing 102, underneath the latches 131, 132 and above the bottom edge 170 of the first wing 102 (see, e.g., FIGS. 6A and 6B), to provide strength and stability. The second wing 104 also includes a pair of latches 141, 142 that is disposed on opposing sides of the interior surface of the opening 105. In addition, the interior surface of the second wing 104 includes a crossbar 145, underneath the latches 141, 142 and above the bottom edge 180 of the second wing 104 (see, e.g., FIGS. 6A and 6B), to provide strength and stability. The crossbars 135, 145 can further be configured as retention means, such that the crossbars 135, 145 assist in retaining the slider 100 on a closure assembly. While the embodiment of FIG. 4 illustrates the latches 131 and 141 being disposed about one hundred eighty degrees apart from their corresponding latches, 132 and 142, respectively, the latches can be disposed along various positions of the interior surface of the respective opening 103, 105. Alternatively, the latches 131, 132, 141, and 142 can be disposed at one or more positions along the respective crossbar 135, 145. The latch 132 of the first wing 102 is configured to engage with the front face 130A of the leg 130, while the latch 131 is configured to engage with the back face 130B of the leg 130. Similarly, the latch 142 of the second wing 104 is configured to engage with the front face 140A of the leg 140, while the latch 141 is configured to engage with the back face 140B of the leg 140. The latching mechanism is a compression-type latch in that the latches 131, 132, 141, and 142 are flexible enough to deflect and to snap around their respective legs 130, 140 to lock the first and second wings 102, 104 into position with their respective leg 130, 140. In particular, as shown in FIGS. 6A and 6B, when the slider 100 is in the closed position, the latches 131,132 have deflected and snapped into place around the leg 130, while the latches 141, 142 have deflected and snapped into placed around the leg 140. Once the first and second wings 102, 104 are latched with their respective leg 130, 140, it becomes difficult for a user to disengage the first and second wings 102, 104 with their respective leg 130, 140.

As also shown in FIGS. 4 and 5, each of the first and second wings 102, 104 includes a first closing bar 150, 160 and a second closing bar 155, 165 that are provided on one side of the interior surface of the respective wing 102, 104. The closing bars 150, 155, 160, 165 are configured to occlude closure elements of a closure assembly, once the slider 100 is operatively engaged on the closure assembly. In particular, as shown in FIG. 6B, the front side of the slider includes the first opening member 114 that extends from the front end 101B of the top wall 101 of the slider 100 and is configured to de-occlude closure elements of a closure assembly as the slider 100 is slid in an opening direction. In one embodiment, the first opening member 114 extends from the top wall 101 of the slider 100 to a length (or width) that engages with closure elements in a single zipper closure assembly. In another embodiment, the first opening member 114 preferably extends from the top wall 101 of the slider 100 to a length (or width) that engages with upper closure elements of a double zipper closure assembly, but does not extend to a length (or width) that engages with lower closure elements in the double zipper closure assembly. However, as shown in FIG. 6A, the back side of the slider includes the second opening member 112 that extends from the separator finger 110 and the back end 101A of the top wall 101. The second opening member 112 preferably extends from the separator finger 110 to a length (or width) that engages with closure elements of a single zipper closure assembly, or to a length (or width) that engages with lower closure elements in a double zipper closure assembly. As also shown in FIG. 6B, the first closing bars 150, 160 are positioned such that they assist in occluding closure elements of a single zipper closure assembly or upper closure elements of a double zipper closure assembly, when the slider is slid in a closing direction. The second closing bars 155, 165 are positioned such that they assist in occluding closure elements of a single zipper closure assembly or lower closure elements of a double zipper closure assembly, when the slider is slid in a closing direction.

Figure 7:
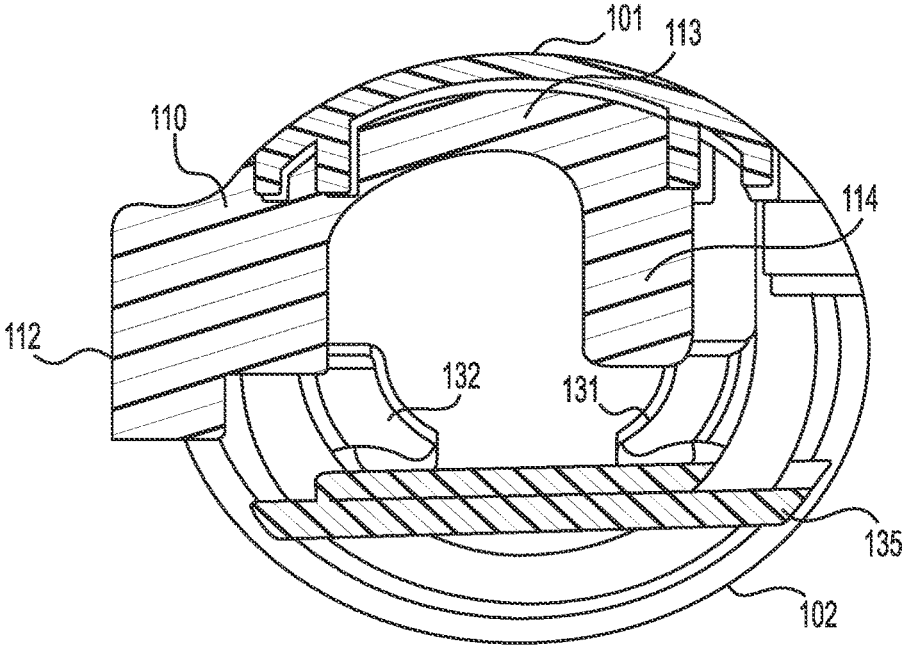
FIG. 7 is a side cross-sectional view taken along line 7-7 of FIG. 1 showing the slider of FIG. 1 in a closed position with portions of the slider omitted for clarity.

FIG. 7 illustrates a side cross-sectional view of the slider 100, with the second wing 104 removed to illustrate the separator finger 110, including the first opening member 114 and the second opening member 112, with more clarity. In particular, as shown in FIG. 7, the separator finger 110 extends from the top wall 101 of the slider to the second opening member 112, while the first opening member 114 is connected to both the top wall 101 and the separator finger 110 via a connecting member 113. Thus, the separator finger 110 is a singular separator finger that is attached to the first opening member 114 and the second opening member 112 via the connecting member 113. Alternatively, the slider 100 could comprise two separator fingers, with the first separator finger 110 extending from the top wall 101 to the second opening member 112, and the first opening member 114 extending directly from the top wall 101, with the connecting member 113 being completely removed from this alternative embodiment.

Figure 8A:
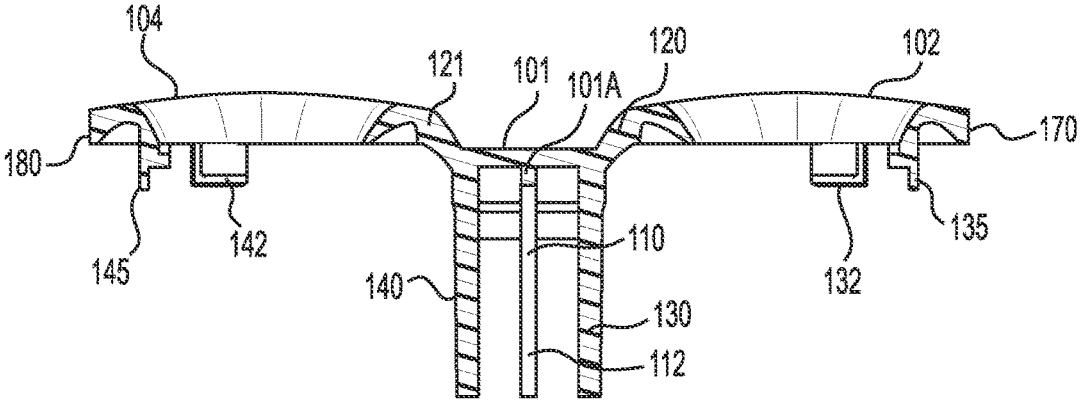
FIG. 8A is a back-side cross-sectional view taken along line 8A-8A of FIG. 2 showing the slider of FIG. 2 in an opened position.
Figure 8B:
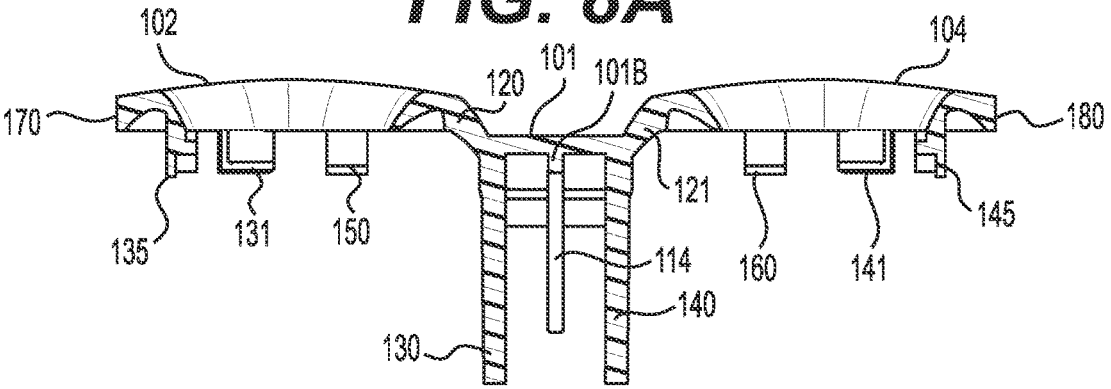
FIG. 8B is a front-side cross-sectional view taken along line 8B-8B of FIG. 2 showing the slider of FIG. 2 in an opened position.
Figure 9:
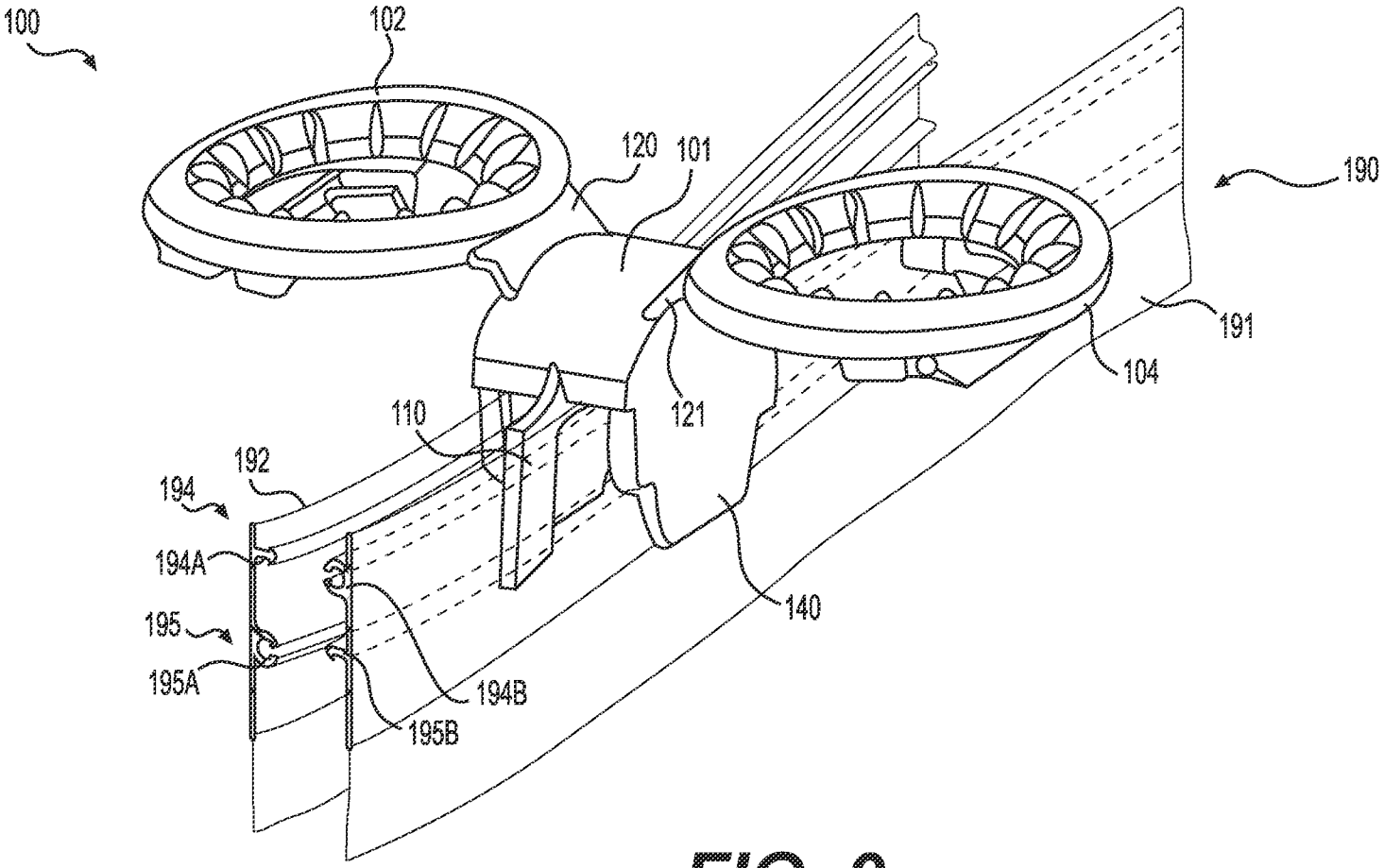
FIG. 9 is a top perspective view of the slider of FIG. 1 in an opened position and being positioned onto a closure assembly.

FIGS. 8A, 8B, and 9 illustrate the hinged slider 100 in an open position in which the first and second wings 102, 104 are detached from the legs 130, 140. In this open position, the slider 100 can be positioned over a closure mechanism of a bag and then attached into place onto the closure mechanism, by hinging the first and second wings 102, 104 downward. In particular, as shown in FIG. 9, the slider 100 is in an open position, and positioned over a pair of sidewalls 191, 192 of a bag 190. The bag 190 includes a closure assembly with an upper zipper profile 194 that includes a first closure element 194A and a second closure element 194B, and a lower zipper profile 195 that includes a first closure element 195A and a second closure element 195B. The slider 100, in the open position, is positioned over the sidewalls 191, 192 of the bag 190, such that the legs 130, 140 of the slider 100 straddle the exterior surfaces of the sidewalls 191, 192 of the bag 190. Moreover, the slider 100 is positioned such that the separator finger 110 is disposed between the interior surfaces of the sidewalls 191, 192 of the bag 190 and between the upper and lower zipper profiles 194, 195.

Figure 10:
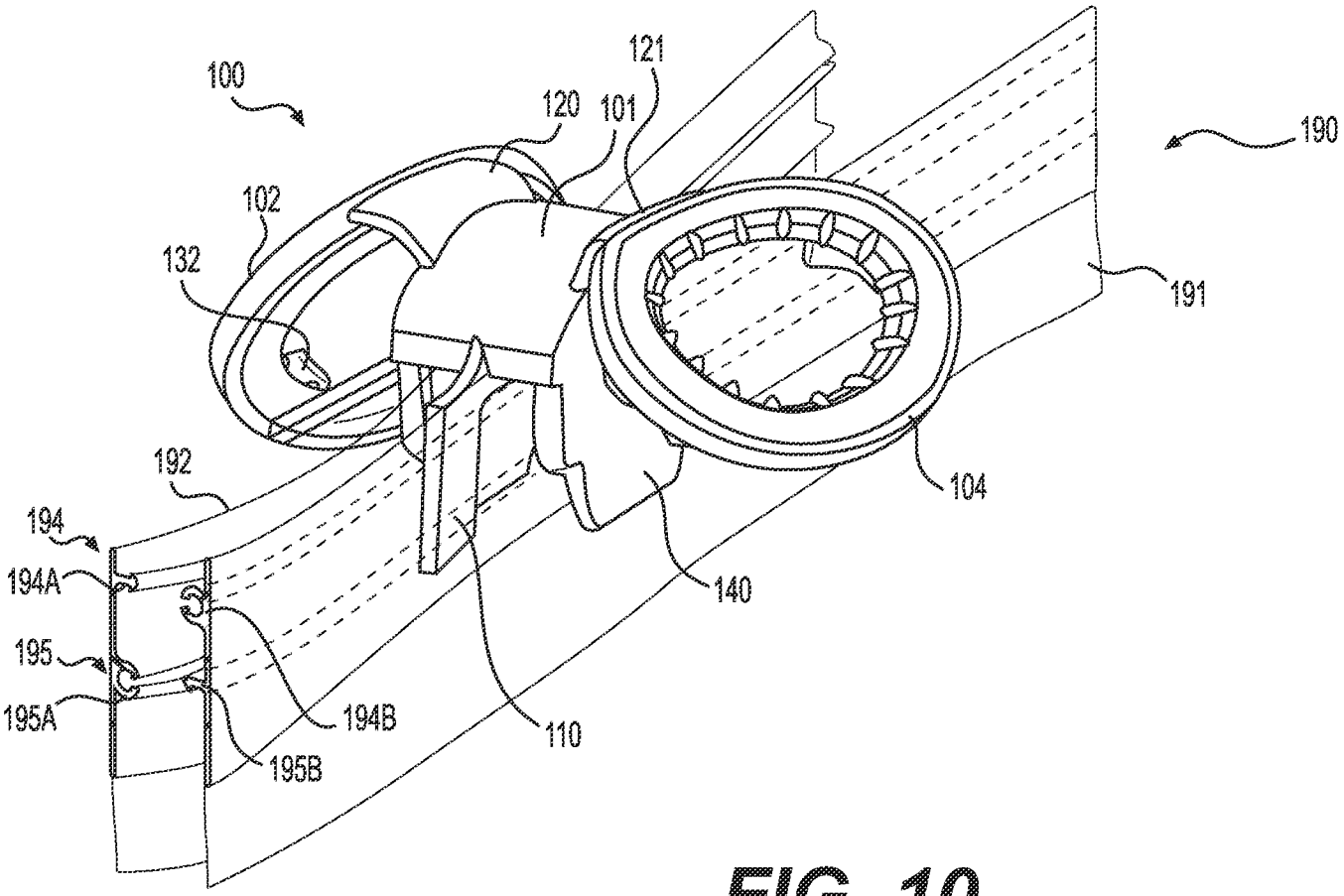
FIG. 10 is a top perspective view of the slider of FIG. 1 with wings of the slider being rotated downward to be positioned onto a closure assembly.
Figure 11:
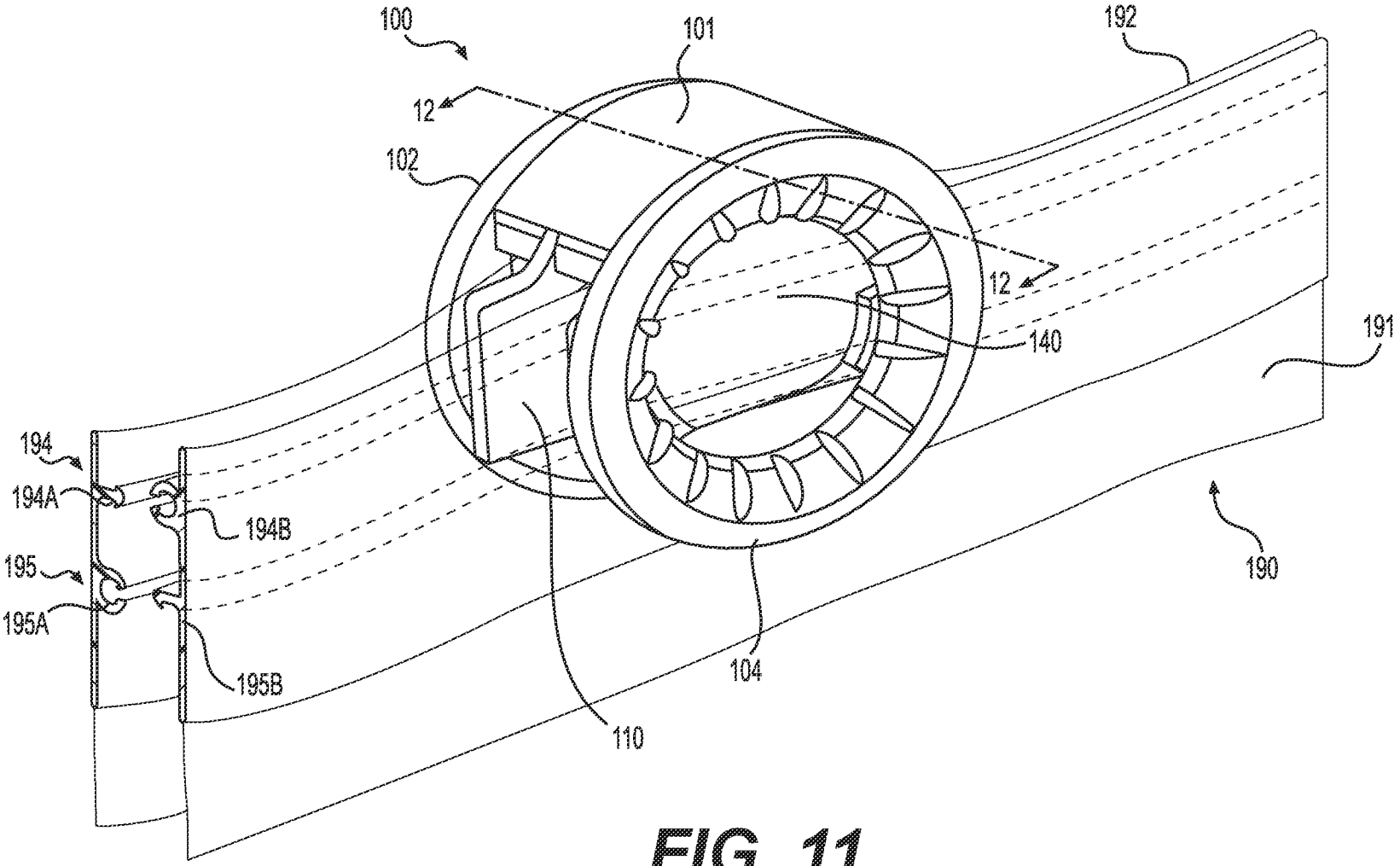
FIG. 11 is a top side perspective view of the slider of FIG. 1 in a closed position and being operatively engaged on a closure assembly.

FIG. 10 illustrates the initial hinging of the first and second wings 102, 104 of the slider 100. In particular, the first and second wings 102, 104 are rotated downward toward the bottom of the bag 190, with the hinges 120, 121 acting as the axis of rotation. FIG. 11 illustrates the first and second wings 102, 104 locked into place onto the legs 130, 140 of the slider 100. In this closed position, the latches 131, 132, 141, and 142 (see, e.g., FIGS. 8A and 8B) of the first and second wings 102, 104 are snapped into place on their respective legs 130, 140, and the slider 100 is in an assembled condition and operatively engaged onto the closure assembly, i.e., the upper and lower zipper profiles 194, 195. As also shown in FIG. 11, the upper and lower zipper profiles 194, 195 are in an occluded position at least one end of the bag 190, such that the first closure element 194A is occluded with the second closure element 194B of the upper zipper profile 194, and the first closure element 195A is occluded with the second closure element 195B of the lower zipper profile 195.

Figure 12:
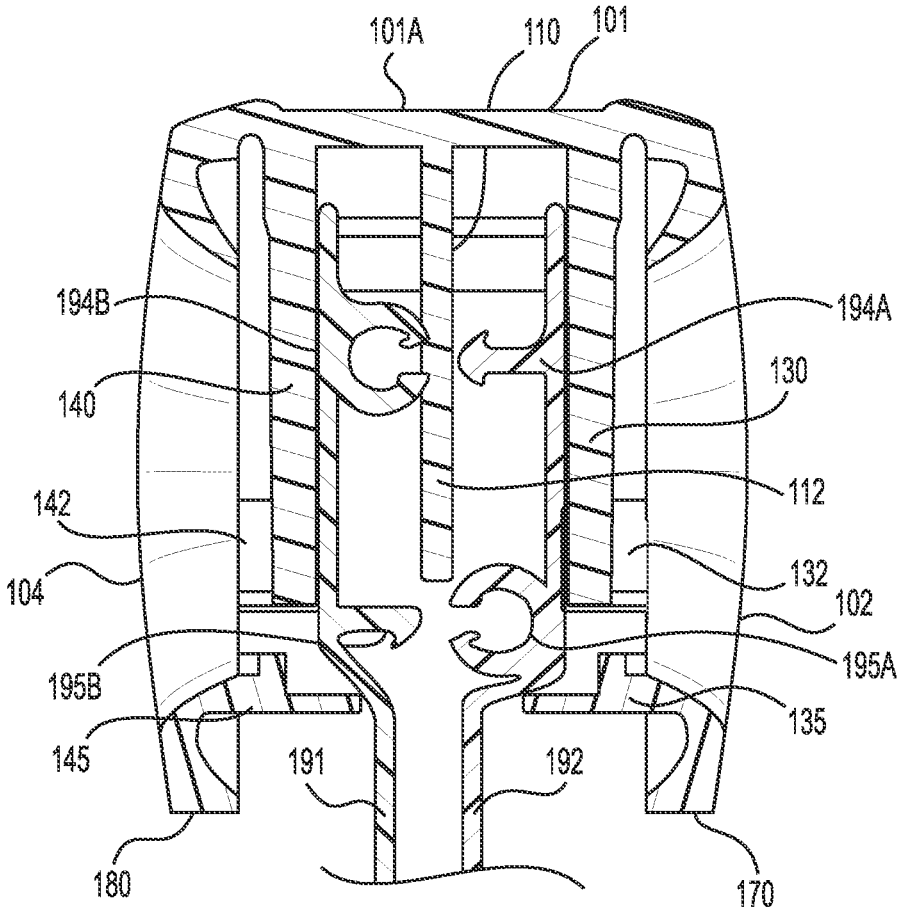
FIG. 12 is an enlarged partial cross-sectional view taken along line 12-12 of FIG. 11 showing the slider of FIG. 1, in a closed position, and being operatively engaged on a double zipper profile of a closure assembly with portions behind the plane of the cross section omitted for clarity.

FIG. 12 illustrates the slider 100 shown in FIG. 11 operatively engaged on the double zipper profile shown in FIGS. 9-11. As shown in FIG. 12, the first and second closure elements 194A, 194B of the upper zipper profile 194, and the first and second closure elements 195A, 195B of the lower zipper profile 195 are disposed underneath the top wall 101 of the slider 100 and between the legs 130, 140 and the first and second wings 102, 104. The separator finger 110, which extends from the back end 101A of the top wall 101, is disposed in the area between the first and second closure elements 194A, 194B of the upper zipper profile 194 and the first and second closure elements 195A, 195B of the lower zipper profile 195. In particular, the second opening member 112 of the separator finger 110 is disposed adjacent to or slightly above the first and second closure elements 195A, 195B of the lower zipper profile 195, such that the second opening member 112 of the separator finger 110 will interact with the first and second closure elements 195A, 195B of the lower zipper profile 195. The separator finger 110 and the second opening member 112, however, do not extend to a point below the first and second closure elements 195A, 195B of the lower zipper profile 195. The first wing 102 of the slider 100 extends from the top wall 101 to the bottom edge 170, while the second wing 104 of the slider 100 extends from the top wall 101 to the bottom edge 180. The crossbars 135, 145 are attached to the bottom edges 170, 180, respectively, such that the crossbars 135, 145 assist in retaining the slider 100 on the sidewalls 191, 192 of the bag 190, by extending to a point underneath the first and second closure elements 195A, 195B of the lower zipper profile 195.

Referring to FIGS. 6A, 6B, 11, and 12, when the slider 100 operatively moves, such as by being slid by a user, along the zipper profiles in an occluding direction, i.e., from right to left in FIG. 11, the first closing bars 150, 160 occlude the first and second closure elements 194A, 194B of the upper zipper profile 194, respectively. The second closing bars 155, 165 occlude the first and second closure elements 195A, 195B of the lower zipper profile 195, respectively. When the slider 100 operatively moves in a de-occluding direction, i.e., from left to right in FIG. 11, the first opening member 114 de-occludes the first and second closure elements 194A, 194B of the upper zipper profile 194 by extending therebetween and forcing these closure elements apart via a wedging action. Thereafter, the second opening member 112, which trails behind the first opening member 114 in the de-occluding direction, de-occludes the first and second closure elements 195A, 195B of the lower zipper profile 195 via a wedging action.

FIGS. 13A-13E illustrate another embodiment of a slider 500 that includes first and second wings 502, 504 extending from a top wall 501 defining a channel therebetween in which a closure assembly, such as a single or double zipper closure assembly, can be operatively accepted. The first wing 502 includes an arcuate portion 503 that is filled-in with a material forming the slider. The second wing 504 also includes a similar arcuate portion that is not shown in FIG. 13A. Although the arcuate portion 503 is filled-in in the embodiment shown in FIG. 13A, the arcuate portion 503 could alternatively be hollow or partially filled-in. In addition, the arcuate portion 503 could be of a different shape, since the specific shape and configuration of the wings and/or arcuate portions can be altered without departing from the spirit of the invention.

Figure 13A:
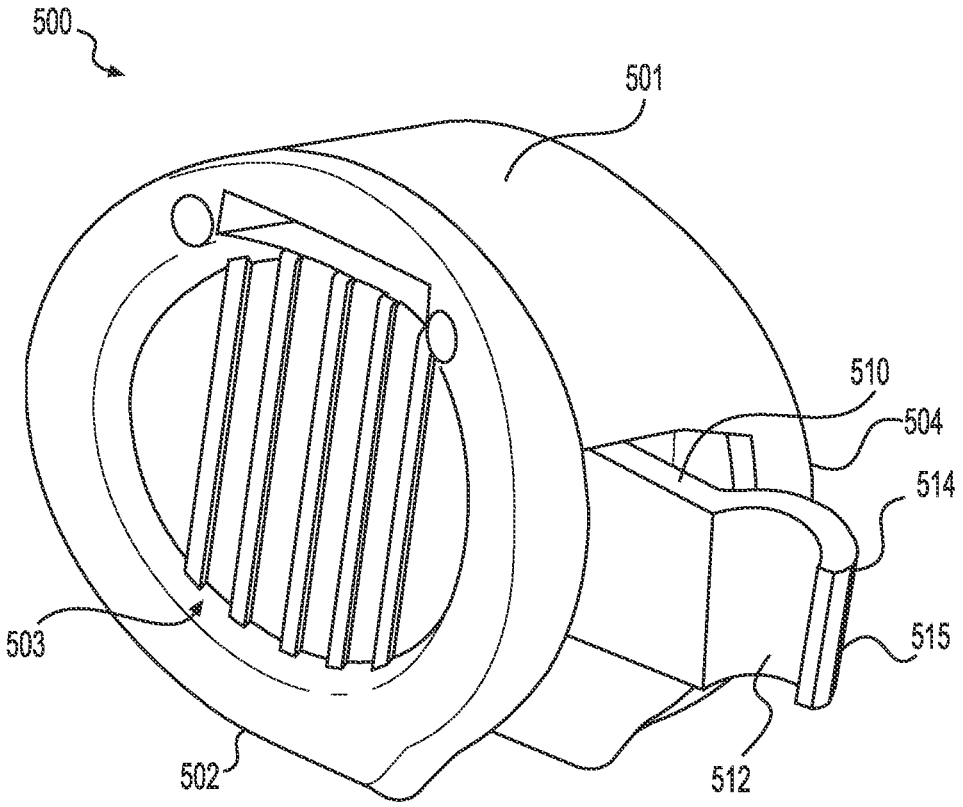
FIG. 13A is a top perspective view of a slider and a separator finger for opening a lower zipper profile according to another embodiment of the invention.
Figure 13B:
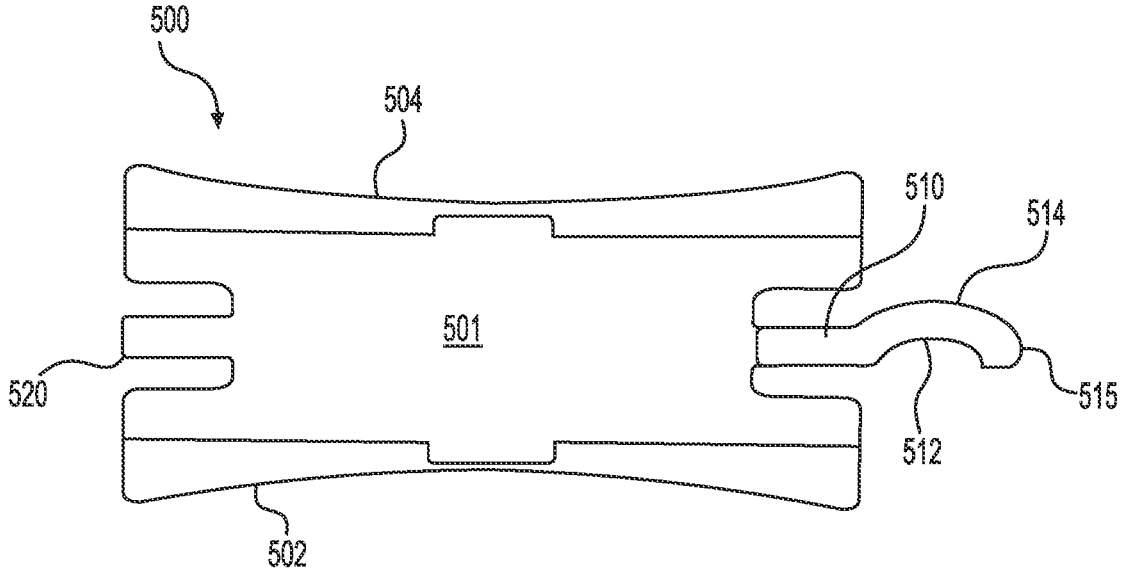
FIG. 13B is a top view of the slider and separator finger of FIG. 13A.

As shown in FIGS. 13A and 13B, the slider 500 includes a central protrusion, such as a separator finger 510, that extends from the top wall 501 into the channel spaced between the first and second wings 502, 504. The separator finger 510 includes an opening end 520 and a closing end 515, as well as a C-shaped indentation 512 near the closing end 515 of the separator finger 510. The C-shaped indentation 512 results in a bulge 514 on the side of the separator finger 510 opposing the C-shaped indentation 512. The bulge 514, which is also near the closing end 515, gently separates the closure elements of a single or double zipper profile.

Figure 13C:
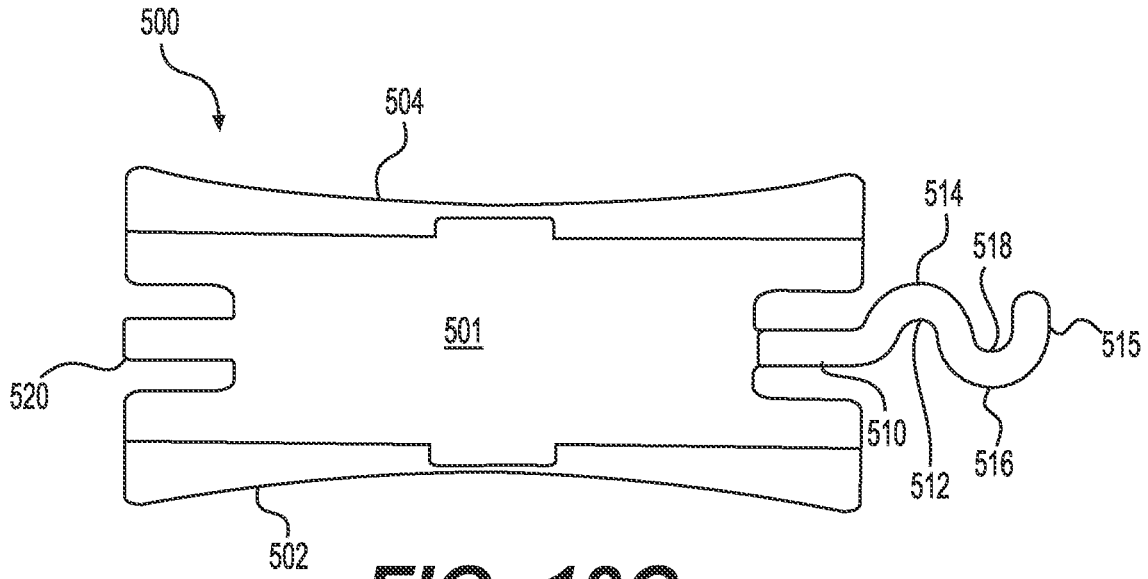
FIG. 13C is a top view of the slider of FIG. 13A with another embodiment of a separator finger for opening a lower zipper profile.
Figure 13D:
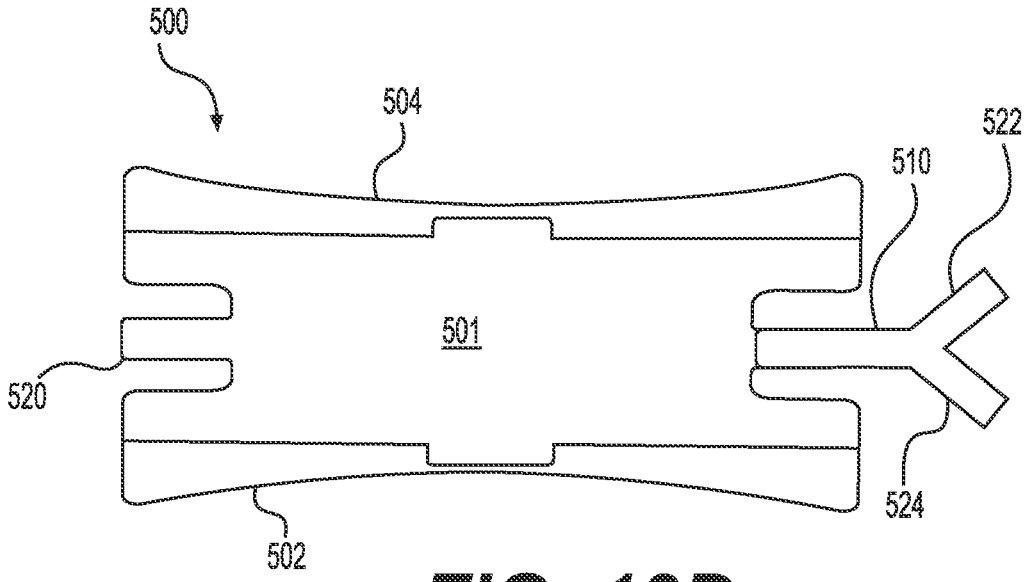
FIG. 13D is a top view of the slider of FIG. 13A with another embodiment of a separator finger for opening a lower zipper profile.
Figure 13E:
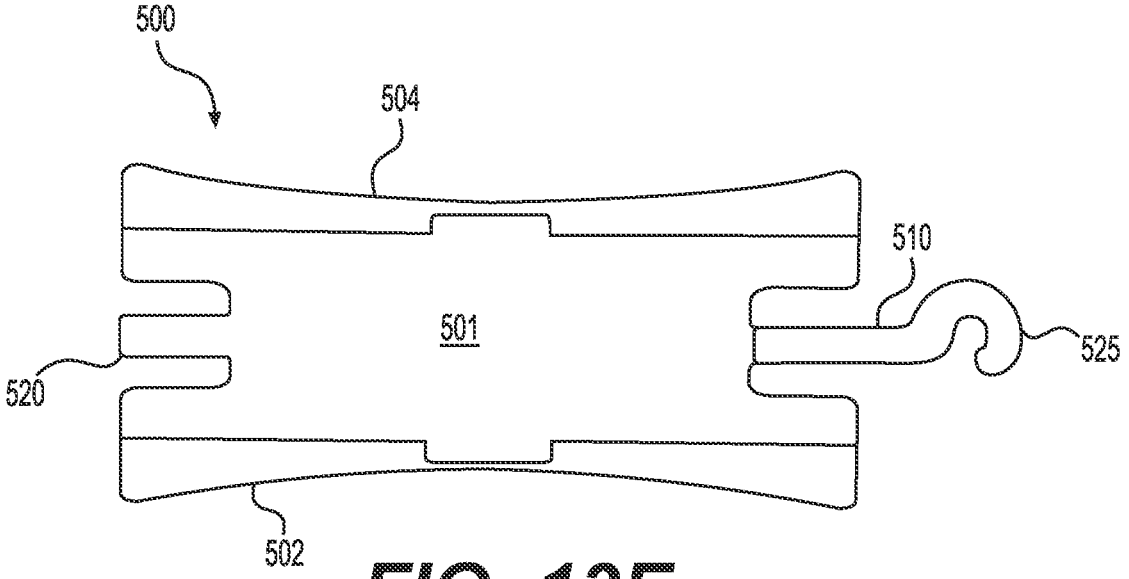
FIG. 13E is top view of the slider of FIG. 13A with another embodiment of a separator finger for opening a lower zipper profile.

FIGS. 13C-13E illustrate alterative embodiments for the separator finger 510 of the slider 500. In particular, FIG. 13C depicts the separator finger 510 comprising two C-shaped indentations. As shown in FIG. 13C, the separator finger 510 includes the C-shaped indentation 512 and opposing bulge 514 shown in FIG. 13B, along with a second C-shaped indentation 518 with an opposing bulge 516 near the closing end 515. FIG. 13D illustrates the separator finger 510 comprising a Y-shaped protrusion with a first portion 522 and a second portion 524 extending from the separator finger 510 for separating the closure elements of a single or double zipper profile. FIG. 13E illustrates an additional embodiment for the separator finger 510. As shown in FIG. 13E, the separator finger 510 includes a curved protrusion 525 similar to a hook shape that is capable of separating the closure elements of a single or double zipper profile. In addition to the embodiments shown in FIGS. 13A-13E, the separator finger 510 could be of a different shape, since the specific shape and configuration of the separator finger 510 can be altered without departing from the spirit of the invention. Moreover, the separator finger 510 of the various embodiments of FIGS. 13A-13E could be used in place of the separator finger 110 of the slider illustrated in FIGS. 1-12.

Figure 14:
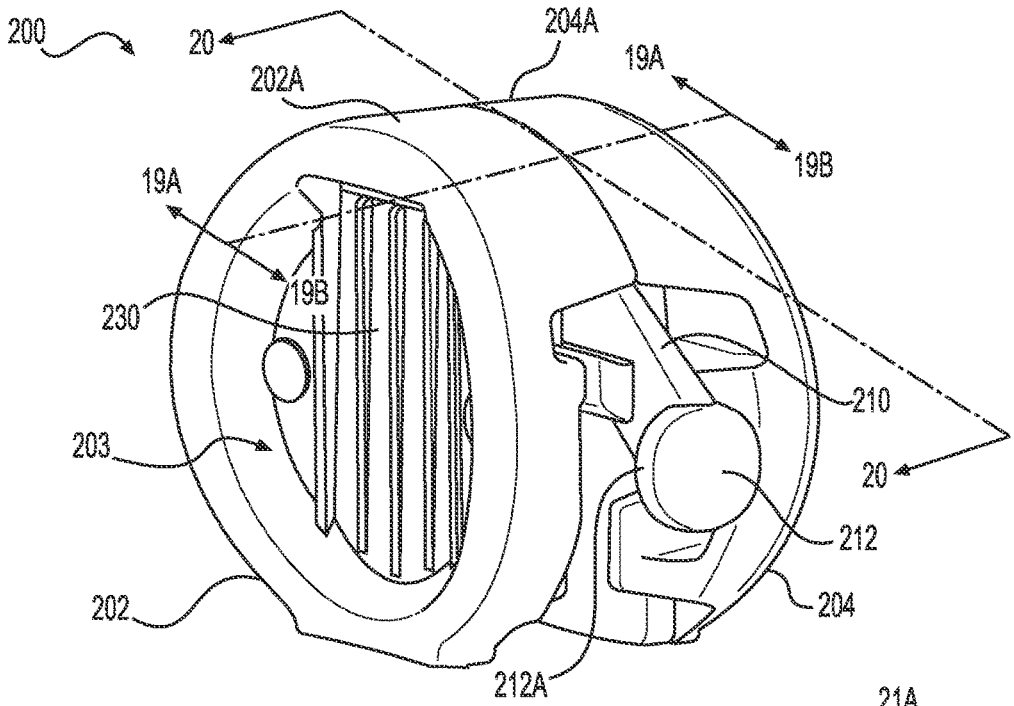
FIG. 14 is a top perspective view of a slider according to another embodiment of the invention.
Figure 15:
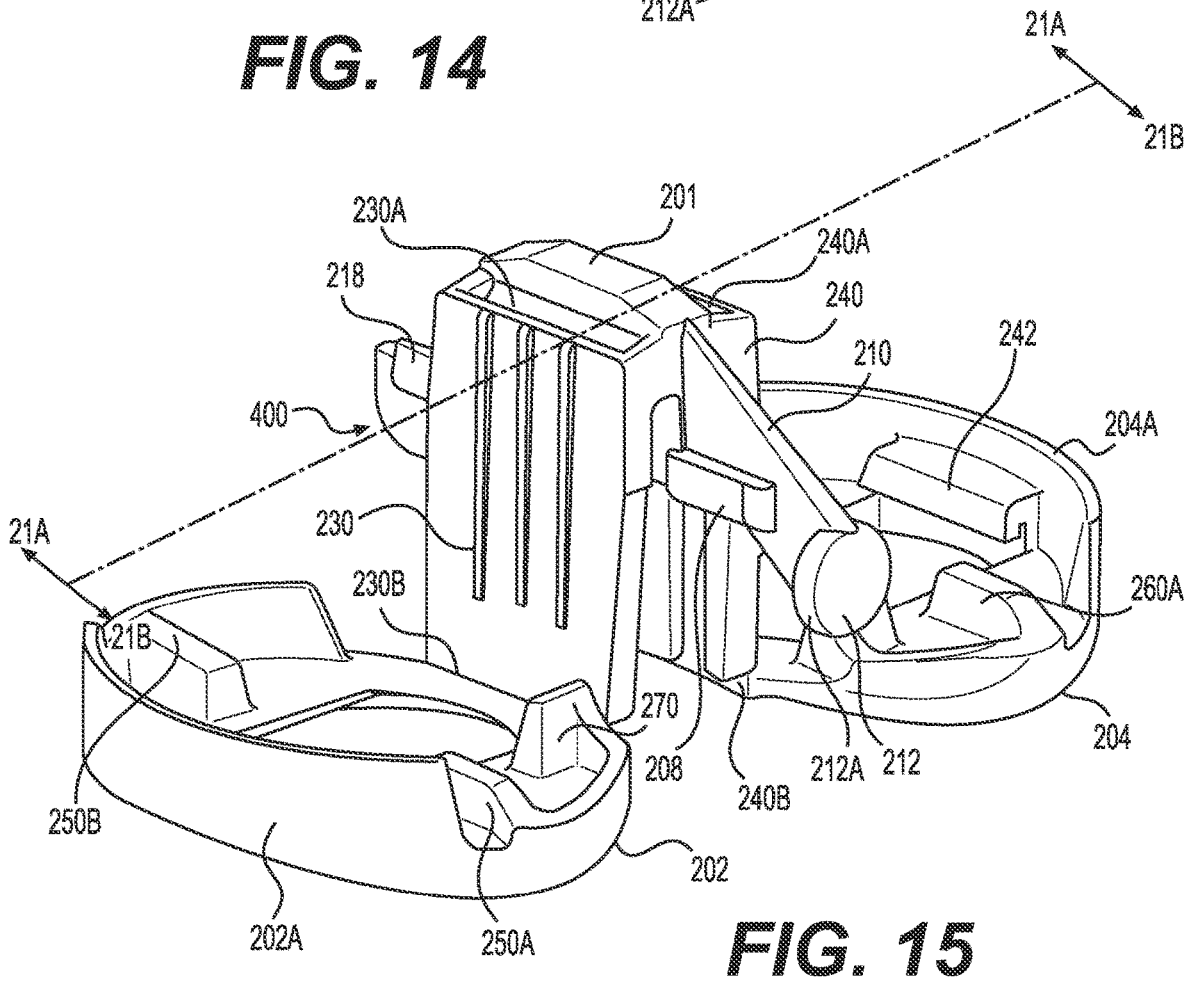
FIG. 15 is a top perspective view of the slider shown in FIG. 14 in an opened position.

FIGS. 14 and 15 illustrate another embodiment of a slider 200 that also includes first and second opposing wings 202, 204. The first wing 202 includes a top surface 202A and a bottom edge 202C (see, e.g., FIG. 19A). The second wing 204 includes a top face 204A and a bottom edge 204C (see, e.g., FIG. 19A). The first wing 202 is hingedly attached, via a hinge 230B, to a leg 230 of the slider 200 at the bottom edge 202C of the first wing 202, while the second wing 204 is hingedly attached, via a hinge 240B, to a leg 240 of the slider 200 at the bottom edge 204C of the second wing 204. The first wing 202 includes an opening 203 exposing the leg 230 of the slider 200. The second wing 204 also includes a similar opening 205 that is not shown in FIG. 14. Although the opening 203 is hollow in the embodiment shown in FIG. 14, the opening 203 could alternatively be completely filled-in or partially filled-in. In addition, the opening 203, which is substantially rectangular in this embodiment, could be of a different shape, since the specific shape and configuration of the wings and/or openings can be altered without departing from the spirit of the invention. The legs 230, 240 of the slider 200 are vertically extending, and extend from a top wall 201 of the slider 200 to the bottom edges 202C, 204C of the respective first and second wings 202, 204. The leg 230 includes a recess or opening 230A adjacent to the top wall 201 of the slider 200, while the leg 240 includes a recess or opening 240A adjacent to the top wall 201 of the slider 200. The openings 230A, 240A of the legs 230, 240 are configured to receive a respective latch of the first and second wings 202, 204, which will be described in more detail below. A bottom end of the leg 230 that is opposite to the opening 230A, includes the hinge 230B, which attaches the leg 230 to the first wing 202. A bottom end of the leg 240 that is opposite to the opening 240A, includes the hinge 240B, which attaches the leg 240 to the second wing 204. As described in more detail below, the first and second wings 202, 204 of the slider 200 of this embodiment hinge upwardly. The upward hinging of the first and second wings 202, 204 of the slider 200 has been found to allow for a narrower slider body and a stronger latch, as well as a latching at the top wall 201 of the slider 200 that has been found to prevent damage to a zipper profile(s) during assembly.

As shown in FIG. 14, when the slider 200 is in a closed position, the top surface 202A of the first wing 202 is positioned adjacent to the top surface 204A of the second wing 204, and the top wall 201 of the slider 200 and the openings 230A, 240A of the legs 230, 240 are covered by the top surfaces 202A, 204A. Moreover, in the closed position, the first and second wings 202, 204 of the slider 200 define a channel therebetween in which a closure assembly, such as a single or double zipper, can be operatively accepted. The slider 200 further includes a support member 210 that extends from the top wall 201 into the channel spaced between the first and second wings 202, 204, and the pair of legs 230, 240. The support member 210 includes a second zipper profile opening member 212 at a distal end of the support member 210. The second zipper profile opening member 212 includes a first shoulder member 212A and a second shoulder member 212B (see, e.g., FIGS. 16 and 18) that extend orthogonally to the direction of slider travel along the zipper profiles. The first and second shoulder members 212A, 212B preferably comprise arcuate members that extend toward respective closure elements of a single or double zipper closure assembly. The first and second shoulder members 212A, 212B of the second zipper profile opening member 212 enables the distal end of the support member 210 to reach the width necessary to de-occlude closure elements of a single or double zipper closure assembly via a wedging action. In a preferred embodiment, the second zipper profile opening member 212 is configured to de-occlude closure elements of a lower zipper profile of a double zipper closure assembly via a wedging action, without penetrating through the lower zipper profile. The width of the second zipper profile opening member 212 is sufficient to open the closure elements of the lower zipper profile, but the width is small enough to be stored in a detent that can be formed between the upper and lower zipper profiles, and is described in more detail below. In one embodiment, the upper and lower zipper profiles are spaced apart from each other at a center-to-center spacing of between about 150 mils and about 225 mils, and preferably, about 200 mils apart. In addition, the zipper profiles each have a thickness (which is measured from a back side of the first closure element to an opposing back side of the second closure element) of 50 mils to about 80 mils, and preferably, about 52 mils to about 56 mils. In this embodiment, the second zipper profile opening member 212 preferably has a width (i.e., from edge of first shoulder member 212A to edge of second shoulder member 212B) of about 40 mils to about 160 mils, and more preferably, of about 70 mils to about 128 mils in order to effectively de-occlude the closure elements of a lower zipper profile with the thickness described above, as well as the center-to-center spacing from the upper zipper profile as described above.

Figure 16:
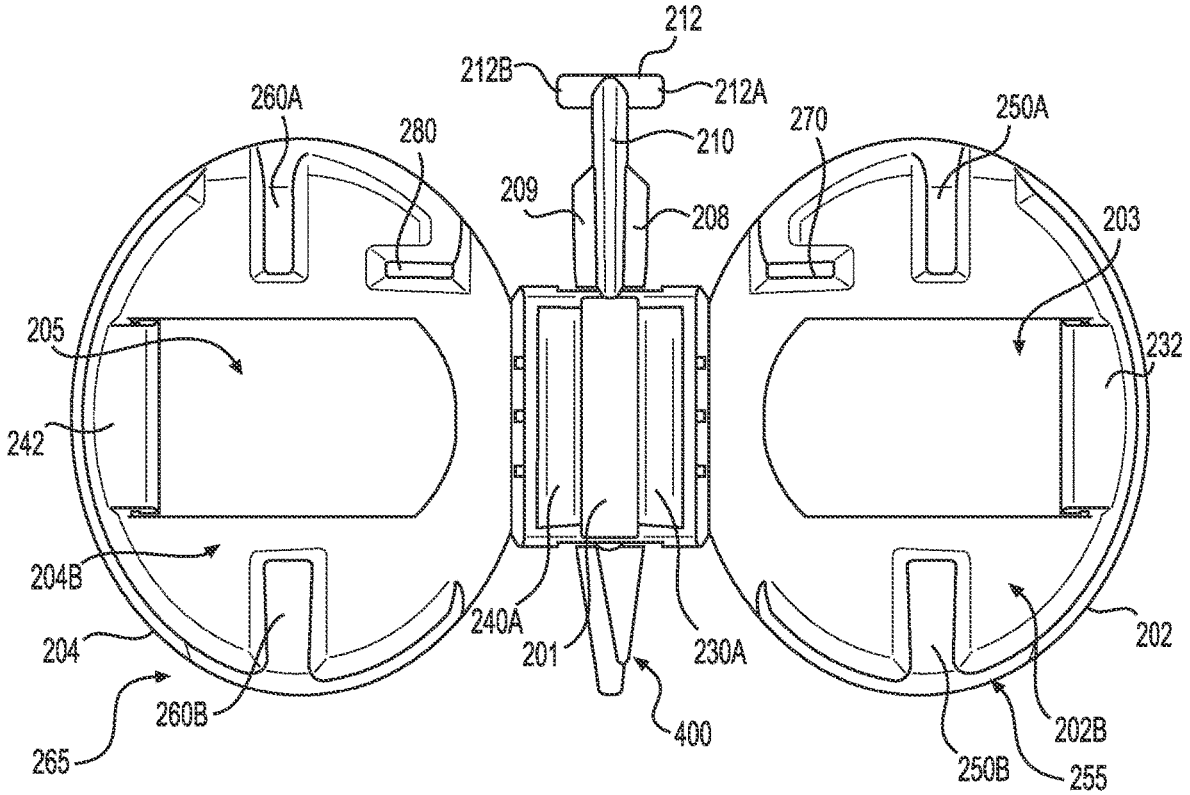
FIG. 16 is a top view of the slider shown in FIG. 15 in an opened position.
Figure 17:
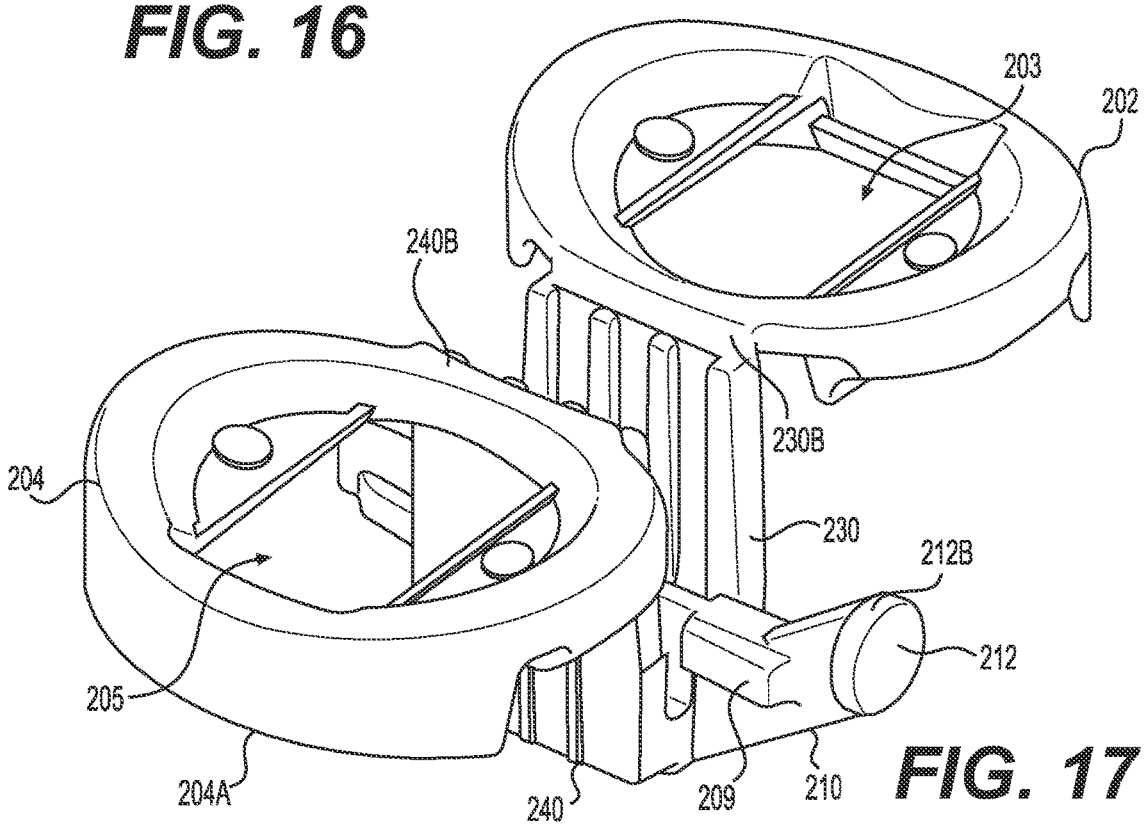
FIG. 17 is a bottom perspective view of the slider shown in FIG. 15 in an opened position.
Figure 18:
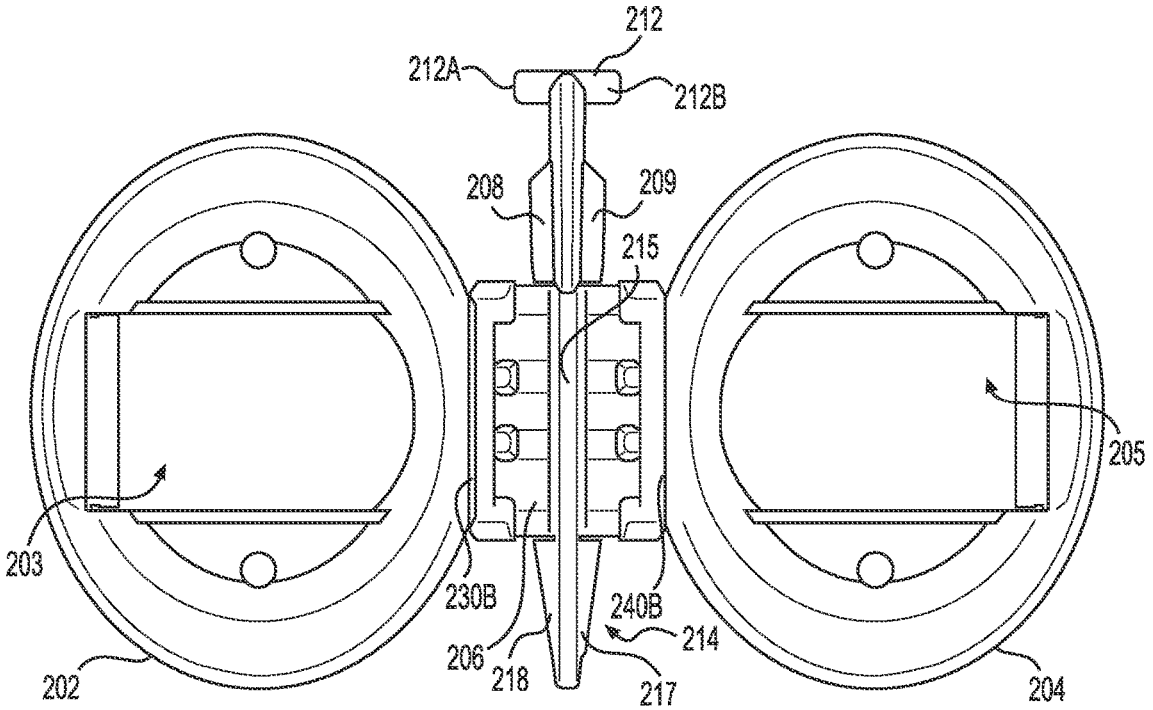
FIG. 18 is a bottom view of the slider shown in FIG. 15 in an opened position.

As shown in FIG. 15, the support member 210 also includes a retention member 208 that assists in retaining the slider on the zipper profiles, such that a user cannot easily pull the slider vertically off of the bag. The support member 210 preferably includes a similar retention member 209 on the opposing side to the retention member 208, which is shown in FIGS. 16-18. The retention members 208, 209 are configured to assist in retaining the slider on the zipper profiles by engaging with an underside of the closure elements of the zipper profile(s), preferably, the underside of the closure elements of an upper zipper profile. The retention members 208, 209, however, do not extend from the support member 210 to a point in which the retention members 208, 209 interact with the closure elements or a base strip of the closure elements in such a manner as to de-occlude the closure elements. Although the support member 210 and second zipper profile opening member 212 of the slider of the embodiment of FIGS. 14-25 extend to an area outside of the first and second wings 202, 204 of the slider 200, the support member 210 and second zipper profile opening member 212 can alternatively be positioned entirely within the first and second wings 202, 204 of the slider 200.

Figure 20:
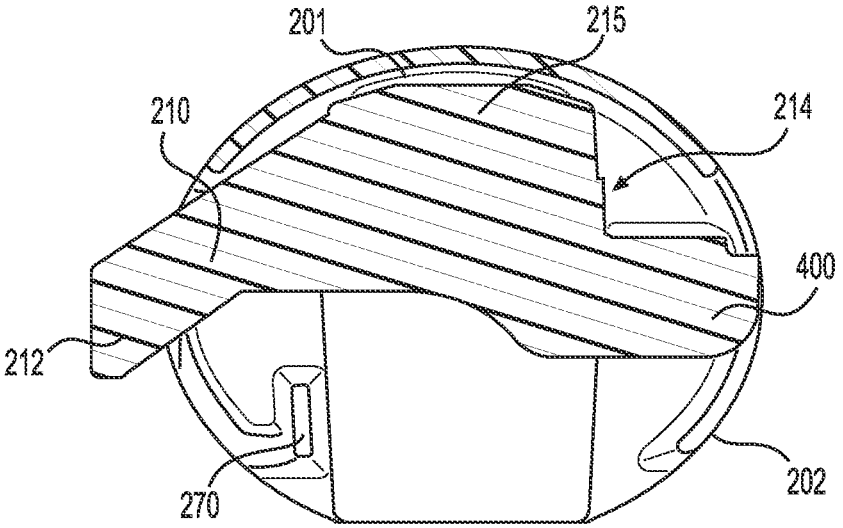
FIG. 20 is a side cross-sectional view taken along line 20-20 of FIG. 14 showing the slider of FIG. 14 in a closed position with portions of the slider omitted for clarity.
Figure 30:
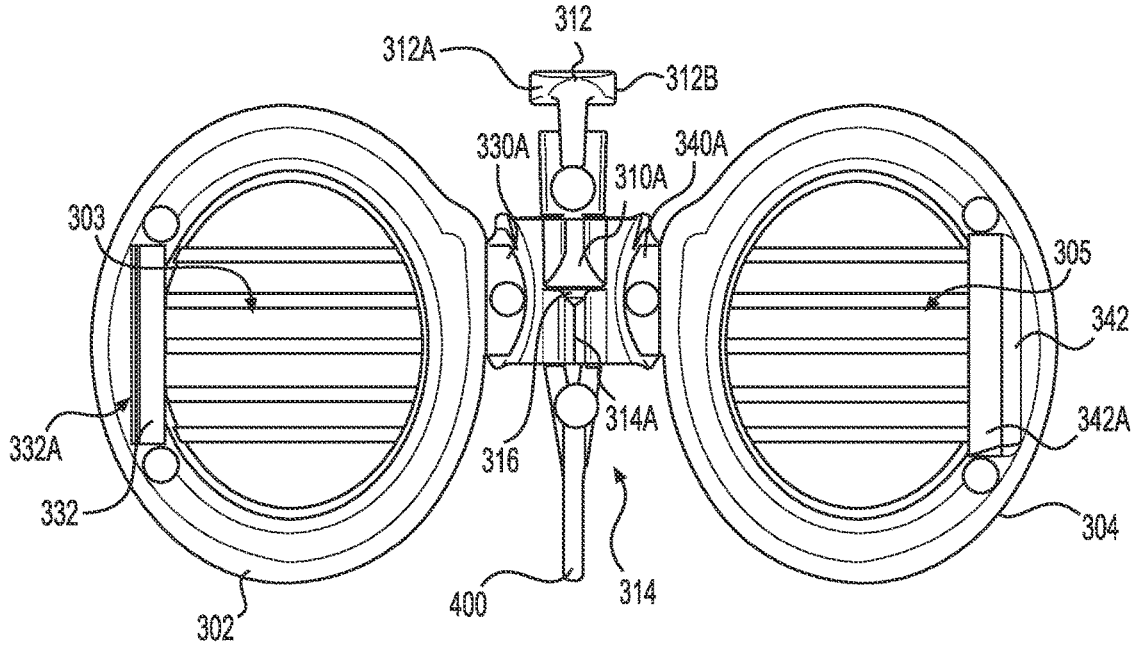
FIG. 30 is a bottom view of the slider shown in FIG. 27 in an opened position.
Figure 38A:
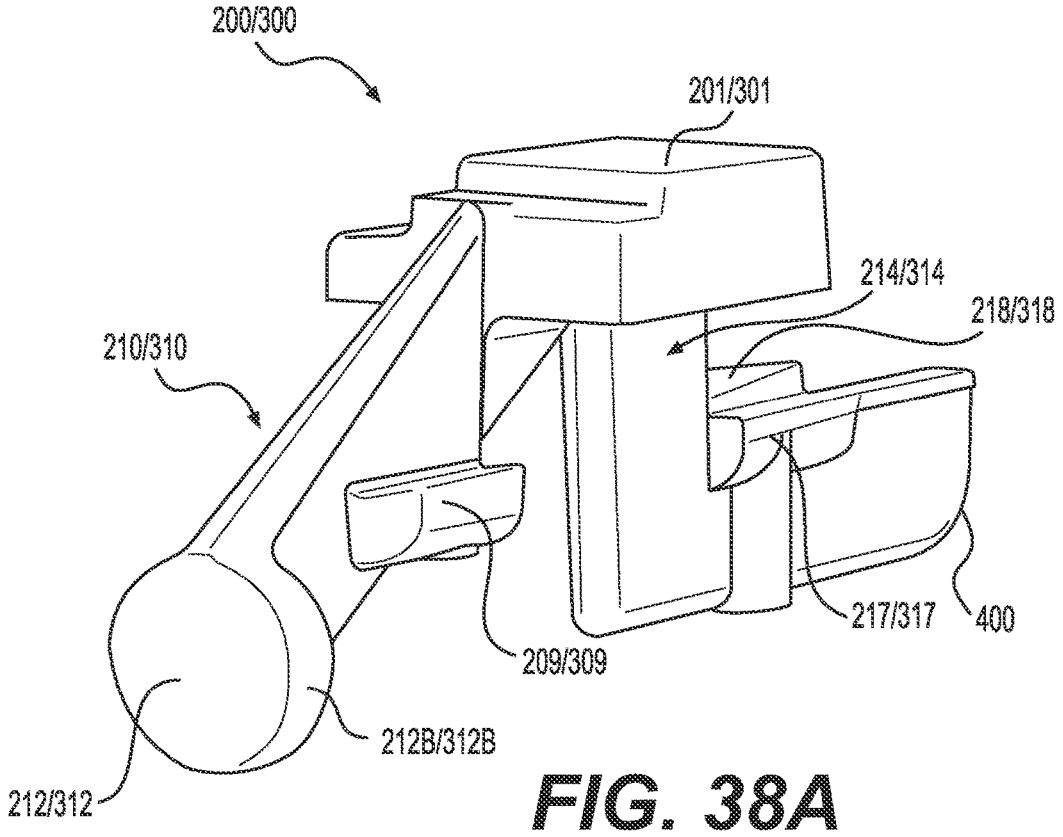
FIG. 38A is a side perspective view of the slider illustrated in FIGS. 14-37, with portions of the slider removed to clarify features of the first and second zipper profile opening members.
Figure 38B:
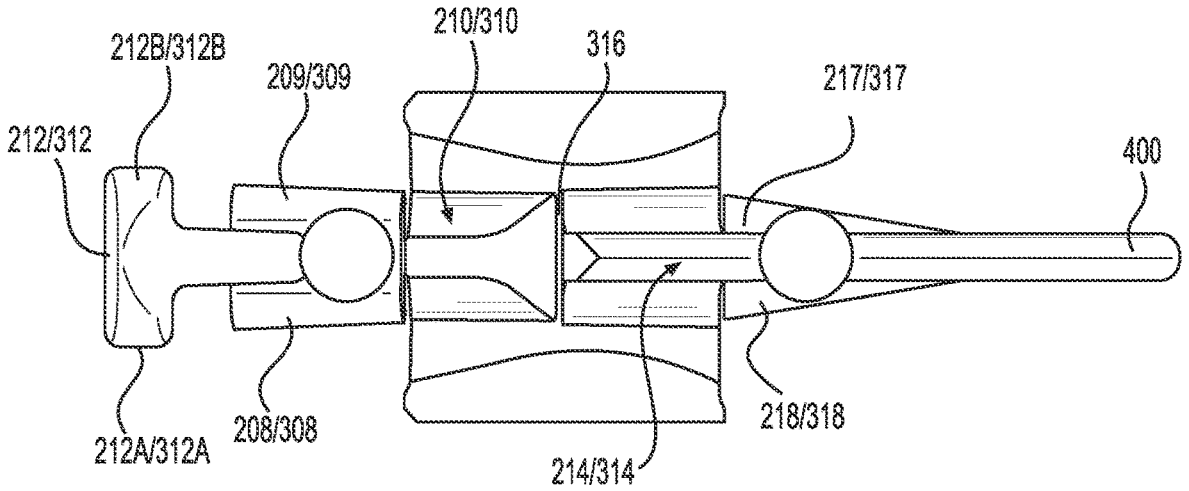
FIG. 38B is a bottom view of the slider and the first and second zipper profile opening members of FIG. 38A, with portions of the slider removed for clarity.
Figure 38C:
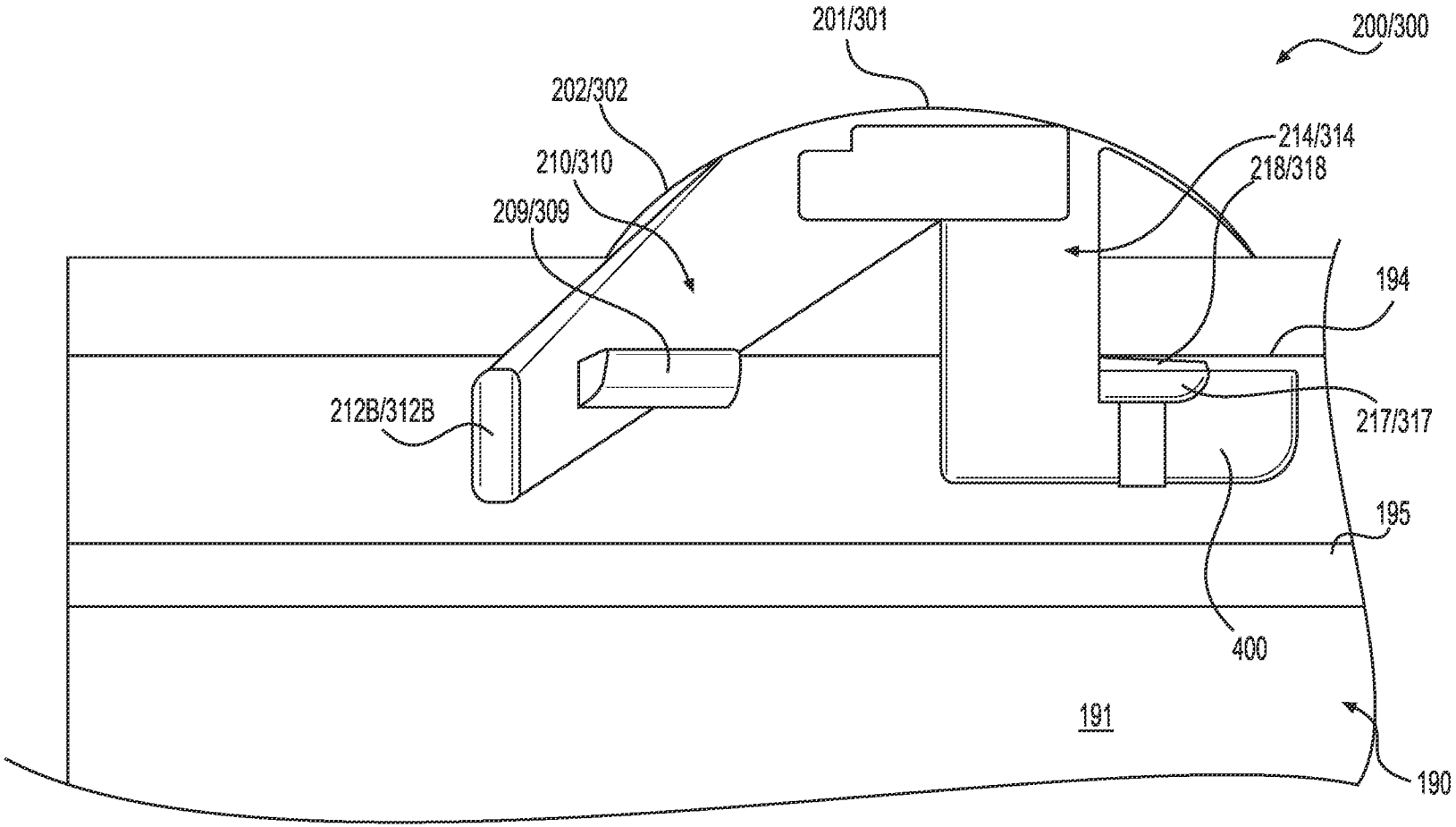
FIG. 38C is a partial side view of a bag including the slider and first and second zipper profile opening members of FIGS. 14-37 operatively engaged on a double zipper profile of the bag, with portions of the slider and bag removed for clarity.

As shown in, for example, FIG. 20, the slider 200 further includes a first zipper profile opening member 214 (see also, e.g., FIGS. 38A and 38C). The first zipper profile opening member 214 can be attached to the support member 210 (see, e.g., FIG. 20), such that the slider includes a single separating mechanism that comprises the first zipper profile opening member 214 and the support member 210 with the second zipper profile opening member 212. In an alternative embodiment, the first zipper profile opening member 214 is directly attached to the top wall 201 of the slider, such that the first zipper profile opening member 214 is a separate and distinct separating element from the support member 210 and second zipper profile opening member 212 (see, for example, the embodiment of FIGS. 30 and 32, which is described in more detail below).

Figure 19A:
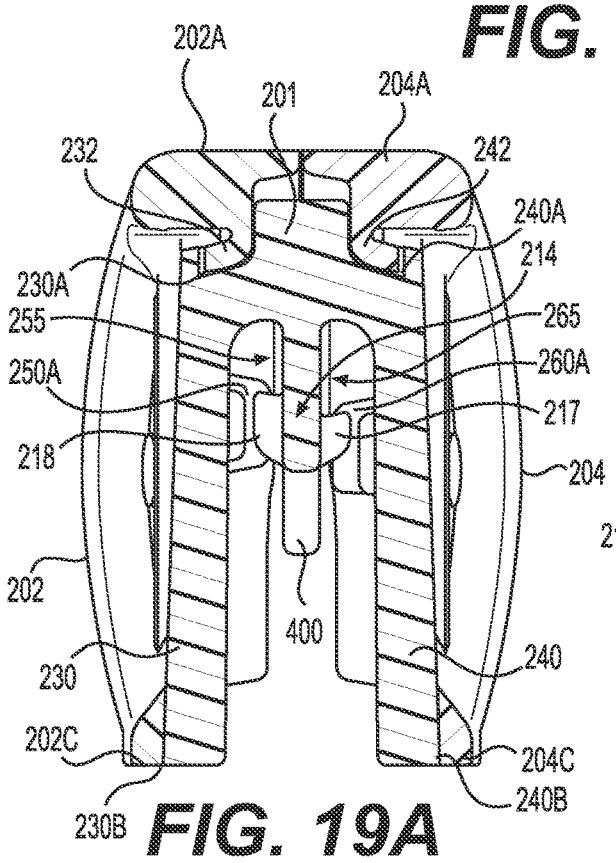
FIG. 19A is a front-side cross-sectional view taken along line 19A-19A of FIG. 14 showing the slider of FIG. 14 in a closed position.
Figure 19B:
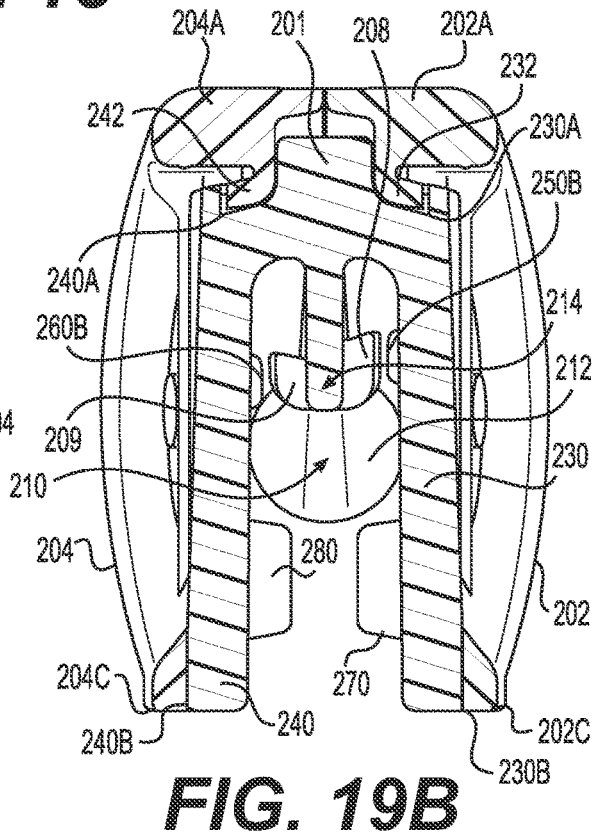
FIG. 19B is a back-side cross-sectional taken along line 19B-19B of FIG. 14 showing the slider of FIG. 14 in a closed position.

As shown in FIGS. 15 and 16, the interior surface 202B of the first wing 202, as well as the interior surface 204B of the second wing 204, include various elements for attaching the first and second wings 202, 204 to a respective leg 230, 240 of the slider 200. In particular, the first wing 202 includes a latch 232 that is disposed on an underside of the top surface 202A of the first wing 202 that is above the opening 203. The second wing 204 also includes a latch 242 that is disposed on an underside of the top surface 204A of the second wing 204 that is above the opening 205. While the embodiment of FIGS. 15 and 16 illustrates a singular latch 232 on the first wing 202 and a singular latch 242 on the second wing 204, multiple latches could be used, as opposed to the singular latch structure of this embodiment. Alternatively, only one of the wings 202, 204 could include a latch(es), while the opposing wing could contain an engagement mechanism for the latch. The latch 232 of the first wing 202 is configured to engage with the opening 230A of the leg 230, while the latch 242 of the second wing 204 is configured to engage with the opening 240A of the leg 240. The latching mechanism is a compression-type latch in that the latches 232 and 242 are flexible enough to deflect and to snap into place in the respective holes 230A, 240A of the respective legs 230, 240 to lock the first and second wings 202, 204 into position with their respective leg 230, 240. In particular, as shown in FIGS. 19A and 19B, when the slider 200 is in the closed position, the latch 232 has deflected and snapped into place in the opening 230A of the leg 230, while the latch 242 has deflected and snapped into place in the opening 240A of the leg 240. Once the first and second wings 202, 204 are latched with their respective leg 230, 240, it becomes difficult for a user to disengage the first and second wings 202, 204 with their respective leg 230, 240.

As also shown in FIGS. 15 and 16, the first wing 202 includes a first closing bar 255, a second closing bar 270, and a pair of backer bars 250A and 250B that are provided on the interior surface 202B of the first wing 202. The second wing 204 also includes a first closing bar 265, a second closing bar 280, and a pair of backer bars 260A and 260B that are provided on the interior surface 204B of the second wing 204. The closing bars 255, 265, 270, 280 are configured to occlude closure elements of a closure assembly, once the slider 200 is operatively engaged on the closure assembly, while the backer bars 250A, 250B, 260A, and 260B are configured to provide strength and stability to the slider, as well as assistance in retaining the slider on a zipper profile(s). As also shown in FIG. 16, the first and second closing bars 255, 270 of the first wing 202 and the first and second closing bars 265, 280 of the second wing 204 are provided on opposite sides of the respective wing 202, 204 and respective leg 230, 240. While the embodiment of FIG. 16 illustrates the first closing bars 255, 265 being positioned on the front end of the slider, and the second closing bars 270, 280 being positioned on the back end of the slider, the closing bars 255, 265, 270, 280 can be positioned an any point along the interior surfaces of the wings as long as the first closing bars 255, 265 are offset or staggered from the second closing bars 270, 280. By positioning the closing bars in such a manner, the internal deflection forces of the slider can be balanced, and the occlusion of the closure elements by the first closing bars 255, 265 will not impact the occlusion of the closure elements by the second closing bars 270, 280. In a preferred embodiment, the first closing bars 255, 265 are configured to occlude closure elements of an upper zipper profile of a double zipper closure assembly, while the second closing bars 270, 280 are configured to occlude closure elements of a lower zipper profile of the double zipper closure assembly. Thus, the occlusion of the closure elements of the upper zipper profile by the first closing bars 255, 265 will not impact the occlusion of the closure elements of the lower zipper profile by the second closing bars 270, 280. In another preferred embodiment, the second closing bars 270, 280 are positioned such that they will be no greater than 400 mils from the end of bag when the slider has effectively occluded the zipper profiles of the bag.

As shown in FIG. 19A, the front side of the slider 200 includes the first zipper profile opening member 214 that extends from the top wall 201 of the slider 200. The first zipper profile opening member 214 is configured to de-occlude closure elements of a closure assembly as the slider 200 is slid in an opening direction. The first zipper profile opening member 214 preferably extends from the top wall 201 of the slider 200 to a length (or width) that does not engage with lower closure elements in a double zipper closure assembly. However, the first zipper profile opening member 214 preferably extends from the top wall 201 of the slider 200 to a length (or width) necessary to engage with upper closure elements of a double zipper closure assembly. Accordingly, in a preferred embodiment, the first zipper profile opening member 214 is configured to only open the upper closure elements of a double zipper closure assembly. In addition, as shown in FIG. 19B, the back side of the slider 200 includes the support member 210 that extends from the top wall 201 of the slider 200 to the second zipper profile opening member 212 (the shoulder members 212A, 212B not being shown in the cross-section of FIG. 19B) that is configured to de-occlude closure elements of a closure assembly as the slider 200 is slid in the opening direction. Preferably, the support member 210 and the second zipper profile opening member 212 extend from the top wall 201 of the slider 200 to a length (or width) necessary to separate the lower closure elements of a double zipper closure assembly. Accordingly, in a preferred embodiment, the second zipper profile opening member 212 is configured to only open the lower closure elements of a double zipper closure assembly without extending through the lower closure elements. As also shown in FIGS. 19A and 19B, the first closing bars 255, 265 are positioned such that they assist in occluding upper closure elements of a double zipper closure assembly, when the slider is slid in a closing direction, while the second closing bars 270, 280 are positioned such that they assist in occluding lower closure elements of the double zipper closure assembly, when the slider is slid in a closing direction.

FIG. 20 illustrates a side cross-sectional view of the slider 200, with the second wing 204 removed to illustrate the support member 210, the first zipper profile opening member 214, and the second zipper profile opening member 212 with more clarity. In particular, as shown in FIG. 20, the support member 210 extends from the top wall 201 of the slider to the second zipper profile opening member 212, while the first zipper profile opening member 214 is connected to both the top wall 201 and the support member 210 via a connecting member 215. The connecting member 215 is preferably attached to the underside 206 of the top wall 201 (see, e.g., FIG. 18). Thus, the slider 200 includes a singular separator finger or separating mechanism that comprises the support member 210 to which is attached (i) the second zipper profile opening member 212 and (ii) the first zipper profile opening member 214 via the connecting member 215. Alternatively, the slider 200 could comprise two separator fingers, with the support member 210 and the second zipper profile opening member 212 comprising a first separator finger, and the first zipper profile opening member 214, which would extend directly from the top wall 201, being a separate and distinct separator finger, such that the connecting member 215 is completely removed from this alternative embodiment (see, for example, the embodiment of FIGS. 30 and 32).

Figure 21A:
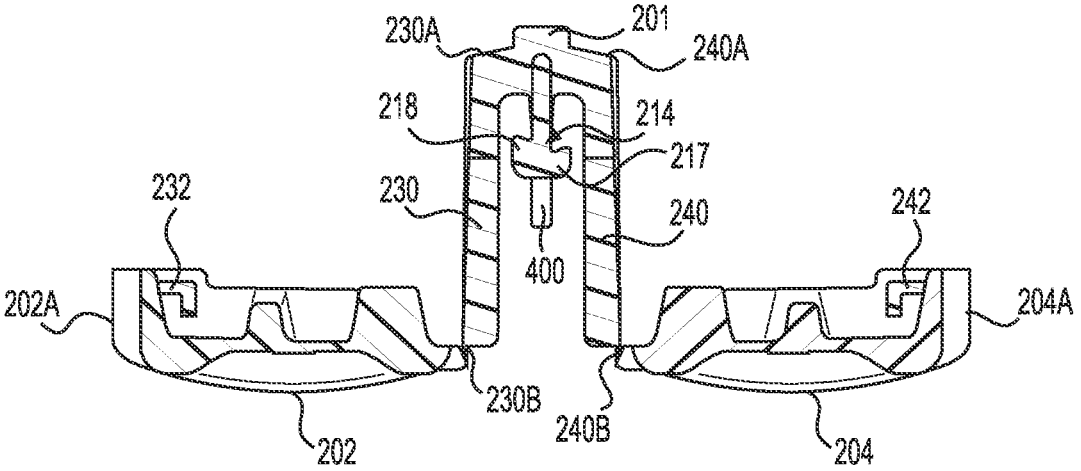
FIG. 21A is a front-side cross-sectional view taken along line 21A-21A of FIG. 15 showing the slider of FIG. 15 in an opened position.
Figure 21B:
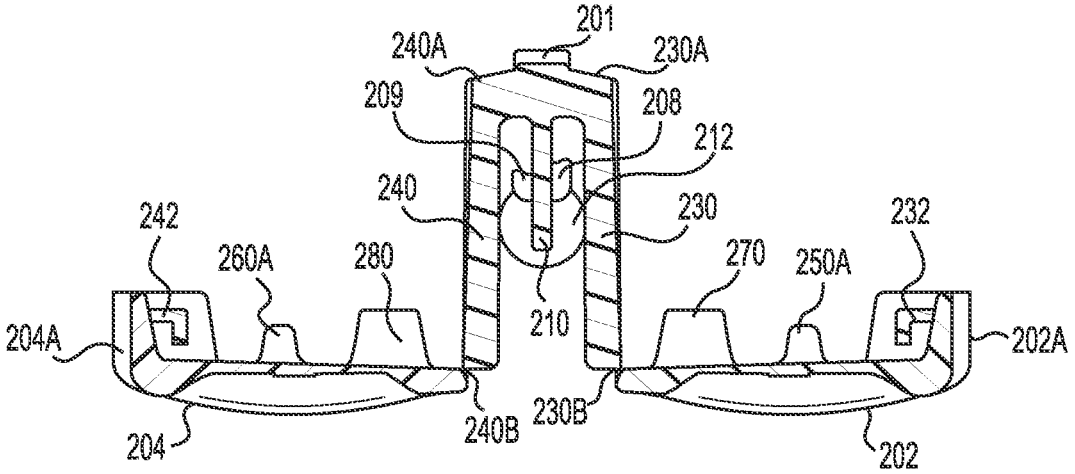
FIG. 21B is a back-side cross-sectional view taken along line 21B-21B of FIG. 15 showing the slider of FIG. 15 in an opened position.
Figure 22:
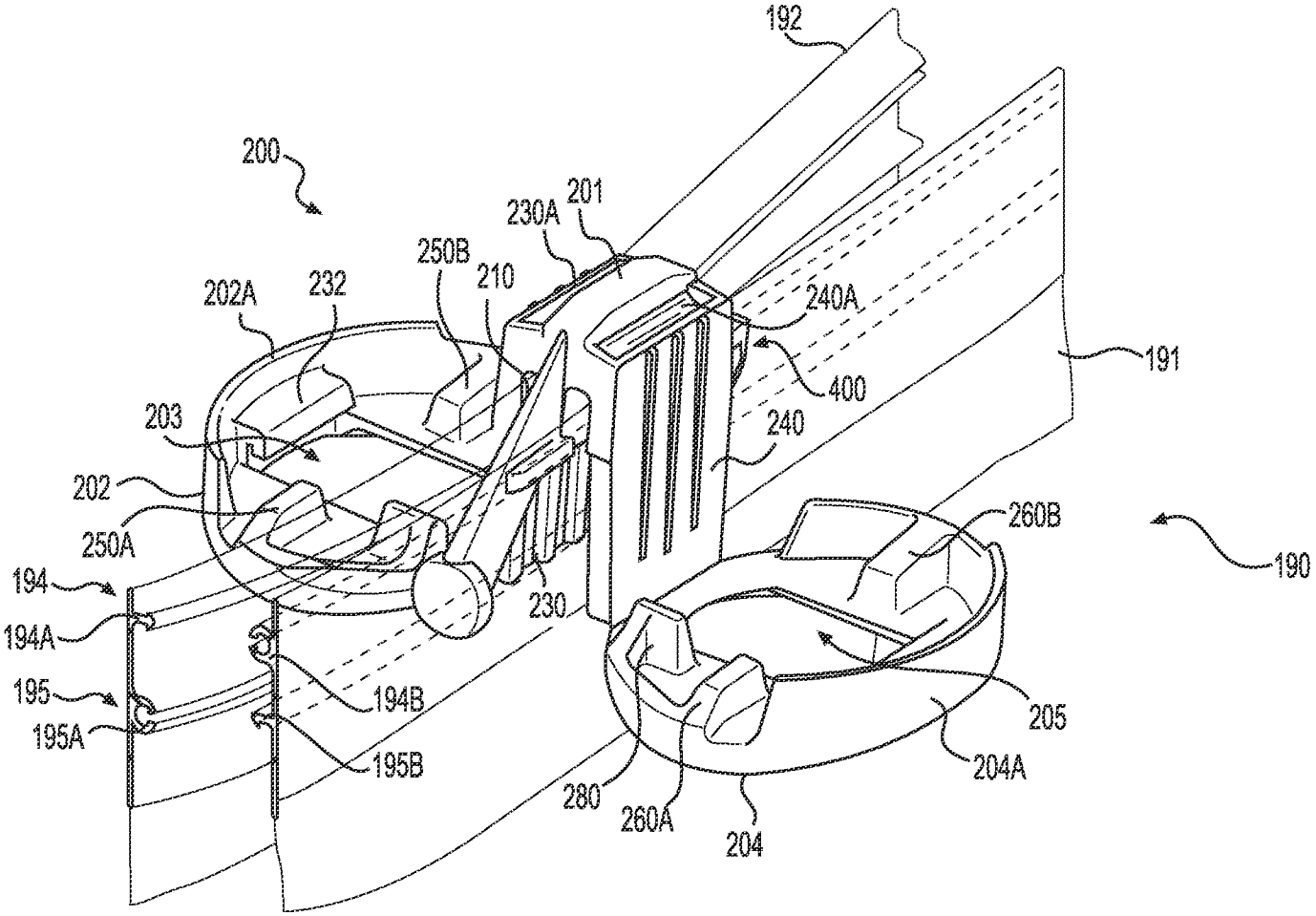
FIG. 22 is a top perspective view of the slider of FIG. 14 in an opened position and being positioned onto a closure assembly.

FIGS. 21A, 21B, and 22 illustrate the hinged slider 200 in an open position in which the latches 232, 242 of the first and second wings 202, 204 are detached from the openings 230A, 240A of the legs 230, 240. In this open position, the slider 200 can be positioned over a closure mechanism of a bag and then attached into place onto the closure mechanism, by hinging the first and second wings 202, 204 upward. In particular, as shown in FIG. 22, the slider 200 is in an open position, and positioned over a pair of sidewalls 191, 192 of a bag 190. The bag 190 includes a closure assembly with an upper zipper profile 194 that includes a first closure element 194A and a second closure element 194B, and a lower zipper profile 195 that includes a first closure element 195A and a second closure element 195B. The slider 200, in the open position, is positioned over the sidewalls 191, 192 of the bag 190, such that the legs 230, 240 of the slider 200 straddle the exterior surfaces of the sidewalls 191, 192 of the bag 190. Moreover, the slider 200 is positioned such that at least the second zipper profile opening member 212 is disposed between the interior surfaces of the sidewalls 191, 192 of the bag 190 and between the upper and lower zipper profiles 194, 195.

Figure 23:
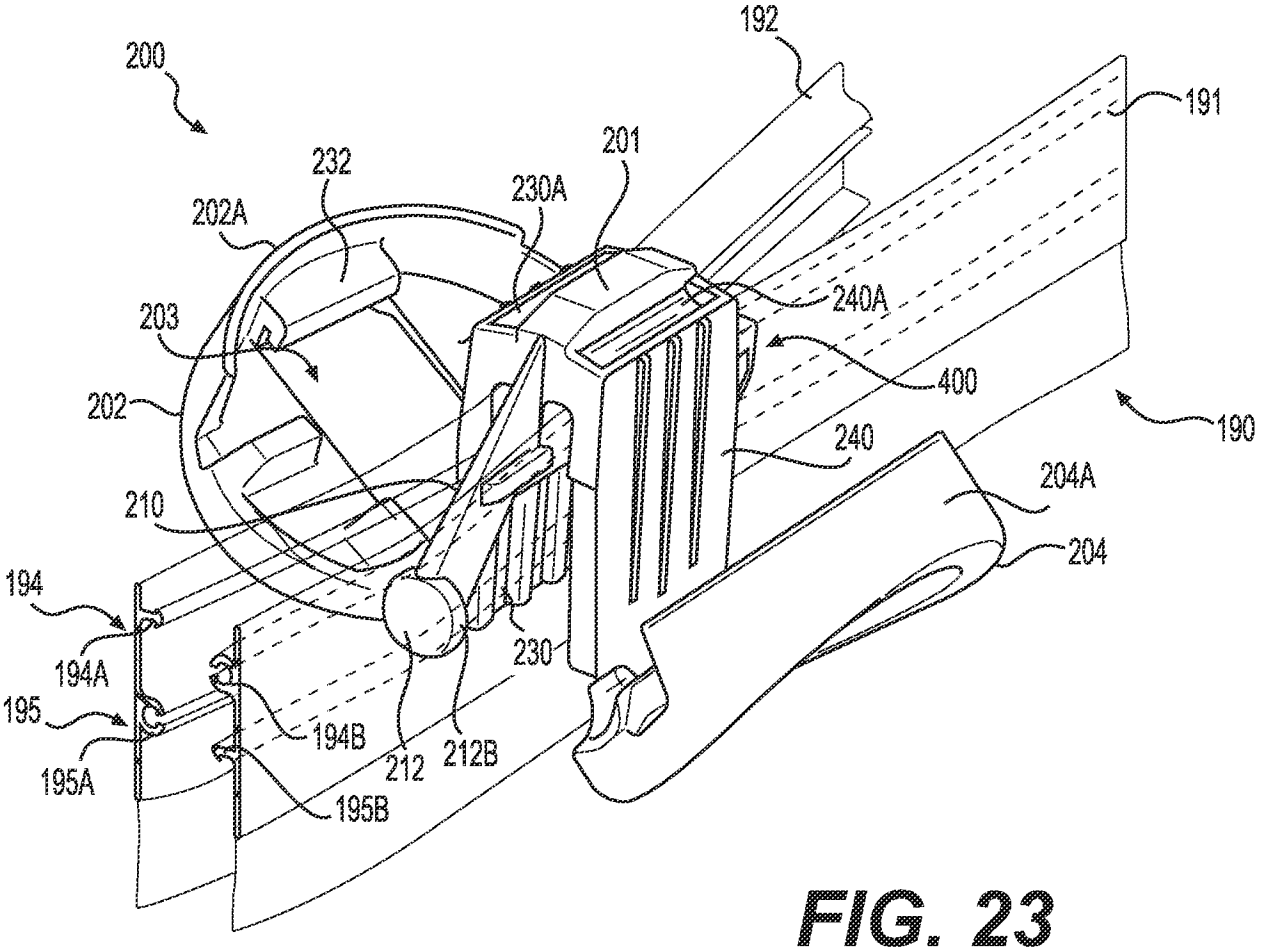
FIG. 23 is a top perspective view of the slider of FIG. 14 with wings of the slider being rotated upward to be positioned onto a closure assembly.
Figure 24:
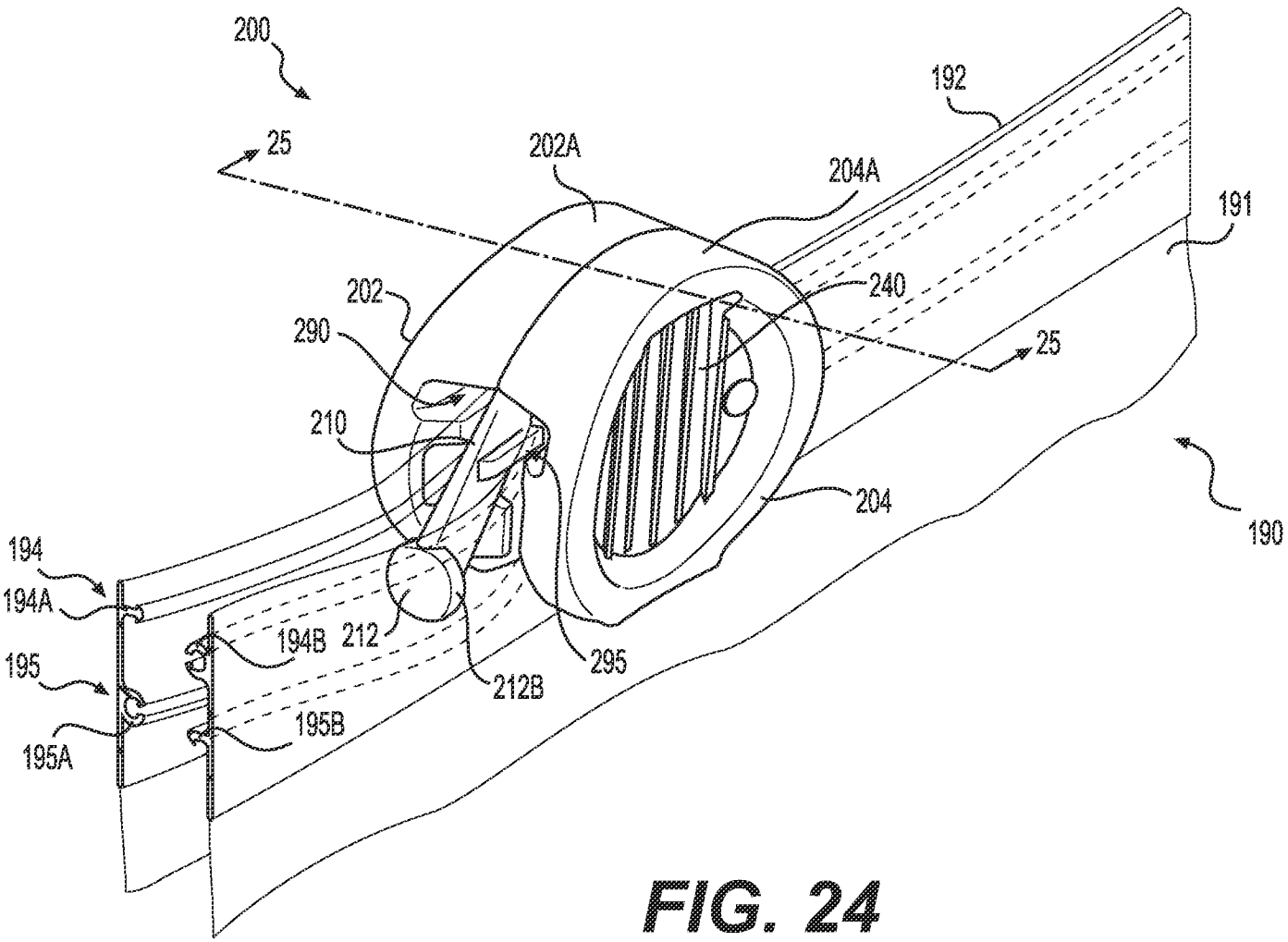
FIG. 24 is a top side perspective view of the slider of FIG. 14 in a closed position and being operatively engaged on a closure assembly.

FIG. 23 illustrates the initial hinging of the first and second wings 202, 204 of the slider 200. In particular, the first and second wings 202, 204 are rotated upward toward the top wall 201 of the slider 200 and the top of the bag 190, with the hinges 230B, 240B acting as the axis of rotation. FIG. 24 illustrates the first and second wings 202, 204 locked into place onto the legs 230, 240 of the slider 200. In this closed position, the latches 232 and 242 of the first and second wings 202, 204 are snapped into place on the respective openings 230A, 240A of the respective legs 230, 240, and the slider 200 is in an assembled condition and operatively engaged onto the closure assembly, i.e., the upper and lower zipper profiles 194, 195. FIG. 24 also illustrates that in the closed position, the slider 200 includes a pair of cut-outs 290, 295 at the back end of the slider. These cut-outs 290, 295 are configured to assist in vertical slider retention. In particular, these cut-outs 290, 295 provide an area into which the zipper profile, preferably, the upper zipper profile, falls, such that when an opening force is applied to pull the zipper profile(s) apart, the slider will remain on the zipper profile(s). Accordingly, by including these cut-outs 290, 295, a higher opening force will be required to pull the zipper profile(s) apart and to pull the slider off of the bag. As also shown in FIG. 24, the upper and lower zipper profiles 194, 195 are in an occluded position at least one end of the bag 190, such that the sidewalls 191, 192 are positioned adjacent to each other, and the first closure element 194A is occluded with the second closure element 194B of the upper zipper profile 194, and the first closure element 195A is occluded with the second closure element 195B of the lower zipper profile 195.

Figure 25:
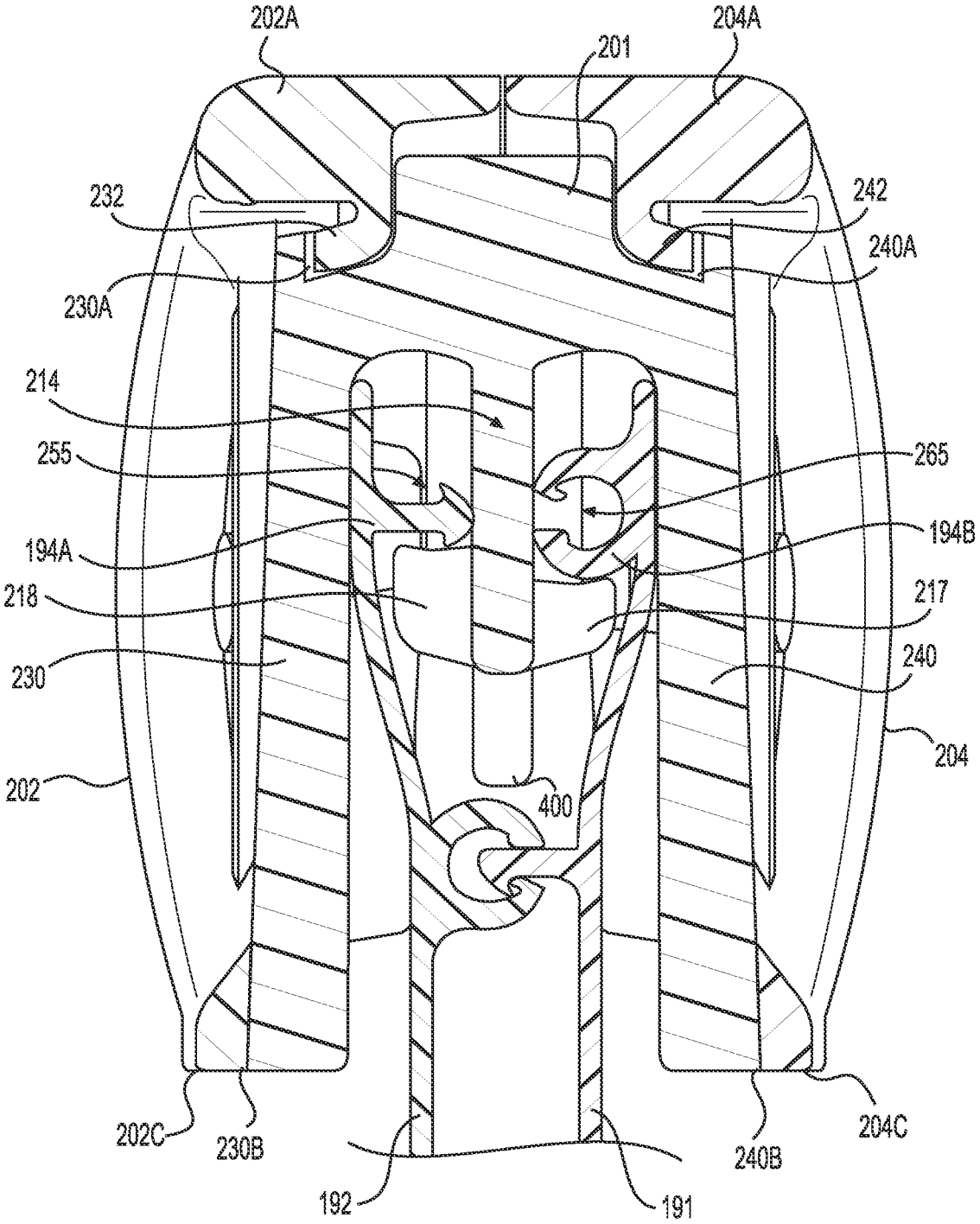
FIG. 25 is an enlarged partial cross-sectional view taken along line 25-25 of FIG. 24 showing the slider of FIG. 14, in a closed position, and being operatively engaged on a double zipper profile of a closure assembly with portions behind the plane of the cross section omitted for clarity.

FIG. 25 illustrates the slider 200 shown in FIG. 24 operatively engaged on the double zipper profile shown in FIGS. 22-24. As shown in FIG. 25, the first and second closure elements 194A, 194B of the upper zipper profile 194, and the first and second closure elements 195A, 195B of the lower zipper profile 195 are disposed underneath the top wall 201 of the slider 200 and between the legs 230, 240 and the first and second wings 202, 204. In this view, which is in the opening direction, the first zipper profile opening member 214, which extends from the top wall 201 of the slider 200, is disposed in the area between the first and second closure elements 194A, 194B of the upper zipper profile 194 and the first and second closure elements 195A, 195B of the lower zipper profile 195. In particular, the first zipper profile opening member 214 is wedged between the first and second closure elements 194A, 194B of the upper zipper profile 194, as the first zipper profile opening member 214 has de-occluded the first and second closure elements 194A, 194B of the upper zipper profile 194. As also shown in FIG. 25, an extension member 400, along with first and second retention members 217, 218, which will be described in more detail below, are positioned below the first and second closure elements 194A, 194B of the upper zipper profile 194 and above the first and second closure elements 195A, 195B of the lower zipper profile 195. The first zipper profile opening member 214, as well as the extension member 400, however, does not extend to a point adjacent to or below the first and second closure elements 195A, 195B of the lower zipper profile 195. FIG. 25 further illustrates the first wing 202 of the slider 200 extending from the top surface 202A to the bottom edge 202C and the hinge 230B, and the second wing 204 of the slider 200 extending from the top surface 204A to the bottom edge 204C and the hinge 240B.

Referring to FIGS. 19A, 19B, 24, and 25, when the slider 200 operatively moves, such as by being slid by a user, along the zipper profiles in an occluding direction, i.e., from right to left in FIG. 24, the first closing bars 255, 265 occlude the first and second closure elements 194A, 194B of the upper zipper profile 194, respectively. The second closing bars 270, 280 assist in occluding the first and second closure elements 195A, 195B of the lower zipper profile 195. When the slider 200 operatively moves in a de-occluding direction, i.e., from left to right in FIG. 24, the first zipper profile opening member 214 de-occludes the first and second closure elements 194A, 194B of the upper zipper profile 194, by extending therebetween and forcing these closure elements apart via a wedging action (see, e.g., FIG. 25). Thereafter, the second zipper profile opening member 212, which trails behind the first zipper profile opening member 214 in the de-occluding direction, de-occludes the first and second closure elements 195A, 195B of the lower zipper profile 195, by interacting with or pressing upon at least the area between the upper and lower zipper profiles 194, 195. The retention members 208, 209, however, which are included on the support member 210 to assist in retaining the slider on a zipper profile, such as, for example, the upper zipper profile 194, are configured to not interact with or de-occlude the closure elements of the upper or lower zipper profiles 194, 195, as discussed above. Moreover, the extension member 400, as well as the first and second retention members 217, 218, discussed above, are also included to assist in retaining the slider on a zipper profile, such as, for example, the upper zipper profile 194, and are configured to not interact with or de-occlude the closure elements of the upper or lower zipper profiles 194, 195.

Figure 26:
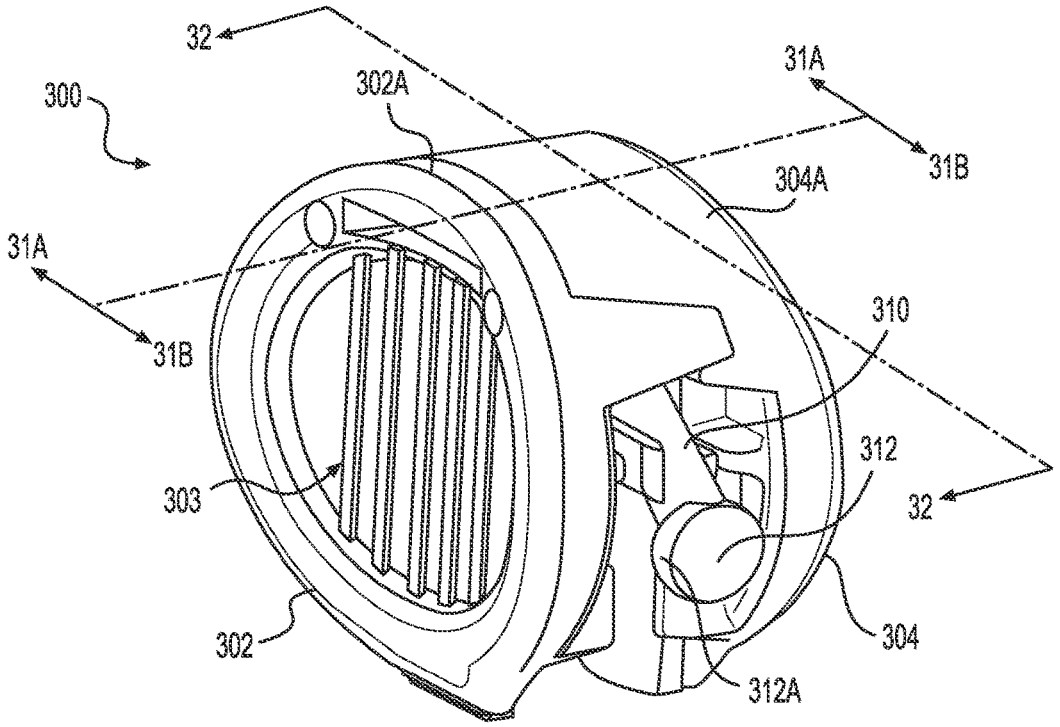
FIG. 26 is a top perspective view of a slider according to another embodiment of the invention.
Figure 27:
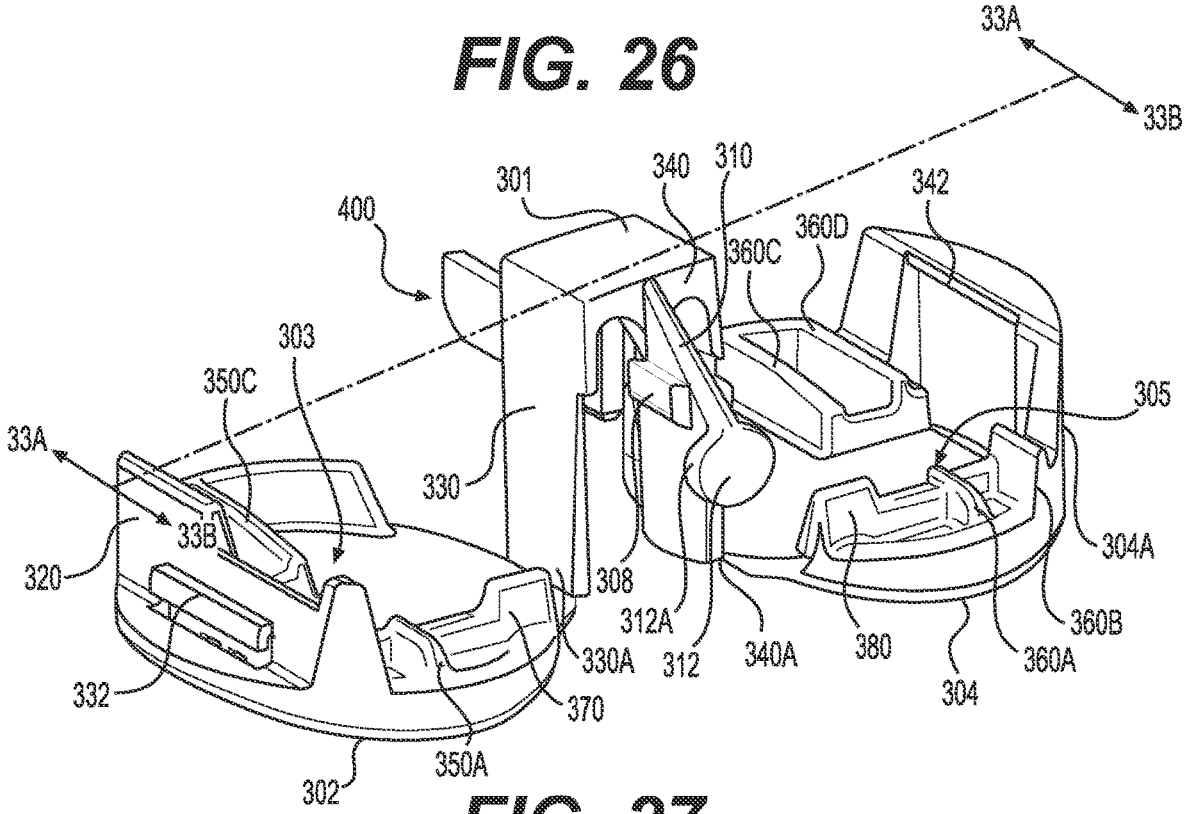
FIG. 27 is a top perspective view of the slider shown in FIG. 26 in an opened position.

FIGS. 26 and 27 illustrate another embodiment of a slider 300 that also includes first and second opposing wings 302, 304. The first wing 302 includes a top surface 302A and a bottom edge 302B (see, e.g., FIG. 31A). The second wing 304 includes a top surface 304A and a bottom edge 304B (see, e.g., FIG. 31A). The first wing 302 is hingedly attached, via a hinge 330A, to a leg 330 of the slider 300 at the bottom edge 302B of the first wing 302, while the second wing 304 is hingedly attached, via a hinge 340A, to a leg 340 of the slider 300 at the bottom edge 304B of the second wing 304. The first wing 302 includes an arcuateportion 303 that is filled-in with a material forming the slider 300. The second wing 304 also includes a similar arcuate portion 305 that is not shown in FIG. 26. Although the arcuate portion 303 is filled-in in the embodiment shown in FIG. 26, the arcuate portion 303 could alternatively be hollow or partially filled-in. In addition, the arcuate portion 303 can be an ellipse or an oval shape, as shown in, for example, FIG. 26. However, the arcuate portion 303 could be of a different shape, such as, for example, a circular, rectangular, or square shape, or any other polygonal shape, etc., since the specific shape and configuration of the wings and/or arcuate portions can be altered without departing from the spirit of the invention. The legs 330, 340 of the slider 300 are vertically extending, and extend from a top wall 301 of the slider 300 to the bottom edges 302B, 304B of the respective first and second wings 302, 304. A bottom end of the leg 330 that is adjacent to the bottom edge 302B of the first wing 302, includes the hinge 330A, which attaches the leg 330 to the first wing 302. A bottom end of the leg 340 that is adjacent to the bottom edge 304B of the second wing 304, includes the hinge 340A, which attaches the leg 340 to the second wing 304. As described in more detail below, the first and second wings 302, 304 of the slider 300 of this embodiment hinge upwardly. As discussed above, the upward hinging of the first and second wings 302, 304 of the slider 300 has been found to allow for a narrower slider body and a stronger latch, as well as a latching at the top of the slider 300 that has been found to prevent damage to a zipper profile(s) during assembly.

As shown in FIG. 26, when the slider 300 is in a closed position, the top surface 302A of the first wing 302 is positioned adjacent to the top surface 304A of the second wing 304, and the top wall 301 of the slider 300 and the legs 330, 340 are covered by the top surfaces 302A, 304A and the first and second wings 302, 304. Moreover, in the closed position, the first and second wings 302, 304 of the slider 300 define a channel therebetween in which a closure assembly, such as a single or double zipper, can be operatively accepted. The slider 300 further includes a support member 310 that extends from the top wall 301 into the channel spaced between the first and second wings 302, 304, and the pair of legs 330, 340. The support member 310, which is substantially similar to the support member 210 shown in the embodiment of FIGS. 14-25, includes a second zipper profile opening member 312 at a distal end thereof. The second zipper profile opening member 312 includes a first shoulder member 312A and a second shoulder member 312B (see, e.g., FIGS. 28 and 29) that extend orthogonally to the direction of slider travel along the zipper profiles. The first and second shoulder members 312A, 312B preferably comprise arcuate members that extend toward respective closure elements of a single or double zipper closure assembly. The first and second shoulder members 312A, 312B of the second zipper profile opening member 312 enables the distal end of the support member 310 to reach the width necessary to de-occlude closure elements of a single or double zipper closure assembly via a wedging action. In a preferred embodiment, the second zipper profile opening member 312 is configured to de-occlude closure elements of a lower zipper profile of a double zipper closure assembly via a wedging action, without penetrating through the lower zipper profile. The width of the second zipper profile opening member 312 is sufficient to open the closure elements of the lower zipper profile, but the width is small enough to be stored in a detent that can be formed between the upper and lower zipper profiles, and is described in more detail below. In one embodiment, the upper and lower zipper profiles are spaced apart from each other at a center-to-center spacing of between about 150 mils and about 225 mils, and preferably, about 200 mils apart. In addition, the zipper profiles each have a thickness (which is measured from a back side of the first closure element to an opposing back side of the second closure element) of about 50 mils to about 80 mils, and preferably, about 52 mils to about 56 mils. In this embodiment, the second zipper profile opening member 312 preferably has a width (i.e., from edge of first shoulder member 312A to edge of second shoulder member 312B) of about 40 mils to about 160 mils, and more preferably, of about 70 mils to about 128 mils in order to effectively de-occlude the closure elements of a lower zipper profile with the thickness described above, as well as the center-to-center spacing from the upper zipper profile as described above.

Figure 28:
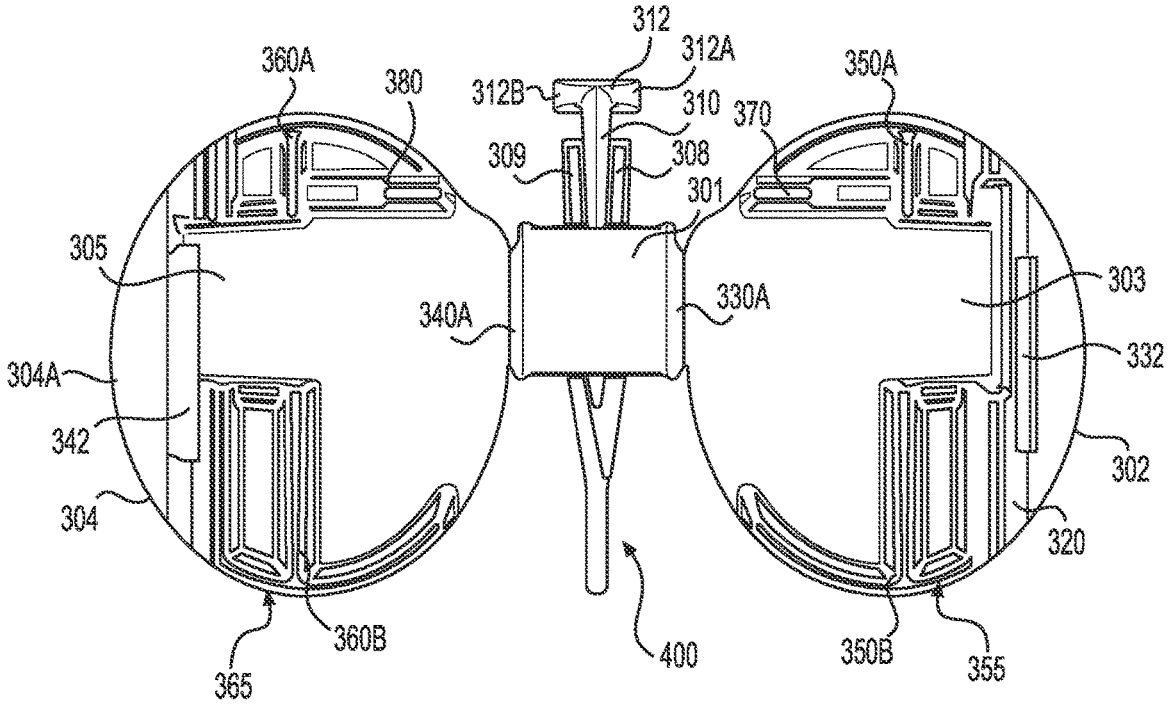
FIG. 28 is a top view of the slider shown in FIG. 27 in an opened position.
Figure 29:
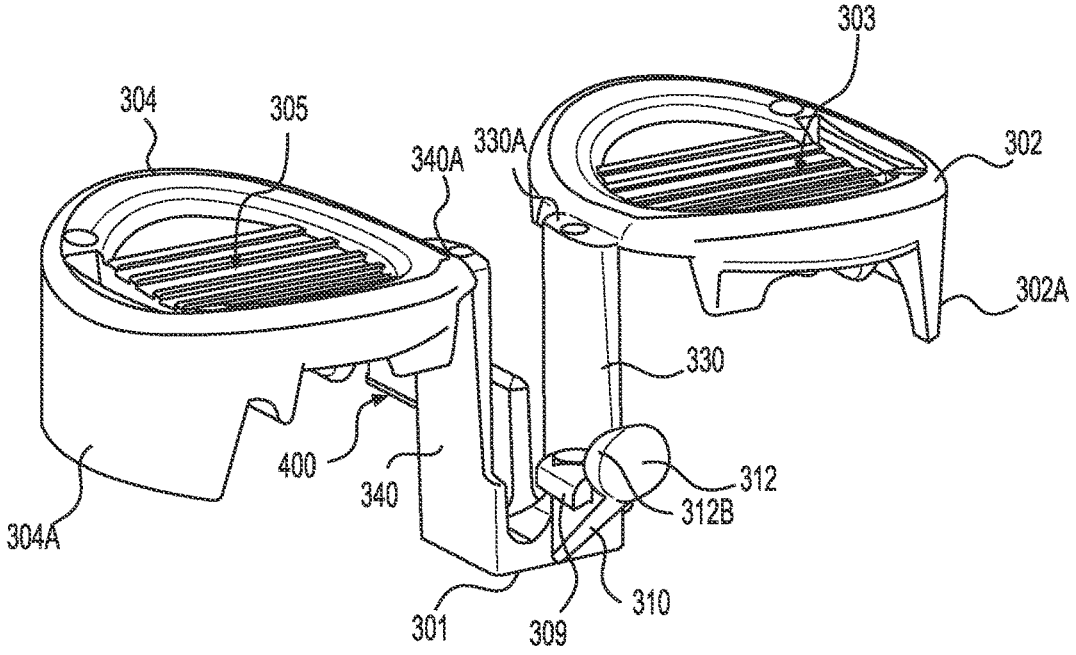
FIG. 29 is a bottom perspective view of the slider shown in FIG. 27 in an opened position.

As shown in FIG. 27, the support member 310 also includes a retention member 308 that assists in retaining the slider on the zipper profiles, such that a user cannot easily pull the slider vertically off of the bag. The support member 310 preferably includes a similar retention member 309 on the opposing side to the retention member 308, which is shown in FIGS. 28 and 29. The retention members 308, 309 are configured to assist in retaining the slider on the zipper profiles by engaging with an underside of the closure elements of the zipper profile(s), preferably, the underside of the closure elements of an upper zipper profile. The retention members 308, 309, however, do not extend from the support member 310 to a point in which the retention members 308, 309 interact with the closure elements or a base strip of the closure elements in such a manner as to de-occlude the closure elements. Although the support member 310 and second zipper profile opening member 312 of the slider of the embodiment of FIGS. 26-37 extend to an area outside of the first and second wings 302, 304 of the slider 300, the support member 310 and second zipper profile opening member 312 can alternatively be positioned entirely within the first and second wings 302, 304 of the slider 300.

Figure 32:
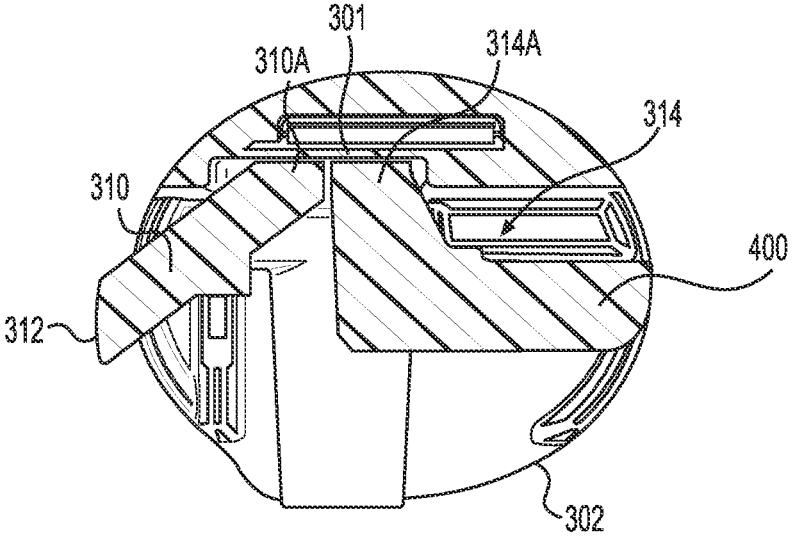
FIG. 32 is a side cross-sectional view taken along line 32-32 of FIG. 26 showing the slider of FIG. 26 in a closed position with portions of the slider omitted for clarity.

As shown in, for example, FIG. 32, the slider 300 further includes a first zipper profile opening member 314 (see also, e.g., FIGS. 38A and 38C). In this embodiment, the first zipper profile opening member 314 is directly attached to the top wall 301 of the slider 300, such that the first zipper profile member 314 is a separate and distinct separating mechanism from the support member 310 with the second zipper profile opening member 312 (see, e.g., FIGS. 30 and 32). Alternatively, the first zipper profile member 314 can be attached to the support member 310 to create a singular separator finger or separating mechanism (see, for example, the embodiment of FIG. 20).

Figure 31A:
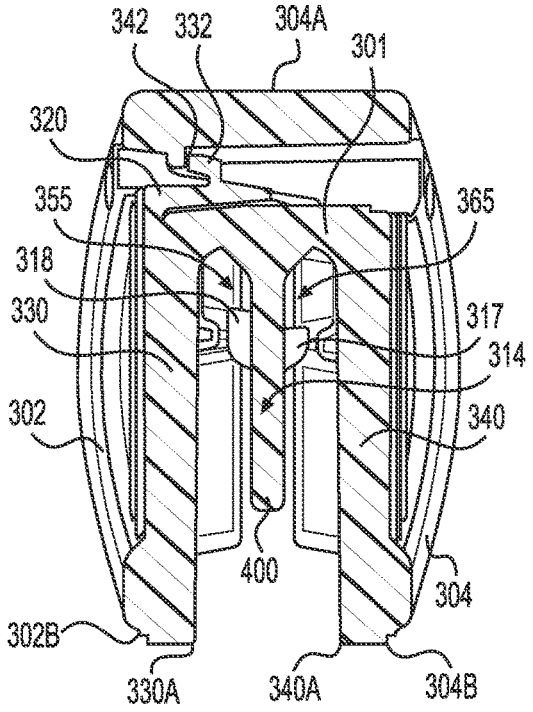
FIG. 31A is a front-side cross-sectional view taken along line 31A-31A of FIG. 26 showing the slider of FIG. 26 in a closed position.
Figure 31B:
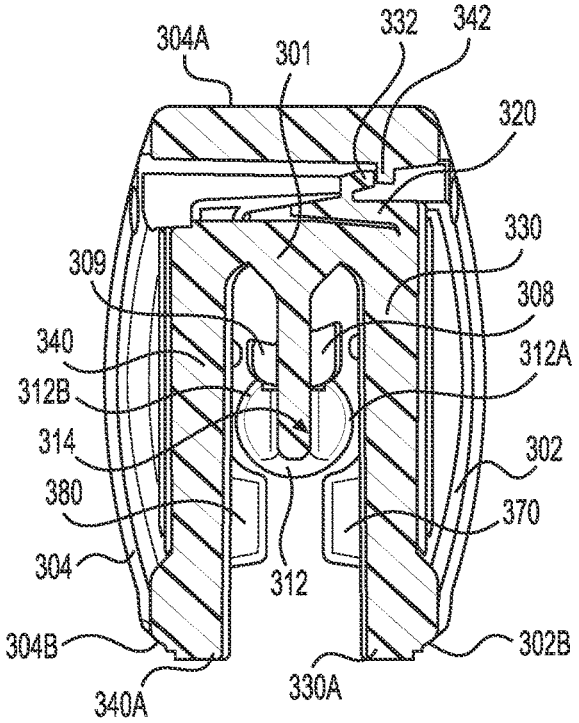
FIG. 31B is a back-side cross-sectional view taken along line 31B-31B of FIG. 26 showing the slider of FIG. 26 in a closed position.

As shown in FIGS. 27 and 28, the interior surface of the first wing 302, as well as the interior surface of the second wing 304, include various elements for attaching the first and second wings 302, 304 to each other. In particular, the interior surface of the first wing 302 includes a ledge 320 from which a latch 332 extends that is disposed underneath the top surface 302A of the first wing 302. In contrast, the top surface 304A of the second wing 304 includes an opening 342 on an underside of the top surface 304A, which is configured to engage with the latch 332 of the first wing 302. While the embodiment of FIGS. 27 and 28 illustrates a singular latch 332 on the first wing 302, multiple latches and engagement structures could be used, as opposed to the singular latch structure of this embodiment. Alternatively, the latch 332 could be placed on the second wing 304, while the opening 342 could be placed on the first wing 302. As discussed above, the latch 332 of the first wing 302 is configured to engage with the opening 342 of the second wing 304. The latching mechanism is a compression-type latch in that the latch 332 is flexible enough to deflect and to snap into place in the opening 342 of the second wing 304 to lock the first and second wings 302, 304 together. In particular, as shown in FIGS. 31A and 31B, when the slider 300 is in the closed position, the latch 332 of the first wing 302 has deflected and snapped into place in the opening 342 of the second wing 304. Once the latch 332 of the first wing 302 is engaged with the opening 342 of the second wing 304, it becomes difficult for a user to disengage the first and second wings 302, 304 from each other. By creating a latch over the center of the top of the slider 200, the latch will in turn be positioned over the center of the zipper profile(s). By positioning the latch in such a manner, the latch is stronger even in a case where the internal forces of a bag containing the zipper profile(s) increase due to the pressure created by the contents of the bag.

As also shown in FIGS. 27 and 28, the first wing 302 includes a first closing bar 355, a second closing bar 370, and a pair of backer bars 350A and 350B that are provided on the interior surface of the first wing 302. The second wing 304 also includes a first closing bar 365, a second closing bar 380, and a pair of backer bars 360A and 360B that are provided on the interior surface of the second wing 304. The closing bars 355, 365, 370, 380 are configured to occlude closure elements of a closure assembly, once the slider 300 is operatively engaged on the closure assembly, while the backer bars 350A, 350B, 360A, and 360B are configured to provide strength and stability to the slider, as well as assistance in retaining the slider on a zipper profile(s). As also shown in FIG. 28, the first and second closing bars 355, 370 of the first wing 302 and the first and second closing bars 365, 380 of the second wing 304 are provided on opposite sides of the respective wing 302, 304 and respective leg 330, 340. While the embodiment of FIG. 28 illustrates the first closing bars 355, 365 being positioned on the front end of the slider, and the second closing bars 370, 380 being positioned on the back end of the slider, the closing bars 355, 365, 370, 380 can be positioned an any point along the interior surfaces of the wings as long as the first closing bars 355, 365 are offset or staggered from the second closing bars 370, 380. By positioning the closing bars in such a manner, the internal deflection forces of the slider can be balanced, and the occlusion of the closure elements by the first closing bars 355, 365 will not impact the occlusion of the closure elements by the second closing bars 370, 380. In a preferred embodiment, the first closing bars 355, 365 are configured to occlude closure elements of an upper zipper profile of a double zipper closure assembly, while the second closing bars 370, 380 are configured to occlude closure elements of a lower zipper profile of the double zipper closure assembly. Thus, the occlusion of the closure elements of the upper zipper profile by the first closing bars 355, 365 will not impact the occlusion of the closure elements of the lower zipper profile by the second closing bars 370, 380. In another preferred embodiment, the second closing bars 370, 380 are positioned such that they will be no greater than 400 mils from the end of bag when the slider has effectively occluded the zipper profiles of the bag.

As shown in FIG. 31A, the front side of the slider 300 includes the first zipper profile opening member 314 that extends from the top wall 301 of the slider 300. The first zipper profile opening member 314 is configured to de-occlude closure elements of a closure assembly as the slider 300 is slid in an opening direction. The first zipper profile opening member 314 preferably extends from the top wall 301 of the slider 300 to a length (or width) that does not engage with lower closure elements in a double zipper closure assembly. However, the first zipper profile opening member 314 preferably extends from the top wall 301 of the slider 300 to a length (or width) necessary to engage with upper closure elements of a double zipper closure assembly. Accordingly, in a preferred embodiment, the first zipper profile opening member 314 is configured to only open the upper closure elements of a double zipper closure assembly. In addition, as shown in FIG. 31B, the back side of the slider 300 includes the support member 310 that extends from the top wall 301 of the slider 300 to the second zipper profile opening member 312. The second zipper profile opening member 312, which includes the first and second shoulder members 312A, 312B, is configured to de-occlude closure elements of a closure assembly as the slider 300 is slid in the opening direction. Preferably, the support member 310 and the second zipper profile opening member 312 extend from the top wall 301 of the slider 300 to a length (or width) necessary to separate the lower closure elements of a double zipper closure assembly, without extending through the lower closure elements. Accordingly, in a preferred embodiment, the second zipper profile opening member 312 is configured to only open the lower closure elements of a double zipper closure assembly. As also shown in FIGS. 31A and 31B, the first closing bars 355, 365 are positioned such that they assist in occluding upper closure elements of a double zipper closure assembly, when the slider is slid in a closing direction, while the second closing bars 370, 380 are positioned such that they assist in occluding lower closure elements of the double zipper closure assembly, when the slider is slid in a closing direction.

FIG. 32 illustrates a side cross-sectional view of the slider 300, with the second wing 304 removed to illustrate the support member 310, the first zipper profile opening member 314, and the second zipper profile opening member 312 with more clarity. In particular, as shown in FIG. 32, the support member 310 is connected to the top wall 301 of the slider 300 at portion 310A, and extends to the second zipper profile opening member 312, while the first zipper profile opening member 314 is connected to top wall 301 of the slider 300 at portion 314A. As shown more clearly in FIG. 30, at open area 316, the portion 310A of the support member 310 is not connected to the portion 314A of the first zipper profile opening member 314. Thus, the slider 300 includes two distinct and unattached members, i.e., the support member 310 with the second zipper profile opening member 312, and the first zipper profile opening member 314. Alternatively, the slider 300 could comprise a singular separator finger or separating mechanism, with the support member 310 extending from the top wall 301 of the slider 300 to the second zipper profile opening member 312, and the first zipper profile opening member 314 being attached to the support member 310 (see, for example, the embodiment of FIG. 20).

Figure 33A:
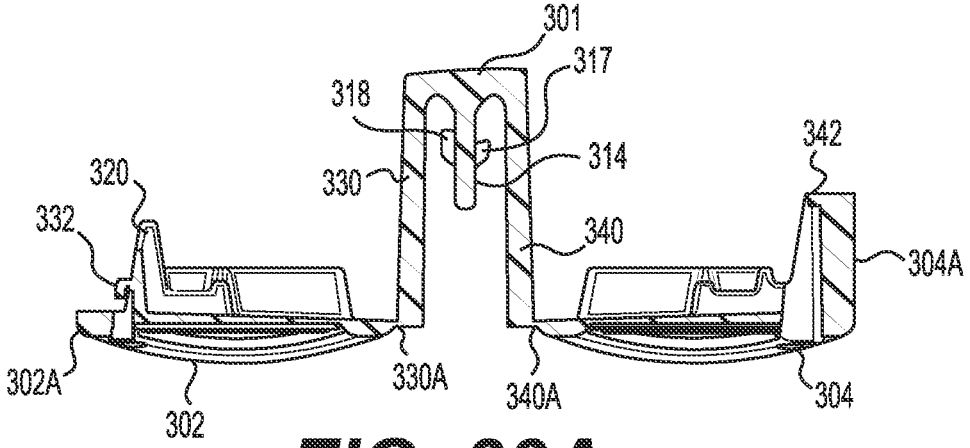
FIG. 33A is a front-side cross-sectional view taken along line 33A-33A of FIG. 27 showing the slider of FIG. 27 in an opened position.
Figure 33B:
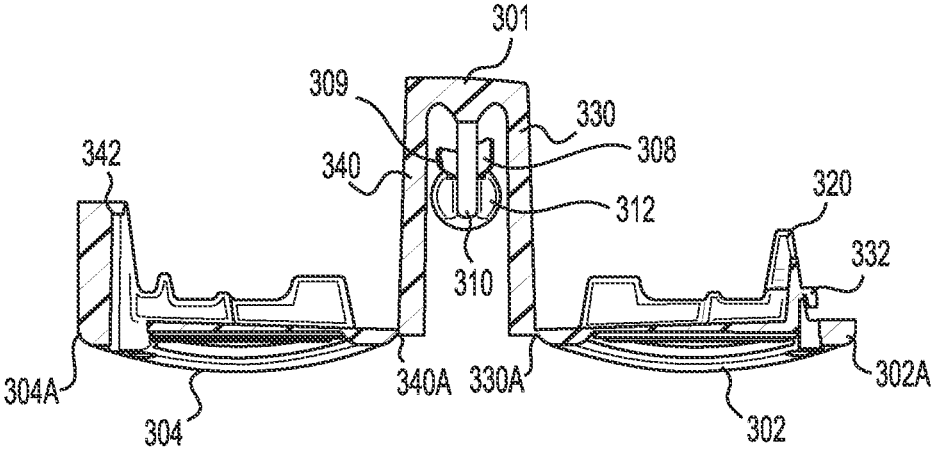
FIG. 33B is a back-side cross-sectional view taken along line 33B-33B of FIG. 27 showing the slider of FIG. 27 in an opened position.
Figure 34:
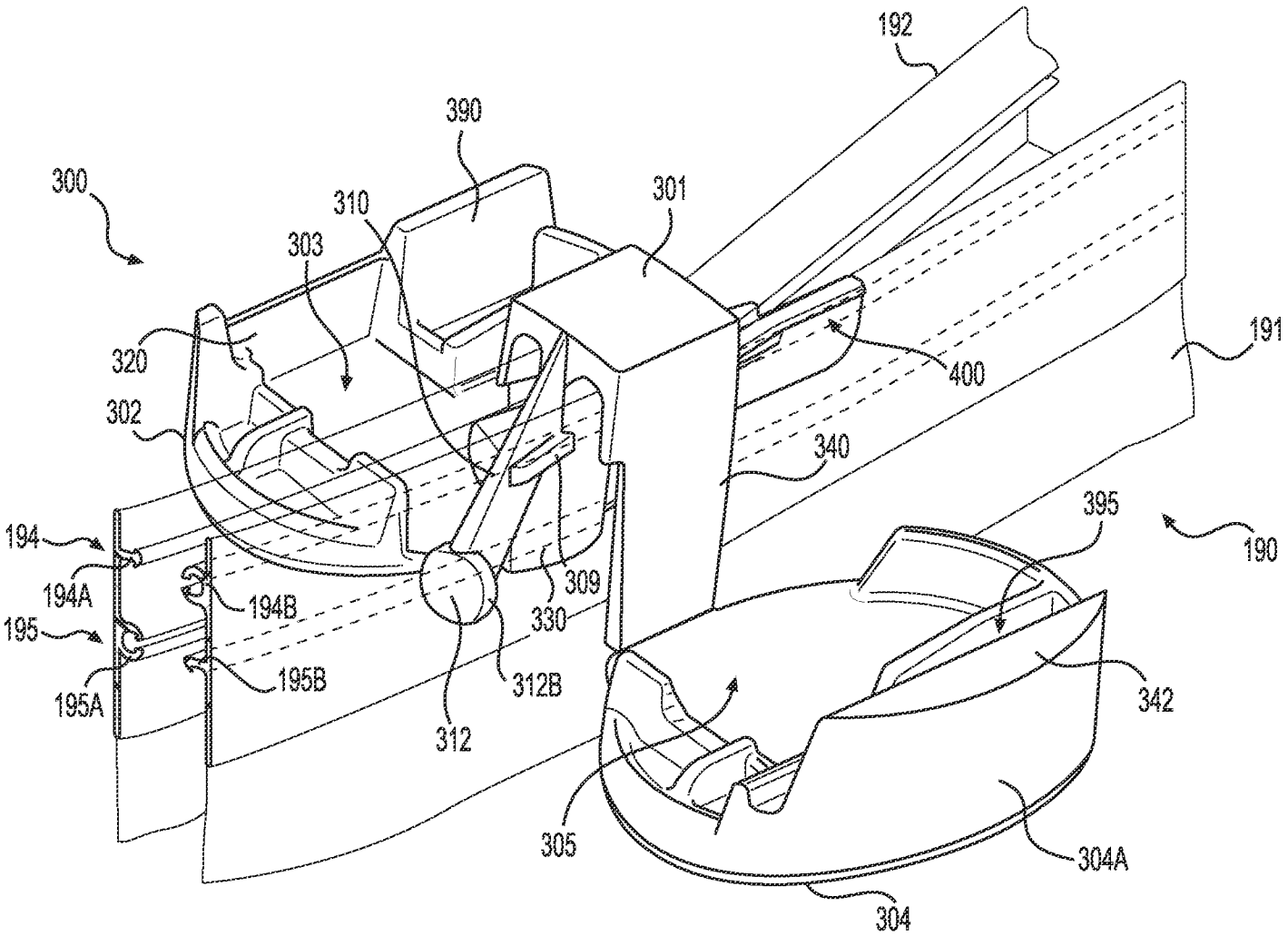
FIG. 34 is a top perspective view of the slider of FIG. 26 in an opened position and being positioned onto a closure assembly.

FIGS. 33A, 33B, and 34 illustrate the hinged slider 300 in an open position in which the latch 332 of the first wing 302 is detached from the opening 342 of the second wing 304. In this open position, the slider 300 can be positioned over a closure mechanism of a bag and then attached into place onto the closure mechanism, by hinging the first and second wings 302, 304 upward. In particular, as shown in FIG. 34, the slider 300 is in an open position, and positioned over a pair of sidewalls 191, 192 of a bag 190. The bag 190 includes a closure assembly with an upper zipper profile 194 that includes a first closure element 194A and a second closure element 194B, and a lower zipper profile 195 that includes a first closure element 195A and a second closure element 195B. The slider 300, in the open position, is positioned over the sidewalls 191, 192 of the bag 190, such that the legs 330, 340 of the slider 300 straddle the exterior surfaces of the sidewalls 191, 192 of the bag 190. Moreover, the slider 300 is positioned such that at least the second zipper profile opening member 312 is disposed between the interior surfaces of the sidewalls 191, 192 of the bag 190 and between the upper and lower zipper profiles 194, 195. As also shown in FIG. 34, the slider 300 includes a tongue member 390 and a groove member 395, that are configured to engage with one another as the slider 300 is hinged into a closed position.

Figure 35:
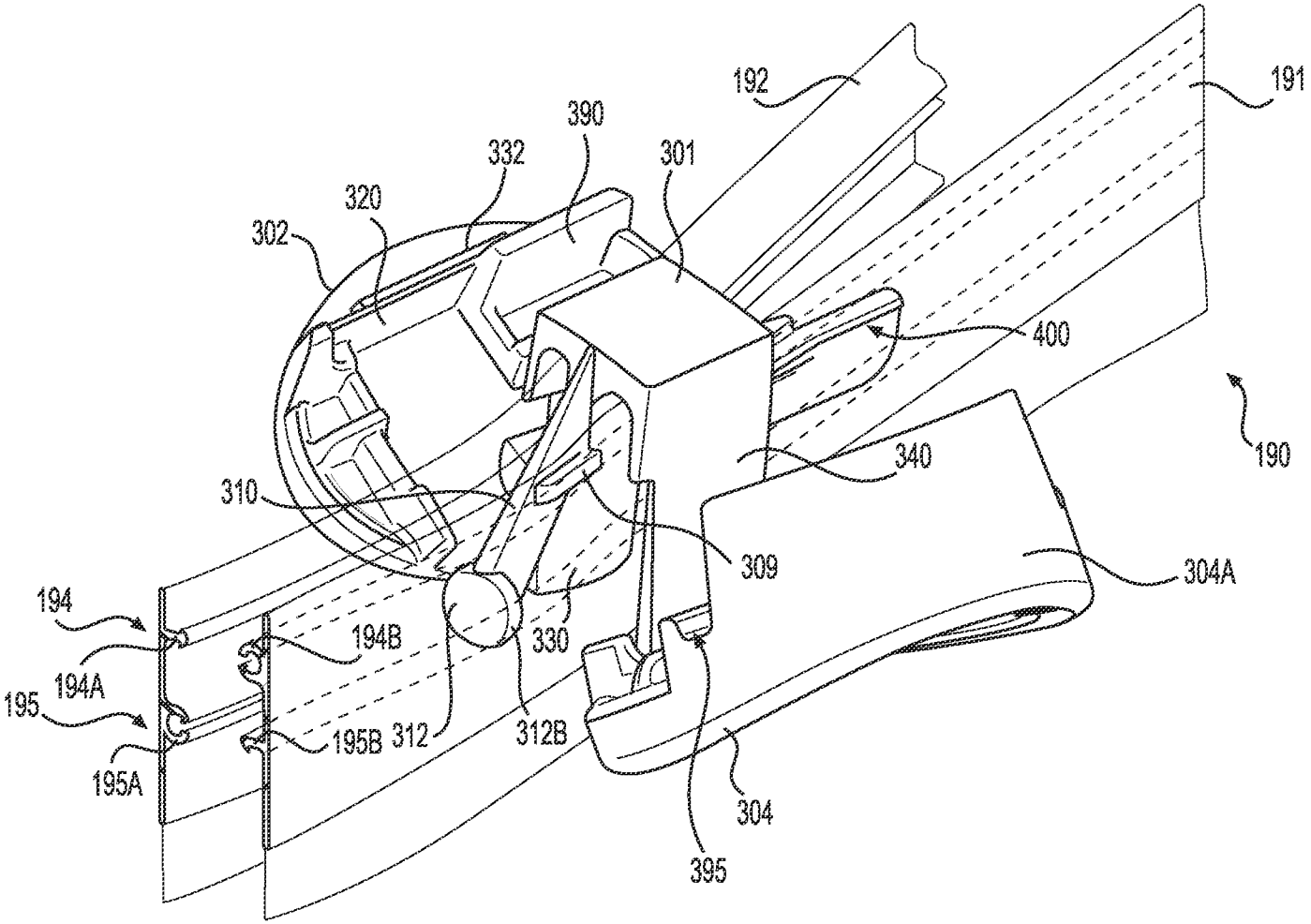
FIG. 35 is a top perspective view of the slider of FIG. 26 with wings of the slider being rotated upward to be positioned onto a closure assembly.
Figure 36:
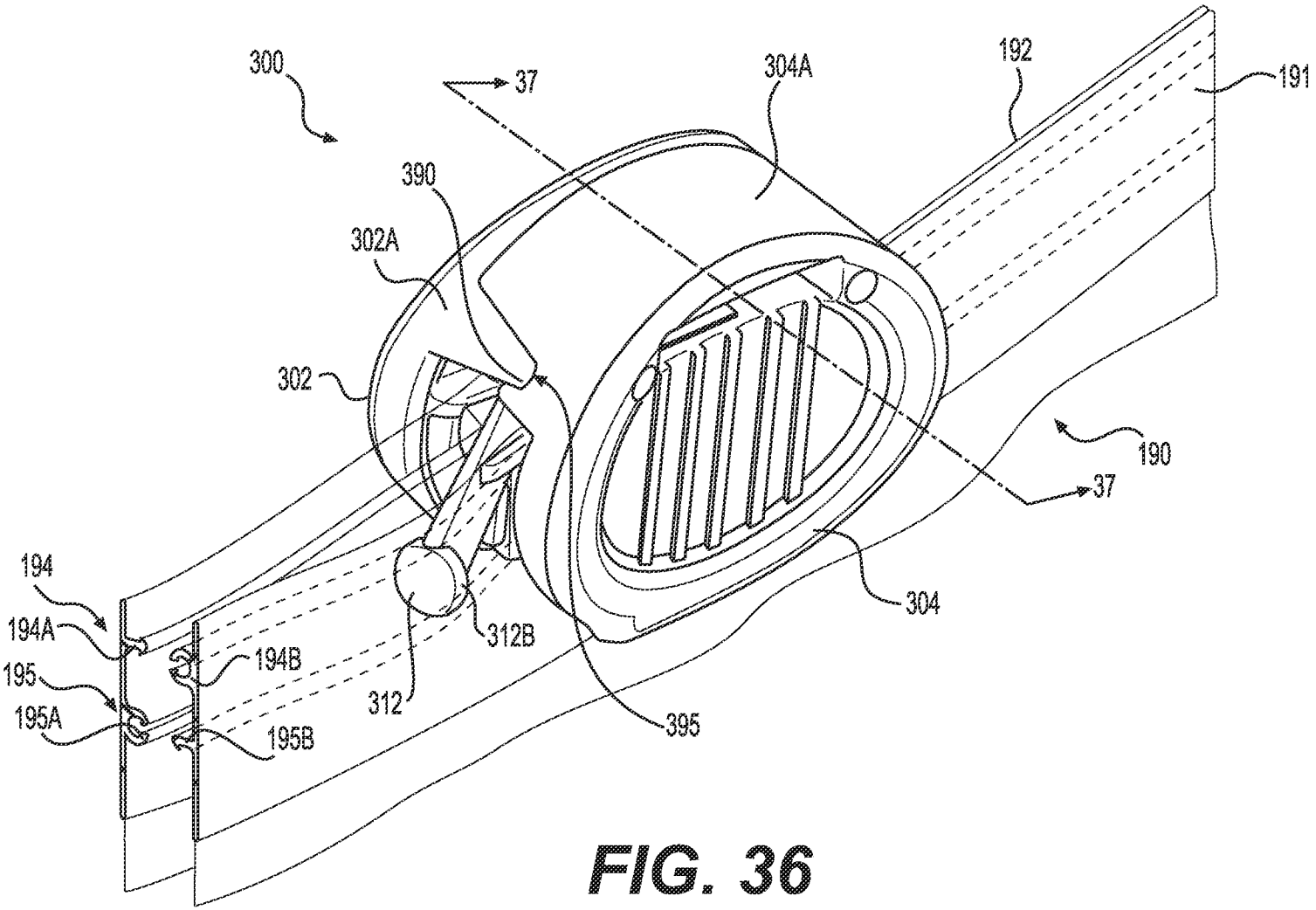
FIG. 36 is a top side perspective view of the slider of FIG. 26 in a closed position and being operatively engaged on a closure assembly.

FIG. 35 illustrates the initial hinging of the first and second wings 302, 304 of the slider 300. In particular, the first and second wings 302, 304 are rotated upward toward the top wall 301 of the slider 300 and the top of the bag 190, with the hinges 330A, 340A acting as the axis of rotation. FIG. 36 illustrates the first and second wings 302, 304 locked into place. In this closed position, the latch 332 of the first wing 302 is snapped into place on the opening 342 of the second wing 304, and the tongue member 390 has engaged with the groove member 395, such that the slider 300 is in an assembled condition and operatively engaged onto the closure assembly, i.e., the upper and lower zipper profiles 194, 195. As also shown in FIG. 36, the upper and lower zipper profiles 194, 195 are in an occluded position at least one end of the bag 190, such that the sidewalls 191, 192 are positioned adjacent to each other, and the first closure element 194A is occluded with the second closure element 194B of the upper zipper profile 194, and the first closure element 195A is occluded with the second closure element 195B of the lower zipper profile 195.

Figure 37:
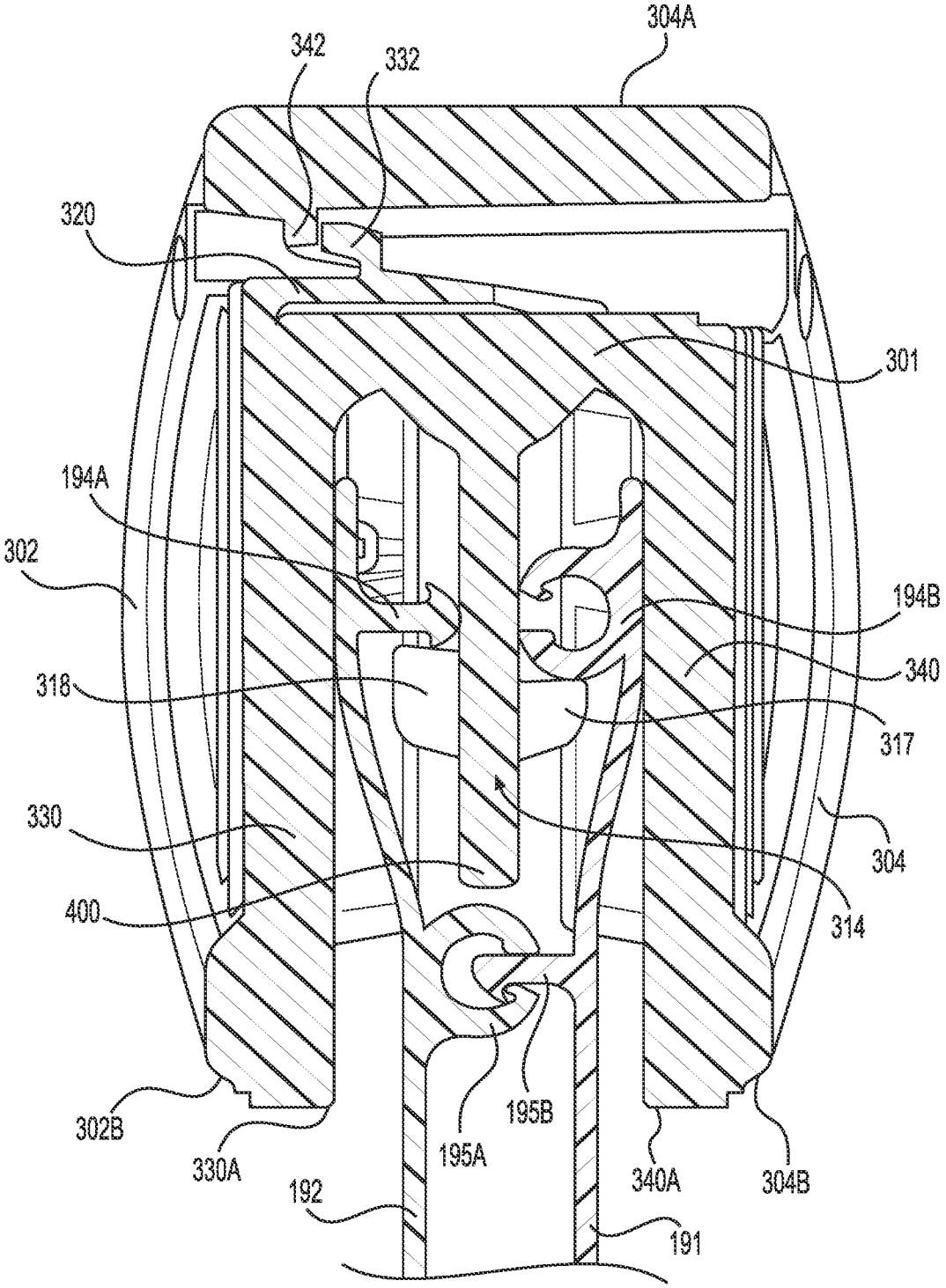
FIG. 37 is an enlarged partial cross-sectional view taken along line 37-37 of FIG. 36 showing the slider of FIG. 26, in a closed position, and being operatively engaged on a double zipper profile of a closure assembly with portions behind the plane of the cross section omitted for clarity.

FIG. 37 illustrates the slider 300 shown in FIG. 36 operatively engaged on the double zipper profile shown in FIGS. 34-36. As shown in FIG. 37, the first and second closure elements 194A, 194B of the upper zipper profile 194, and the first and second closure elements 195A, 195B of the lower zipper profile 195 are disposed underneath the top wall 301 of the slider 300 and between the legs 330, 340 and the first and second wings 302, 304. In this view, which is in the opening direction, the first zipper profile opening member 314, which extends from the top wall 301 of the slider 300, is disposed in the area between the first and second closure elements 194A, 194B of the upper zipper profile 194 and the first and second closure elements 195A, 195B of the lower zipper profile 195. In particular, the first zipper profile opening member 314 is wedged between the first and second closure elements 194A, 194B of the upper zipper profile 194, as the first zipper profile opening member 314 has de-occluded the first and second closure elements 194A, 194B of the upper zipper profile 194. As also shown in FIG. 37, an extension member 400, along with first and second retention members 317, 318, which will be described in more detail below, are positioned below the first and second closure elements 194A, 194B of the upper zipper profile 194 and above the first and second closure elements 195A, 195B of the lower zipper profile 195. The first zipper profile opening member 314, as well as the extension member 400, however, does not extend to a point adjacent to or below the first and second closure elements 195A, 195B of the lower zipper profile 195. FIG. 37 further illustrates the first wing 302 of the slider 300 extending from the top surface 304A of the second wing 304 to the bottom edge 302B and the hinge 330A, and the second wing 304 of the slider 300 extending from the top surface 304A to the bottom edge 304B and the hinge 340A.

Referring to FIGS. 31A, 31B, 36, and 37, when the slider 300 operatively moves, such as by being slid by a user, along the zipper profiles in an occluding direction, i.e., from right to left in FIG. 36, the first closing bars 355, 365 occlude the first and second closure elements 194A, 194B of the upper zipper profile 194, respectively. The second closing bars 370, 380 assist in occluding the first and second closure elements 195A, 195B of the lower zipper profile 195. When the slider 300 operatively moves in a de-occluding direction, i.e., from left to right in FIG. 36, the first zipper profile opening member 314 de-occludes the first and second closure elements 194A, 194B of the upper zipper profile 194, by extending therebetween and forcing these closure elements apart via a wedging action. Thereafter, the second zipper profile opening member 312, which trails behind the first zipper profile opening member 314 in the de-occluding direction, de-occludes the first and second closure elements 195A, 195B of the lower zipper profile 195, by interacting with or pressing upon at least the area between the upper and lower zipper profiles 194, 195. The retention members 308, 309, however, which are included on the support member 310 to assist in retaining the slider on a zipper profile, such as, for example, the upper zipper profile 194, are configured to not interact with or de-occlude the closure elements of the upper or lower zipper profiles 194, 195. Moreover, the extension member 400, as well as the first and second retention members 317, 318, discussed above, are also included to assist in retaining the slider on a zipper profile, such as, for example, the upper zipper profile 194, and are configured to not interact with or de-occlude the closure elements of the upper or lower zipper profiles 194, 195.

FIG. 38A illustrates portions of the slider 200/300, such that the support member 210/310, the first zipper profile opening member 214/314, and the second zipper profile opening member 212/312 of the embodiments shown in FIGS. 14-25 and FIGS. 26-37 can be shown with more clarity. As shown in FIG. 38A, the support member 210/310 extends from the top wall 201/301 of the respective slider 200, 300. The first zipper profile opening member 214/314 also extends from the top wall 201/301 of the respective slider 200, 300. In particular, the first zipper profile opening member 214/314 extends vertically down from the top wall 201/301 of the slider and an extension member 400 is attached to the first zipper profile opening member 214/314, and extends parallel to the direction of slider travel. The first zipper profile opening member 214/314 is configured to open closure elements of a closure assembly via a wedging action. Preferably, the first zipper profile opening member 214/314 is configured to open only the closure elements of an upper zipper profile of a double zipper profile assembly, via a wedging action. The extension member 400 is disposed underneath at least the closure elements of a single zipper closure assembly. In a preferred embodiment, the extension member 400 is positioned between an upper zipper profile 194 and a lower zipper profile 195 of a double zipper closure assembly (see, e.g., FIG. 37C), such that the extension member 400 of the first zipper profile opening member 214/314 is configured to act as a retention means. The extension member 400 also includes first and second retention members 217/317, 218/318, such that the first and second retention members 217/317, 218/318 and the extension member 400 itself, assist in retaining the slider on the zipper profiles, so that a user cannot easily pull the slider vertically off of the bag. Moreover, as shown more clearly in FIGS. 25 and 37, the first and second retention members 217/317, 218/318 are of slightly differing heights, such that the first retention member 217/317, which is preferably positioned underneath a female-shaped closure element (e.g., 194B), has less height or vertical distance than the second retention member 218/318, which is preferably positioned underneath a male-shaped closure element (e.g., 194A).

As further shown in FIG. 38A, the support member 210/310 includes a second zipper profile opening member 212/312 that includes a first shoulder member 212A/312A (not shown) and a second shoulder member 212B/312B that extend orthogonally to the direction of slider travel along the zipper profiles. The first and second shoulder members 212A/312A, 212B/312B preferably comprise arcuate members that extend toward respective closure elements of a closure assembly. The first and second shoulder members 212A/312A, 212B/312B of the second zipper profile opening member 212/312 enables the distal end of the support member 210/310 to reach the width necessary to de-occlude closure elements via a wedging action. The support member 210/310 also includes a retention member 209/309 that assists in retaining the slider on the zipper profiles, such that a user cannot easily pull the slider vertically off of the bag. The support member 210/310 preferably includes a similar retention member (i.e., 208/308) on the opposing side to the retention member 209/309, which is not shown in FIG. 38A. As shown more clearly in FIGS. 19B and 31B, the retention members 208/308, 209/309 are of slightly differing heights, such that the retention member 209/309, which is preferably positioned underneath a female-shaped closure element (e.g., 194B), has less height or vertical distance than the retention member 208/308, which is preferably positioned underneath a male-shaped closure element (e.g., 194A). The retention members 208/308, 209/309 of the support member 210/310, as well as the extension member 400 and the first and second retention members 217/317, 218/318, discussed above, assist in retaining the slider on the zipper profiles.

With respect to the support member 210/310 of FIGS. 38A and 38B, the second zipper profile opening member 212/312 is attached to the support member 210/310, which in turn is attached to the top wall 201/301 of the respective slider 200/300. In addition, the first zipper profile opening member 214/314 is directly attached to the top wall 201/301 of the respective slider 200/300, such that an open area 316 is disposed between the attachment of the first zipper profile opening member 214/314 to the top wall 201/301 and the attachment of the support member 210/310 to the top wall 201/301. Accordingly, in this embodiment, the slider is composed of two distinct members or separator fingers, namely, the support member 210/310 with the second zipper profile opening member 212/312, and the first zipper profile opening member 214/314. Alternatively, the first zipper profile opening member 214/314 and the second zipper profile opening member 212/312 can each be attached to the support member 210/310 to create a unitary separator finger or separating mechanism that is composed of a single member.

FIG. 38C illustrates an embodiment of the slider 200/300, along with the support member 210/310, the first zipper profile opening member 214/314, and the second zipper profile opening member 212/312 shown in FIG. 38A, operatively engaged on the double zipper profile shown in FIGS. 22-25 and FIGS. 34-37. As shown in FIG. 38C, the slider 200/300 is disposed on the bag 190 and maintains a straddling relation with the upper and lower zipper profiles 194, 195, such that at least the extension member 400 and the second zipper profile opening member 212/312 are disposed in the area between the upper zipper profile 194 and the lower zipper profile 195. In the embodiment of FIG. 38C, the second wing 204/304 of the slider 200/300 has been removed in order to clearly show the position of the support member 210/310 with the second zipper profile opening member 212/312 and the first zipper profile opening member 214/314 on the bag 190. As shown in FIG. 38C, the support member 210/310 extends from the top wall 201/301 of the slider 200/300 to a position between closure elements of the upper zipper profile 194 and closure elements of the lower zipper profile 195. In particular, the second zipper profile opening member 212/312 of the separator finger 210/310 is disposed in the area between the closure elements of the upper zipper profile 194 and the closure elements of the lower zipper profile 195. By positioning the second zipper profile opening member 212/312 in such a manner, the first shoulder member 212A/312A and the second shoulder member 212B/312B of the second zipper profile opening member 212/312 will interact with the area between the upper zipper profile 194 and the lower zipper profile 195, to separate closure elements of the lower zipper profile 195 via a wedging action. The support member 210/310, however, does not extend to a point between or below the closure elements of the lower zipper profile 195. As also shown in FIG. 38C, the first zipper profile opening member 214/314 extends from the top wall 201/301 of the slider 200/300 to a position between closure elements of the upper zipper profile 194 and closure elements of the lower zipper profile 195. By positioning the first zipper profile opening member 214/314 in such a manner, the first zipper profile opening member 214/314 will interact with the closure elements of the upper zipper profile 194 to separate these closure elements via a wedging action. The extension member 400 is disposed in the area between the closure elements of the upper zipper profile 194 and the closure elements of the lower zipper profile 195. The extension member 400, however, does not extend to a point between or below the closure elements of the lower zipper profile 195, such that the extension member 400 can function as a retention member (without impacting leakage) to assist in retaining the slider 200/300 on the zipper profiles. Accordingly, the extension member 400, as well as the first and second retention members 217/317, 218/318, are not configured to de-occlude closure elements of either the upper or lower zipper profiles 194, 195.

Referring to FIG. 38C, when the slider 200/300 operatively moves, such as by being slid by a user, along the zipper profiles in an occluding direction, i.e., from right to left in FIG. 38C, closure bars of the respective slider (such as those discussed in the embodiments shown in FIGS. 14-25 and FIGS. 26-37) occlude the closure elements of the upper and lower zipper profiles 194, 195. When the slider 200/300 operatively moves in a de-occluding direction, i.e., from left to right in FIG. 38C, the first zipper profile opening member 214/314 de-occludes the closure elements of the upper zipper profile 194 by extending therebetween and wedging the closure elements apart. Thereafter, the second zipper profile opening member 212/312, which trails behind the first zipper profile opening member 214/314 in the de-occluding direction, de-occludes the closure elements of the lower zipper profile 195. In particular, the first and second shoulder members 212A/312A, 212B/312B of the second zipper profile opening member 212/312 de-occlude the closure elements of the lower zipper profile 195 by pressing outwardly against the area between the upper and lower zipper profiles 194, 195, which forces the closure elements of the lower zipper profile 195 apart. As discussed above, the first and second shoulder members 212A/312A, 212B/312B of the first zipper profile opening member 212/312 enables the distal end of the support member 210/310 to reach the width necessary to de-occlude the closure elements of the lower zipper profile 195 via a wedging action.

Figure 39A:
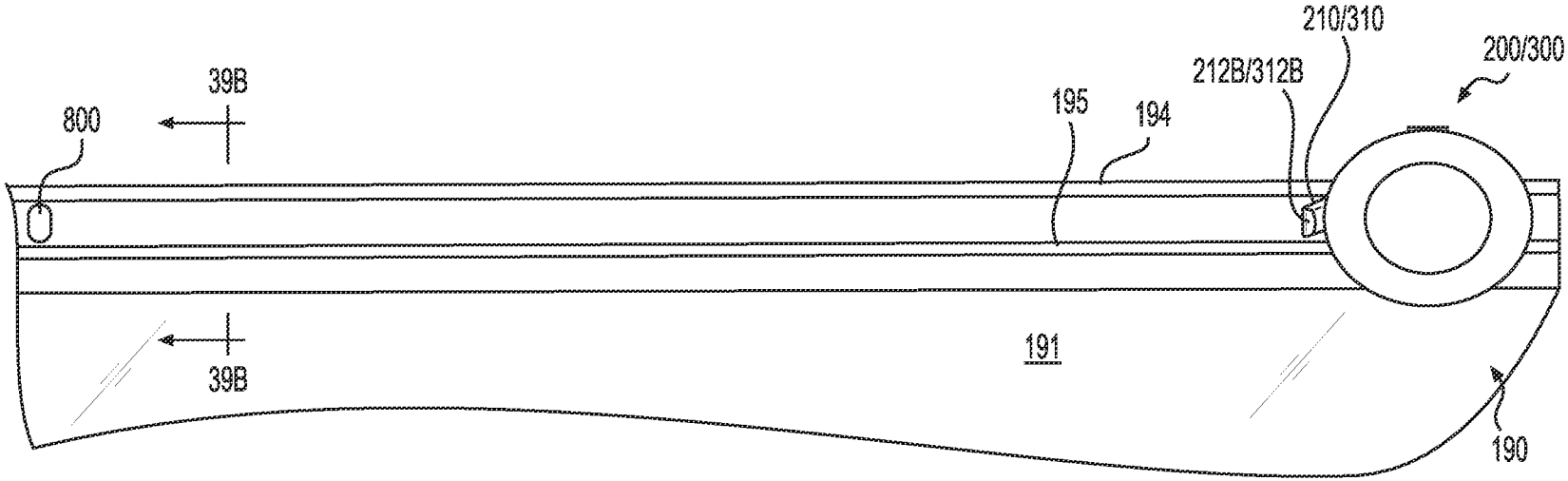
FIG. 39A is a partial side view of a bag including a detent at one end of the bag and the slider of FIGS. 14-37 operatively engaged on a double zipper profile of the bag.

FIG. 39A shows an embodiment of the slider 200/300 shown in the embodiments of FIGS. 14-25 and FIGS. 26-37 being operatively engaged on the bag 190 shown in FIG. 38C. As illustrated in FIG. 39A, the slider 200/300 maintains a straddling relation with the upper and lower zipper profiles 194, 195, such that at least the second zipper profile opening member 212/312 of the support member 210/310 (including the first and second shoulder members 212A/312A, 212B/312B) is disposed in the area between the upper zipper profile 194 and the lower zipper profile 195. In the embodiment shown in FIG. 39A, a detent 800 is included at one end of the bag in the area between the upper and lower zipper profiles 194, 195. The detent 800 comprises an indentation that is capable of engaging with at least one of the first and second shoulder members 212A/312A, 212B/312B of the second zipper profile opening member 212/312. The engagement of at least one of the first and second shoulder members 212A/312A, 212B/312B of the second zipper profile opening member 212/312 with the detent 800 ensures that the second zipper profile opening member 212/312 is not positioned in the area between the upper and lower zipper profiles 194, 195, in such a manner that the support member 210/310 and the second zipper profile opening member 212/312 de-occludes the lower zipper profile 195 at the end of the bag 190. Accordingly, the engagement of at least one of the first and second shoulder members 212A/312A, 212B/312B of the second zipper profile opening member 212/312 with the detent 800 can provide an end seal that prevents leakage, by ensuring that at least the lower zipper profile 195 is completely occluded along the length of the bag. The detent 800 must therefore, be positioned a predetermined distance from at least the lower zipper profile 195 to ensure an accurate engagement with the at least one of the first and second shoulder members 212A/312A, 212B/312B of the second zipper profile opening member 212/312. In one embodiment, the detent 800 is disposed in a position that is between at least about 60 mils and about 187.5 mils from the lower zipper profile 195. Moreover, in another embodiment, the detent 800 must be within 400 mils of the edge of the bag 190 to ensure proper occlusion of at least the lower zipper profile 195 at the end of the bag 190. The engagement of at least one of the first and second shoulder members 212A/312A, 212B/312B of the second zipper profile opening member 212/312 with the detent 800 can also provide a tactile sensation to a user and/or an audible click, thus assuring the user that the bag is sealed closed. By further tapering the structure of the first and second shoulder members 212A/312A, 212B/312B of the second zipper profile opening member 212/312, such that the first and second shoulder members 212A/312A, 212B/312B are thinner near the bottom of the indentation and thicker at the top of the indention, the structural integrity of the second zipper profile opening member 212/312 is maintained, while providing a maximum audio/haptic experience to a user via the engagement of at least one of the first and second shoulder members 212A/312A, 212B/312B of the second zipper profile opening member 212/312 with the detent 800. Although this embodiment has a detent 800 on only one end of the bag, the invention also encompasses detents on either one or both ends of the bag.

Figure 39B:
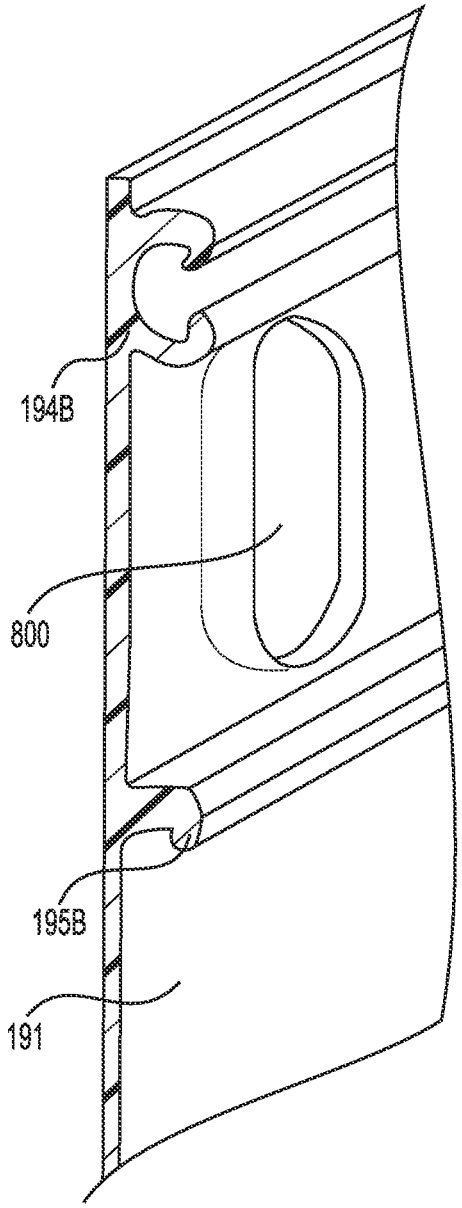
FIG. 39B is an enlarged partial cross-sectional view taken along line 39B-39B of FIG. 39A of the detent including on the bag of FIG. 39A with portions behind the plane of the cross section omitted for clarity.

FIG. 39B is an enlarged partial cross-sectional view of the detent 800 included on the bag shown in FIG. 39A. As shown in FIG. 39B, the detent 800 is disposed in the area between one of the closure elements (e.g., 194B) of the upper zipper profile and one of the closure elements (e.g., 195B) of the lower zipper profile of the double zipper profile illustrated in FIGS. 12, 25, and 37. By way of example, the detent 800 can be formed into the area between the upper zipper profile and the lower zipper profile using a punch and die assembly. Alternatively, the detent 800 can be formed by cutting, cold stomping, ultrasonic stomping, molding, or any other method for deforming thermoplastic material.

While FIGS. 39A and 39B illustrate an embodiment with a detent 800 at one end of a bag 190, the bag 190 is further shown without any end stomps at the edges or sidewelds of the bag 190. The sideweld encompasses the areas at the edges of the bag where the sidewalls of the bag, as well as the zipper profiles, are sealed. In one embodiment, the zipper profile(s) will be closed or sealed within 0.16 mils from the edges or ends of the bag 190. In another embodiment, the sideweld of at least the upper zipper profile 194 results in a sealed zipper profile with a thickness of about 45 mils to about 72 mils, preferably, about 52 mils to about 58 mils, and, most preferably, a thickness of about 56 mils. In this embodiment, the sideweld of the area between the upper and lower zipper profiles 194, 195 results in a sealed area between the profiles that has a thickness of about 4 mils to about 28 mils, preferably, about 12 mils to about 24 mils, and, more preferably, about 18 mils to about 22 mils. These sidewelds provide an area that both the second zipper profile opening member 212/312 of the support member 210/310 and the extension member 400 (see, e.g., FIG. 38C) can run into, or become entrapped by, at either the closing end or opening end of the bag, respectively, such that the slider 200/300 will not fall off of the ends of the bag 190. Accordingly, the sidewelds provide for axial slider retention without requiring an end stomp or end stop on the bag 190. In particular, the axial slider retention is provided due to at least the sealing of the upper zipper profile 194 at the edges of the bag 190 by, for example, thermal welding. In one embodiment, such a configuration of the sidewelds, including the thicknesses discussed above, as well as the slider 200/300 with the second zipper profile opening member 212/312, the support member 210/310, and the extension member 400, provides for an axial slider retention force of about 4 lbf to about 18 lbf.

Figure 40:
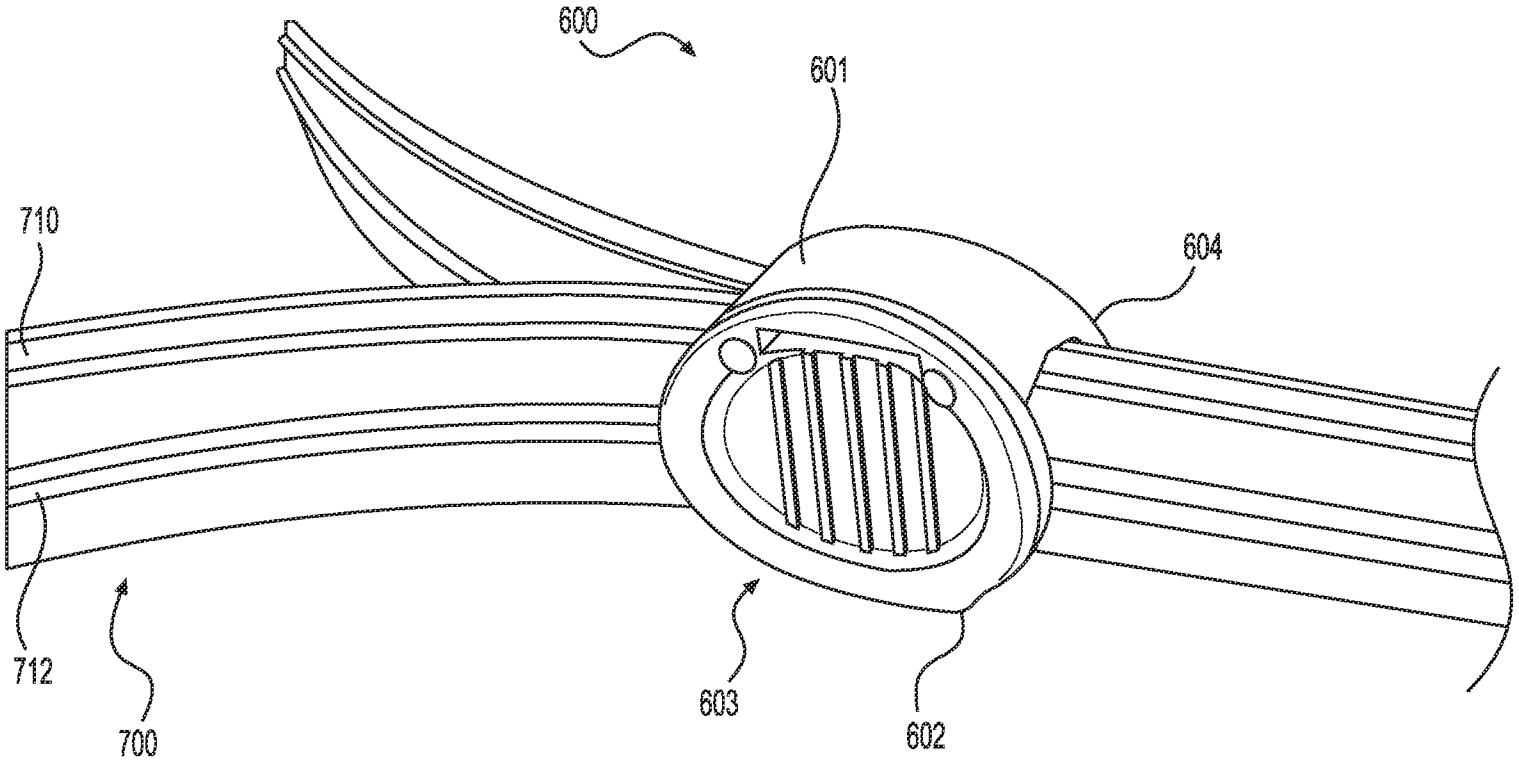
FIG. 40 is top perspective view of another embodiment of a slider, operatively engaged on a zipper profile of a closure assembly.

FIG. 40 illustrates a top prospective view of a bag 700 that includes an upper zipper profile 710 and a lower zipper profile 712. Although the embodiment of FIG. 40 illustrates a double zipper closure assembly, the bag 700 could alternatively include a single zipper closure assembly. As also shown in FIG. 40, a slider 600 is operatively engaged onto the zipper profiles 710, 712, so as to open and to close a top, open end of the bag 700. The slider 600 includes first and second wings 602, 604 extending from a top wall 601 of the slider 600, the first and second wings 602, 604 defining a channel therebetween in which a closure assembly, such as the double zipper closure assembly, can be operatively accepted. The first wing 602 includes a finger pad 603 that is filled-in with a material forming the slider. The second wing 604 also includes a similar finger pad (see, e.g., 605 of FIG. 41D) that is not shown in FIG. 40. Although the finger pad 603 is filled-in in the embodiment shown in FIG. 40, the finger pad 603 could alternatively be hollow or partially filled-in.

The shape of the finger pad 603 of FIG. 40 is substantially similar to the openings 103/203 of the embodiments of FIGS. 1-12 and FIGS. 14-25, as well as the arcuate portions 303/503 of the embodiments of FIGS. 16-37 and 13A. The inventors have found that creating the first and second wings of the slider with a finger pad that comprises an opening (103/203) or a arcuate portion (303/503/603) that is of an elliptical or oval shape, or generally any rounded shape, results in a slider with an improved ergonomic feel to a user. In particular, the elliptical or oval shape of the finger pad 303, as well as the opening (103/203) or the arcuate portion (303/503/603), of the first and second wings of the slider gives the user a comfortable area to place their fingers onto the slider, regardless of the angle of grasping the slider and/or the bag, when opening and closing a zipper profile(s) of a bag, such that the slider is both ergonomic and provides confidence to a user (young or old) in opening and closing the zipper profile(s) of the bag. Although an elliptical or oval shape for the finger pad 603 is discussed above, the finger pad 603 could be of a different shape, such as, for example, a circular, rectangular, or square shape, or any other polygonal shape, etc., since the specific shape and configuration of the finger pad can be altered without departing from the spirit of the invention. The primary feature of the shape of the finger pads 603, 605 is that the shape will accommodate the fingers of a user at any angle of the bag and the slider, such that the best grip on the slider with the least fatigue (e.g., strength amount) is provided. Accordingly, the various dimensions of the slider 600 and the finger pads 603, 605, which will be discussed in more detail below, are related to the average finger size of an adult human, and preferably, an average female adult.

Figure 41A:
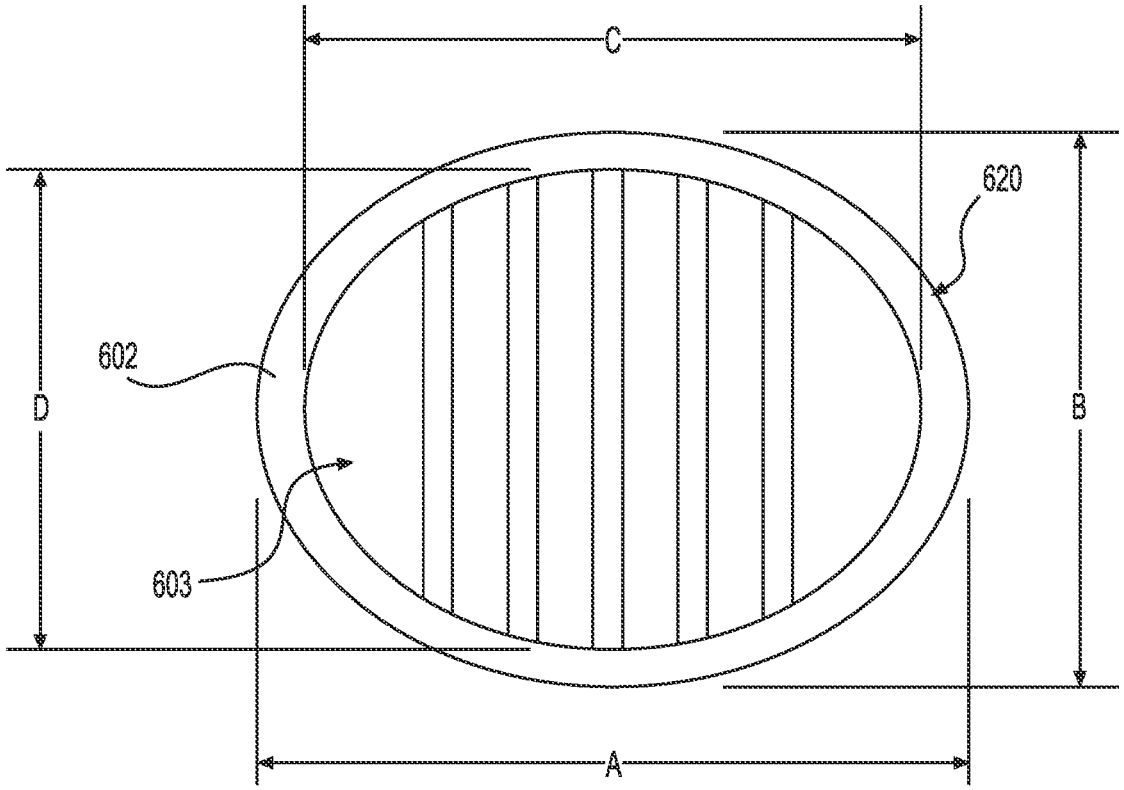
FIG. 41A is a side view of a wing of the slider of FIG. 40, showing dimensions of the wing, with other portions of the slider omitted for clarity.

As shown in FIG. 41A, the first wing 602 of the slider 600 includes the finger pad 603. In particular, the first wing 602 includes the finger pad 603 that is surrounded by a lip region 620. The combination of the finger pad 603 with the lip region 620 of the first wing 602 has overall dimensions that relate to a major axis (A) and a minor axis (B). The finger pad 603 itself, without the lip region 620, has overall dimensions that relate to a secondary major axis (C) and a secondary minor axis (D). To create a slider with the improved ergonomic feel, as discussed above, the major axis (A) for the finger pad 603 and the surrounding lip region 620 of the first wing 602 is preferably from about 12.0 mm to about 19.0 mm, more preferably, from about 14.0 mm to about 18.0 mm, even more preferably, from about 15.0 mm to about 17.7 mm, and, most preferably, from about 16.0 mm to about 17.7 mm. Moreover, to create a slider with the improved ergonomic feel, the minor axis (B) for the finger pad 603 and the surrounding lip region 620 of the first wing 602 is preferably from about 10.5 mm to about 16.0 mm, more preferably, from about 11.0 mm to about 15.0 mm, even more preferably, from about 12.0 mm to about 14.0 mm, and, most preferably, from about 13.0 mm to about 14.0 mm. Thus, in one preferred embodiment, the major axis (A) and the minor axis (B) of the overall dimensions for the finger pad 603 and the surrounding lip region 620 are set at about 16.0 mm and about 13.0 mm, respectively, or about 17.7 mm and about 14.0 mm, respectively. In another embodiment, the major axis (A) and the minor axis (B) of the overall dimensions for the finger pad 603 and surrounding lip region 620 are set at about 18.0 mm and about 15.0 mm, respectively, or about 19.0 mm and about 16.0 mm, respectively. Alternatively, in another preferred embodiment, the major axis (A) and the minor axis (B) of the overall dimensions for the finger pad 603 and surrounding lip region 620 are set at about 15.0 mm and about 12.0 mm, respectively, or about 14.0 mm and about 11.0 mm, respectively, or about 12.0 mm and about 10.5 mm, respectively. In yet another embodiment, the major axis (A) and the minor axis (B) of the overall dimensions for the finger pad 603 and surrounding lip region 620 are set at a ratio of A to B of about 1.25 to 1. In addition, various other ratios between the major axis (A) and the minor axis (B) can be extrapolated, dependent upon the various values discussed above. Moreover, in one embodiment, the major axis (A) and the minor axis (B) of the overall dimensions for the finger pad 603 and the surrounding lip region 620 correspond to the following equation for an ellipse:

$$\frac{X^2}{A^2} + \frac{Y^2}{B^2} = 1$$

where X and Y represent the coordinates of any point on the elliptical shape of the finger pad 603 and the surrounding lip region 620.

In addition, to create a slider with an improved ergonomic feel, the secondary major axis (C) of the finger pad 603 is preferably from about 8.75 mm to about 13.9 mm, more preferably, from about 10.3 mm to about 13.2 mm, even more preferably, from about 11.0 mm to about 12.5 mm, and, most preferably, from about 11.7 mm to about 12.5 mm. In addition, the secondary minor axis (D) of the finger pad 603 is preferably from about 8.1 mm to about 12.4 mm, more preferably, from about 8.5 mm to about 11.8 mm, even more preferably, from about 9.3 mm to about 10.8 mm, and, most preferably, from about 10.0 mm to about 10.8 mm. Thus, in one preferred embodiment, the secondary major axis (C) and the secondary minor axis (D) of the dimensions for the finger pad 603 are set at about 11.7 mm and about 10.0 mm, respectively, or about 12.5 mm and about 10.8 mm, respectively. In another embodiment, the secondary major axis (C) and the secondary minor axis (D) of the dimensions for the finger pad 603 are set at about 13.2 mm and about 11.8 mm, respectively, or about 13.9 mm and about 12.4 mm, respectively. Alternatively, in another preferred embodiment, the secondary major axis (C) and the secondary minor axis (D) of the dimensions for the finger pad 603 are set at about 11.0 mm and about 9.3 mm, respectively, or about 10.3 mm and about 8.5 mm, respectively, or about 8.75 mm and about 8.1 mm, respectively. In one embodiment, the secondary major axis (C) and the secondary minor axis (D) of the dimensions for the finger pad 603 may correspond to the equation of an ellipse, as discussed above. Moreover, in another embodiment where both the overall finger pad 603 with the surrounding lip 620 comprises an ellipse, and the finger pad 603 itself comprises an ellipse, the area of the overall elliptical shape of the finger pad 603 and surrounding lip 620 is about 1.70 to about 1.80 times than the area of the elliptical shape of the finger pad 603 itself (the area being calculated for an ellipse). In yet another embodiment, the major axis (A) is about 1.25 to about 1.45 times larger than the secondary major axis (C), and the minor axis (B) is about 1.25 to about 1.45 times larger than the secondary minor axis (D). In addition, various other ratios between the major axis (A), the minor axis (B), the secondary major axis (C), and/or the secondary minor axis (D) can be extrapolated, dependent upon the various values discussed above. These preferred embodiments provide major axis (A) dimensions, minor axis (B) dimensions, secondary major axis (C) dimensions, and secondary minor axis (D) dimensions of the finger region 603 and/or the lip region 620 that is ideal for most, if not all, finger sizes of a user. Although not shown in FIG. 41A, the second wing 604 of the slider 600 also includes a similar finger pad and surrounding lip region (see, e.g., 605 of FIG. 41D) that would include the same dimensions as those of the finger pad 603 and/or surrounding lip region 620.

Figure 41B:
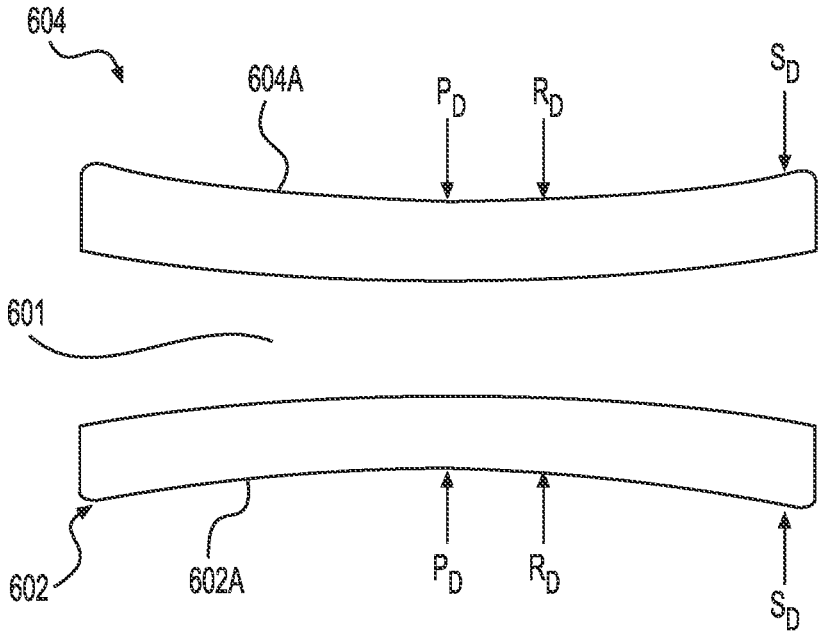
FIG. 41B is a top view of the slider of FIG. 40, showing the dimensions of the top wall, with other portions of the slider omitted for clarity.

FIG. 41B is a top view of the slider 600 of FIG. 40 that illustrates the top wall 601 of the slider 600, as well as a pinch dimension ($P_D$) of a center section of the top wall 601, a saddle dimension ($S_D$) of an end section(s) of the top wall 601, and a ribbon dimension ($R_D$) for a region between the center section and the end section(s) of the top wall 601. The pinch dimension ($P_D$) is the width of the center section of the top wall 601 between opposing outer edges of the top surface 602A of the first wing 602 and the top surface 604A of the second wing 604. The saddle dimension ($S_D$) is the width of the end section(s) of the top wall 601 between opposing outer edges of an end of the top surface 602A of the first wing 602 and an opposing end of the top surface 604A of the second wing 604. The ribbon dimension ($R_D$) is the width of a region between the center section and the end section(s) of the top wall 601 between opposing outer edges of the top surface 602A of the first wing 602 and the top surface 604A of the second wing 604. Similar to the major axis (A), the minor axis (B), the secondary major axis (C), and the secondary minor axis (D) dimensions of the finger pad 603 and/or lip region 620 of the first wing 602, the pinch dimension ($P_D$), the saddle dimension ($S_D$), and the ribbon dimension ($R_D$) are set so as to provide a slider with an improved ergonomic feel to a user by accommodating any angle that the user grips the slider with when opening or closing the bag. In particular, the pinch dimension ($P_D$) is preferably from about 5.72 mm to about 10.16 mm, and, more preferably, from about 5.72 mm to about 7.24 mm, while the saddle dimension ($S_D$) is preferably from about 7.62 mm to about 10.16 mm. The inventors have found that a pinch dimension ($P_D$) that is as small as possible, without going under about 5.72 mm, and a saddle dimension ($S_D$) that as large as possible, without going over about 10.16 mm, such that the difference between the pinch dimension ($P_D$) and the saddle dimension ($S_D$) is as large as possible, provides a slider with an improved ergonomic feel because this provides a "pinching" feeling that users prefer when opening or closing zipper profiles of a bag (that also uses less effort and causes less fatigue). Thus, in one preferred embodiment, the pinch dimension ($P_D$) is about 5.8 mm with a saddle dimension ($S_D$) of about 9.83 mm. Moreover, the ribbon dimension ($R_D$) is preferably from about 6.35 mm to about 10.16 mm, or preferably about 7.62 mm, or most preferably, about 7.40 mm. Alternatively, the ribbon dimension ($R_D$) can be substantially equal to the value for the pinch dimension ($P_D$), such that at least part of the curved portion of the finger pad 603 levels or flattens out in this area. In addition, various ratios between the pinch dimension ($P_D$), the saddle dimension ($S_D$), and/or the ribbon dimension ($R_D$) can be extrapolated, dependent upon the various values discussed above.

Figure 41C:
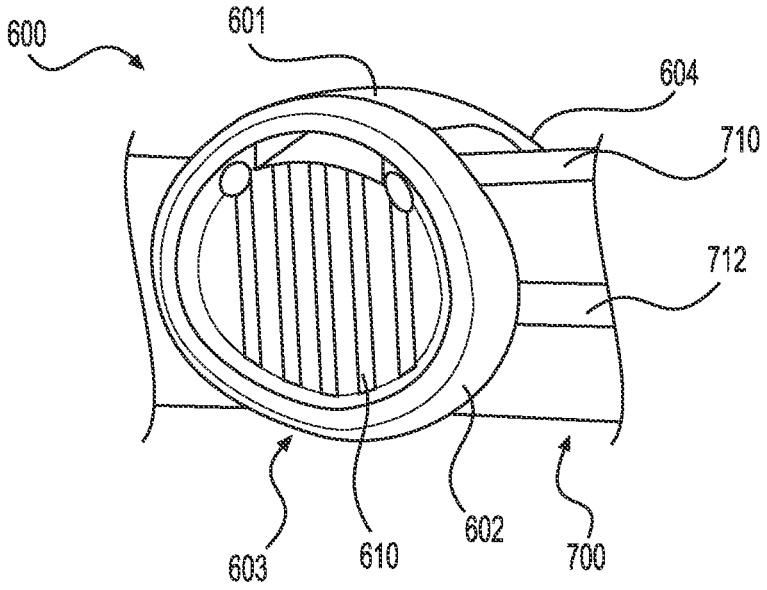
FIG. 41C is a side perspective view of the slider of FIG. 40 operatively engaged on a zipper profile of a closure assembly, with one embodiment for gripping ridges of the slider.
Figure 41D:
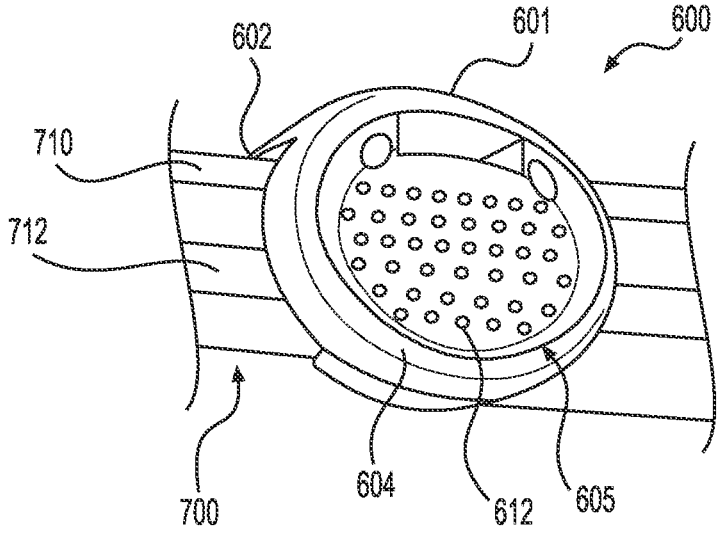
FIG. 41D is a side perspective view of the slider of FIG. 40 operatively engaged on a zipper profile of a closure assembly, with another embodiment for gripping ridges of the slider.

FIGS. 41C and 41D illustrate two types of grips of the improved ergonomic slider 600, in which the slider 600 includes a first type of grip 610 in the finger pad 603 of the first wing 602 of the embodiment of FIG. 41C, and a second type of grip 612 in the finger pad 605 of the second wing 604 of the embodiment of FIG. 41D. In the embodiment of FIG. 41C, the grip 610 comprises a plurality of vertically extending ridges that run from a top edge to a bottom edge of the finger pad 603 of the first wing 602. Although not shown in FIG. 41C, a similar finger pad (e.g., 605 of FIG. 41D) of the second wing 604 would include a similar grip 610. Alternatively, in the embodiment of FIG. 41D, the grip 612 comprises a plurality of circular protrusions or indentations on the finger pad 605 of the second wing 604. Although not shown in FIG. 41D, a similar finger pad (e.g., 603 of FIG. 41C) of the first wing 602 would include a similar grip 612. The grips 610/612 give the user a tactile guide or perception that assists in holding and sliding the slider 600 along zipper profiles of a bag (e.g., the upper and lower zipper profiles 710, 712 of the bag 700).

Figure 41E:
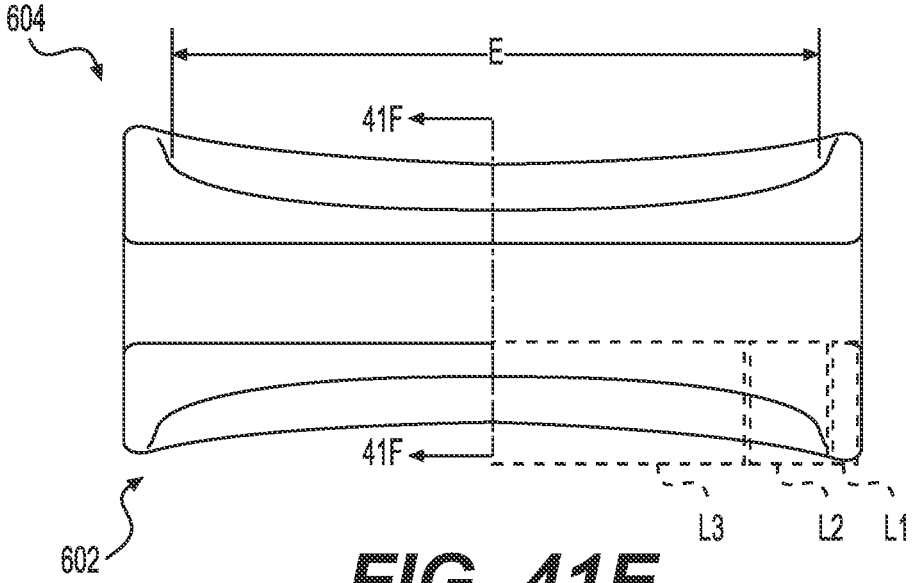
FIG. 41E is a bottom view of the slider of FIG. 40 showing dimensions for the slider, with portions of the slider omitted for clarity.
Figure 41F:
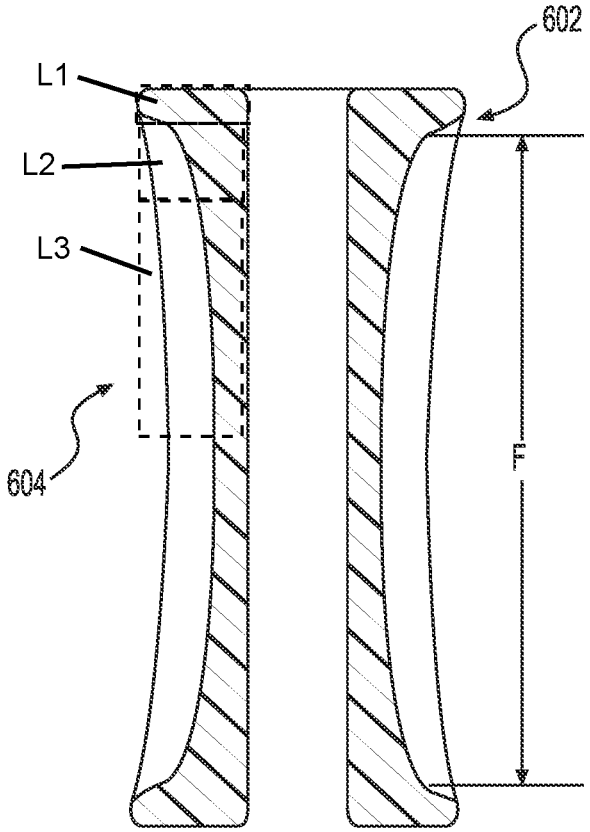
FIG. 41F is an enlarged cross-sectional view taken along line 41F-41F of FIG. 41E showing dimensions of the slider of FIG. 40, with portions of the slider omitted for clarity.

FIG. 41E illustrates a bottom view of the slider 600 of FIG. 40, while FIG. 41F illustrates a cross-sectional view of the slider 600 of FIG. 40. In both FIGS. 41E and 41F, portions of the slider 600 and/or bag 700 have been removed for clarity. FIG. 41E illustrates an overall length (E) for a first curved portion of the finger pad 605 of the second wing 604 for the slider 600 from one end of the second wing 604 to an opposing end of the second wing 604. The finger pad 603 of the first wing 602 would also include a similar length (E) dimension for a first curved portion of the finger pad 603. FIG. 41F illustrates a height dimension (F) for a second curved portion of the finger pad 603 of the first wing 602 of the slider 600 from the top of the slider 600, or a top end of the first wing 602 to a bottom end of the first wing 602. The finger pad 605 of the second wing 604 would also include a similar height (F) dimension for a second curved portion of the finger pad 605. Accordingly, the finger pads 603, 605 include two curved portions, a first curved portion that runs from a front end to a back end of the slider 600, and a second curved portion that runs from the top end to a bottom end of the wings 602, 604 and/or the finger pads 603,605. By providing finger pads 603, 605 with two curved portions in opposing directions, the slider has an improved ergonomic feel because the two curved portions fit with the natural curves of the fingers of a user. As with the various dimensions discussed above, the length dimension (E) and the height dimension (F) are set so as to provide a slider with an improved ergonomic feel to a user. In particular, the length dimension (E) is preferably set at about 8.5 mm to about 14.0 mm, more preferably, at about 11.0 mm to about 13.5 mm, and most preferably, at about 11.5 mm to about 12.5 mm. In addition, the height dimension (F) is preferably set at about 8.0 mm to about 12.5 mm, more preferably, at about 9.0 mm to about 12.0 mm, and most preferably, at about 10.0 mm to about 11.0 mm. In addition, various ratios between the length dimension (E) and the height dimension (F) can be extrapolated, dependent upon the various values discussed above. The inventors have found that such a length dimension (E) of a first curved portion of the finger pads 603, 605 and a height dimension (F) of a second curved portion of the finger pads 603, 605 provide a slider that can accommodate most finger sizes of a user, and that allows for fingers to easily settle into the grip area (i.e., 610/612 of FIGS. 41C and 41D) of the slider 600.

As discussed above, the first wing 602 (as well as the second wing 604) includes a lip region 620 that surrounds the finger pad 603 (or finger pad 605 on the second wing 604). The lip region 620 is an area that surrounds the finger pad 603, and is not a region within the first or second curved portions of the finger pad 603. The lip region 620 provides a slightly elevated area that surrounds the finger pad 603, which thus, guides the fingers of a user into the finger pad 603. The lip region 620 preferably has a length (L1 of FIG. 41E) of about 0.5 mm to about 4.0 mm, more preferably, about 1.0 mm to about 3.0 mm, and most preferably, about 1.5 mm to about 2.5 mm. The lip region 620 ends at the edge of the finger pad 603 at a first area (L2 of FIG. 41E) that begins the first curved portion of the finger pad 603. The first area (L2), which begins the curve down into the finger pad 603, preferably has a length from about 0.1 mm to about 4.0 mm, more preferably, about 0.5 mm to about 2.0 mm, and most preferably, about 1.1 mm to about 1.5 mm. The area (L2), which has the deepest angle down into the finger pad 603, ends at a second area (L3 of FIG. 41E) that extends from the first area (L2) to the middle of the first curved portion of the finger pad 603. In one embodiment, the area (L2) has an angle of between about 10 degrees and 90 degrees from the lip region (L1). The second area (L3) preferably has a length of about 2.0 mm to about 7.0 mm, more preferably, about 3.0 mm to about 6.0 mm, and most preferably, about 3.5 mm to about 5.0 mm. The second area (L3) has a less deep angle than the first area (L2), and ends at the midpoint of the first curved portion of the finger pad 603. At the midpoint of the first curved portion of the finger pad 603, the finger pad 603 begins to curve back up to the opposing end of the finger pad 603 and the opposing side of the lip region 620. The first area (L2) and the second area (L3) can comprise entirely curved portions that end at the midpoint of the first curved portion of the finger pad 603 before begin to curve back up to the opposing edge of the finger pad 603. Alternatively, the second area (L3) may comprise a flattened area at or near the midpoint of the first curved portion of the finger pad 603. As with all of the other dimensions discussed above, the length (L1) of the lip region 620, as well as the first area (L2) and the second area (L3), are set so as to provide a slider with an improved ergonomic feel to a user that can also accommodate most finger sizes of a user. Through the combination of features and dimensions discussed above, a slider 600 is provided with improved ergonomic features and a shape that will accommodate the fingers of a user at any angle of the bag and the slider.

Illustrative thermoplastic materials that could be used to form the various bags discussed above include, for example, polypropylene (PP), polyethylene (PE), metallocene-polyethylene (mPE), low density polyethylene (LDPE), linear low density polyethylene (LLDPE), ultra low density polyethylene (ULDPE), biaxially-oriented polyethylene terephthalate (BPET), high density polyethylene (HDPE), polyethylene terephthalate (PET), among other polyolefin plastomers and combinations and blends thereof. Still other materials that may be used include styrenic block copolymers, polyolefin blends, elastomeric alloys, thermoplastic polyurethanes, thermoplastic copolyesters, thermoplastic polyamides, polymers and copolymers of polyvinyl chloride (PVC), polyvinylidene chloride (PVDC), saran polymers, ethylene/vinyl acetate copolymers, cellulose acetates, polyethylene terephthalate (PET), ionomer, polystyrene, polycarbonates, styrene acryloacrylonitrile, aromatic polyesters, linear polyesters, and thermoplastic polyvinyl alcohols. Those skilled in the art will recognize that a wide variety of other materials may also be used to form the bags.

The single or double zipper profiles of the various embodiments discussed above may each be formed of thermoplastic, such as low density polyethylene (LDPE), high density polyethylene (HDPE), linear low density polyethylene (LLDPE), and combinations thereof. In one embodiment, for example, backing members (or flanges) of the zipper profiles can be formed of a mixture of HDPE, LDPE, and LLDPE to be more rigid, and the closure elements are formed of LDPE to be suppler. The zipper profiles may be disposed on a bag, such as by laminating at least a portion of backing members (e.g., flanges) of the zipper profiles to respective sidewalls of the bag. Alternatively, the backing members (e.g., flanges) of the zipper profiles can be omitted, such that the closure elements of the zipper profiles are directly attached, via, for example, lamination, to respective sidewalls of the bag.

It should be noted that, although the various bags described herein include single or double zipper closure assemblies, other embodiments of the bags can include more than two zipper closure profiles. It should also be noted that the closure elements of the zipper profiles do not necessarily need to fully extend to the edges of the bags. For example, in some embodiments, the bag may include extended sealed sections at the edges of the bag, with the closure elements of the zipper profiles configured to extend only from one sealed section to the other, and not all the way to the edges of the bag.

Each of the sliders illustrated and described herein may be operatively engaged with a single zipper profile or a double zipper profile, such as upper zipper profile 194 and lower zipper profile 195. The sliders may be made in multiple parts and welded together, or the parts may be constructed to be snapped together either with or without the hinged elements. The sliders may also be of one piece construction. The sliders can be made using any desired method, such as, for example, injection molding or any other method. The sliders can be molded from any suitable plastic such as, for example, nylon, polypropylene, polystyrene, acetal, toughened acetal, polyketone, polybutylene terephthalate, high density polyethylene, polycarbonate, or acrylonitrile butadiene styrene (ABS). The sliders can be clear, opaque, or colored. Furthermore, it is contemplated that parts and features of any one of the specific embodiments of the various sliders can be interchanged with parts and features of any other embodiments without departing from the spirit of the invention.

Although this invention has been described with respect to certain specific exemplary embodiments, many additional modifications and variations would be apparent to those skilled in the art in light of this disclosure. It is, therefore, to be understood that this invention may be practiced otherwise than as specifically described. Thus, the exemplary embodiments of the invention should be considered in all respects to be illustrative and not restrictive, and the scope of the invention to be determined by any claims supportable by this application, and the equivalents thereof, rather than by the foregoing description.

INDUSTRIAL APPLICABILITY

The hinged sliders described herein provide a beneficial way of sealing and unsealing closure assemblies of almost any kind, such as by occluding and de-occluding a pouch or a thermoplastic storage bag for storing products therein. The slider may completely seal and unseal a single or double zipper profile without having any leaks when the slider is at a closed end of the zipper profile.

We claim:

1. A slider for a bag, the slider comprising:

(a) a top wall that extends from a front end to a back end of the slider;

(b) a pair of finger pads extending from the top wall, each finger pad of the pair of finger pads having a top end and a bottom end, and each of the finger pad of the pair of finger pads further having a surface that includes (i) a curved portion that runs from the front end to the back end of the slider, (ii) a defined, first curved area that extends from the curved portion to an end of the first curved area, and (iii) a defined, second curved area that extends from the end of the first curved area to a midpoint of the curved portion, with the first curved area being defined by a first angle at which the first curved area extends into the respective finger pad and the second curved area being defined by a second angle at which the second curved area extends into the respective finger pad, with the first angle differing from the second angle, wherein each of the finger pad of the pair of finger pads includes (i) a major axis that runs from the front end to the back end of the slider, and (ii) a minor axis that runs from the top end to the bottom end of the respective finger pad, such that the major axis has a dimension that is greater than a dimension of the minor axis to provide an area for a finger to grip; and (c) a lip region that surrounds at least the top end and the bottom end of each of the finger pad of the pair of finger pads, without extending into the curved portion, the first curved area, and the second curved area of the surface of each of the finger pad of the pair of finger pads, to guide a finger of a user into each of the finger pad of the pair of finger pads, wherein the lip region of each of the finger pad of the pair of finger pads has a surface that is elevated relative to and surrounds at least a portion of the surface of the respective finger pad.

2. The slider according to claim 1, wherein the major axis dimension of each of the finger pad of the pair of finger pads is from about 8.75 mm to about 13.9 mm, and the minor axis dimension of each of the finger pad of the pair of finger pads is from about 8.1 mm to about 12.4 mm.

3. The slider according to claim 1, wherein the major axis dimension of each of the finger pad of the pair of finger pads is about 1.10 times to about 1.72 times greater than the minor axis dimension of each of the finger pad of the pair of finger pads.

4. The slider according to claim 1, wherein the curved portion of each of the finger pad of the pair of finger pads has a length in the major axis dimension, with the length of the curved portion of each of the finger pad of the pair of finger pads being about 8.5 mm to about 14.0 mm.

5. The slider according to claim 1, wherein a pinch dimension of a center section of the top wall is from about 5.72 mm to about 10.16 mm.

6. The slider according to claim 1, wherein the surface of the lip region of each of the finger pad of the pair of finger pads extends a distance from an end of the respective lip region to the first curved area of the corresponding finger pad.

7. The slider according to claim 1, wherein each of the finger pad of the pair of finger pads comprises gripping ridges.

8. The slider according to claim 7, wherein the gripping ridges comprise at least one of (i) vertically extending ridges and (ii) circular protrusions.

9. The slider according to claim 1, wherein each of the finger pad of the pair of finger pads is concave.

10. The slider according to claim 1, wherein the first angle of each of the first curved areas of each of the finger pad of the pair of finger pads is greater than the second angle of each of the second curved areas of each of the finger pad of the pair of finger pads.

11. A slider for a bag, the slider comprising:

(a) a top wall that extends from a front end to a back end of the slider;

(b) a pair of finger pads extending from the top wall, each finger pad of the pair of finger pads having a top end and a bottom end, and each of the finger pad of the pair of finger pads further having a surface that includes (i) a curved portion that runs from the front end to the back end of the slider, (ii) a defined, first curved area that extends a distance L1 from the curved portion to an end of the first curved area, and (iii) a defined, second curved area that extends a distance L2 from the end of the first curved area to a midpoint of the curved portion, with the distance L2 being greater than the distance L1, wherein each of the finger pad of the pair of finger pads includes (i) a major axis that runs from the front end to the back end of the slider, and (ii) a minor axis that runs from the top end to the bottom end of the respective finger pad, such that the major axis has a dimension that is greater than a dimension of the minor axis to provide an area for a finger to grip; and (c) a lip region that surrounds at least the top end and the bottom end of each of the finger pad of the pair of finger pads, without extending into the curved portion, the first curved area, and the second curved area of the surface of each of the finger pad of the pair of finger pads, to guide a finger of a user into each of the finger pad of the pair of finger pads, wherein the lip region of each of the finger pad of the pair of finger pads has a surface that is elevated relative to and surrounds at least a portion of the surface of the respective finger pad.

12. The slider according to claim 11, wherein the major axis dimension of each of the finger pad of the pair of finger pads is from about 8.75 mm to about 13.9 mm, and the minor axis dimension of each of the finger pad of the pair of finger pads is from about 8.1 mm to about 12.4 mm.

13. The slider according to claim 11, wherein the major axis dimension of each of the finger pad of the pair of finger pads is about 1.10 times to about 1.72 times greater than the minor axis dimension of each of the finger pad of the pair of finger pads.

14. The slider according to claim 11, wherein the curved portion of each of the finger pad of the pair of finger pads has a length in the major axis dimension, with the length of the curved portion of each of the finger pad of the pair of finger pads being about 8.5 mm to about 14.0 mm.

15. The slider according to claim 11, wherein at least one of (i) a pinch dimension of a center section of the top wall is from about 5.72 mm to about 10.16 mm, and (ii) a saddle dimension of one or more end sections of the top wall is from about 7.62 mm to about 10.16 mm.

16. The slider according to claim 11, wherein the surface of the lip region of each of the finger pad of the pair of finger pads extends a distance L3 from an end of the respective lip region to the first curved area of the corresponding finger pad.

17. The slider according to claim 11, wherein each of the first curved areas of each of the finger pad of the pair of finger pads extends the distance L1 from the respective lip region to the second curved area of the corresponding finger pad.

18. The slider according to claim 11, wherein each of the finger pad of the pair of finger pads comprises gripping ridges.

19. The slider according to claim 18, wherein the gripping ridges comprise at least one of (i) vertically extending ridges and (ii) circular protrusions.

20. The slider according to claim 11, wherein each of the finger pad of the pair of finger pads is concave.

* * * * *